US011085653B2

(12) United States Patent
Swanson et al.

(10) Patent No.: US 11,085,653 B2
(45) Date of Patent: Aug. 10, 2021

(54) AIR CONDITIONER AND AN AIR CONDITIONER HOUSING

(71) Applicant: Premium Home Comfort, Inc., Philadelphia, PA (US)

(72) Inventors: Kurt M. Swanson, Philadelphia, PA (US); Devin Sidell, Swarthmore, PA (US)

(73) Assignee: Premium Home Comfort, Inc., Philadelphia, PA (US)

( * ) Notice: Subject to any disclaimer, the term of this patent is extended or adjusted under 35 U.S.C. 154(b) by 436 days.

(21) Appl. No.: 15/784,768

(22) Filed: Oct. 16, 2017

(65) Prior Publication Data

US 2018/0106484 A1 Apr. 19, 2018

Related U.S. Application Data

(60) Provisional application No. 62/408,811, filed on Oct. 16, 2016.

(51) Int. Cl.

| | |
|---|---|
| ***F24F 1/027*** | (2019.01) |
| ***F24F 13/32*** | (2006.01) |
| ***F24F 7/007*** | (2006.01) |
| ***F24F 13/10*** | (2006.01) |

(52) U.S. Cl.

CPC ..... *F24F 1/027* (2013.01); *F24F 7/007* (2013.01); *F24F 13/10* (2013.01); *F24F 13/32* (2013.01)

(58) Field of Classification Search

CPC .... F24F 1/027; F24F 1/03; F24F 1/031; F24F 1/02; F24F 1/0314; F24F 7/007; F24F 13/10; F24F 13/32; F24F 2221/36; E06B 7/082

See application file for complete search history.

(56) References Cited

U.S. PATENT DOCUMENTS

| | | | |
|---|---|---|---|
| 2,081,553 | A | 5/1937 | Neeson |
| 2,197,001 | A | 4/1940 | Guido Maiuri |
| 2,293,718 | A | 8/1942 | Eberhart |
| 2,486,828 | A | 11/1949 | Dybvig |
| 2,498,661 | A | 2/1950 | Dybvig |
| 2,630,691 | A | 3/1953 | Harris |
| 2,904,972 | A | 9/1959 | Smilack |
| 2,941,381 | A | 6/1960 | Eberhart |
| 3,279,209 | A | 10/1966 | Laing |
| 3,301,003 | A | 1/1967 | Laing |
| 3,566,614 | A | 3/1971 | Imral |

(Continued)

FOREIGN PATENT DOCUMENTS

| | | | |
|---|---|---|---|
| JP | 2016-055264 | A | 4/2016 |
| WO | 2010037186 | A1 | 4/2010 |

OTHER PUBLICATIONS

International Search Report and Written Opinion dated Aug. 30, 2018, in corresponding application PCT/US2018/032570.

*Primary Examiner* — Joseph F Trpisovsky
(74) *Attorney, Agent, or Firm* — Volpe Koenig

(57) ABSTRACT

An air conditioner includes a housing, a condenser positioned at a first location within the housing, an evaporator positioned at a second location within the housing, a pump that is positioned between the condenser and the evaporator and circulates a refrigerant between the condenser and the evaporator, and at least two air movers that are positioned so that the pump is between the air movers and the air movers are between the condenser and the evaporator.

8 Claims, 62 Drawing Sheets

(56) References Cited

U.S. PATENT DOCUMENTS

| | | | | |
|---|---|---|---|---|
| 3,731,056 | A | 5/1973 | Becker | |
| 3,831,292 | A | 8/1974 | De Pas | |
| 3,858,330 | A | 1/1975 | De Pas | |
| 3,875,268 | A | 4/1975 | De Pas | |
| 3,875,679 | A | 4/1975 | Condit | |
| 3,875,681 | A | 4/1975 | De Pas | |
| 3,898,865 | A | 8/1975 | Stewart | |
| 3,908,393 | A | 9/1975 | Eubank | |
| 3,915,596 | A | 10/1975 | Frazar | |
| 3,940,861 | A | 3/1976 | Frazar | |
| 3,943,728 | A | 3/1976 | Maudlin | |
| 3,964,273 | A | 6/1976 | Merrick | |
| 4,056,946 | A | 11/1977 | Bond | |
| 4,203,302 | A | 5/1980 | Lapeyre | |
| 4,321,803 | A | 3/1982 | Smith | |
| 4,424,686 | A | 1/1984 | Lapeyre | |
| 4,505,129 | A | 3/1985 | Yamane | |
| 4,527,624 | A | 7/1985 | Nishida | |
| 4,574,874 | A | 3/1986 | Duran | |
| 4,603,559 | A | 8/1986 | Wu | |
| 4,641,502 | A | 2/1987 | Aldrich et al. | |
| 4,720,983 | A | 1/1988 | Mintz | |
| 4,726,198 | A | 2/1988 | Ouwenga | |
| 4,745,770 | A | 5/1988 | Mintz | |
| 5,038,577 | A | 8/1991 | Stanford | |
| 5,046,331 | A | 9/1991 | O'Neal | |
| 5,094,089 | A | 3/1992 | Lail | |
| 5,121,613 | A | 6/1992 | Cox | |
| 5,172,752 | A | 12/1992 | Goetz, Jr. | |
| 5,188,169 | A | 2/1993 | Lim | |
| 5,255,532 | A | 10/1993 | Chae | |
| 5,269,146 | A | 12/1993 | Kerner | |
| 5,277,036 | A | 1/1994 | Dieckmann | |
| 5,279,359 | A | 1/1994 | Erickson | |
| 5,279,360 | A | 1/1994 | Hughes | |
| 5,295,903 | A * | 3/1994 | Bolton | F24F 1/027 454/201 |
| 5,361,587 | A | 11/1994 | Hoffman | |
| 5,419,147 | A | 5/1995 | Cooper | |
| 5,454,231 | A | 10/1995 | Bolton | |
| 5,538,075 | A | 7/1996 | Eubank | |
| 5,542,263 | A | 8/1996 | Choi | |
| 5,562,411 | A | 10/1996 | Salgado | |
| 5,638,693 | A | 6/1997 | Baek | |
| 5,657,641 | A | 8/1997 | Cunningham | |
| 5,775,125 | A | 7/1998 | Sakai | |
| 5,832,739 | A | 11/1998 | Bacchus | |
| 5,884,694 | A | 3/1999 | Tanenbaum | |
| 5,979,533 | A * | 11/1999 | Dupuie | F24F 1/0003 160/240 |
| 6,116,037 | A | 9/2000 | Burnett | |
| 6,338,256 | B1 | 1/2002 | Tien | |
| 6,345,667 | B1 | 2/2002 | Hata et al. | |
| 6,701,741 | B2 | 3/2004 | Liu | |
| 7,234,316 | B2 | 6/2007 | Tien | |
| 7,260,953 | B2 * | 8/2007 | Kim | F24F 1/027 62/259.1 |
| 7,381,310 | B2 | 6/2008 | Hernandez Hernandez | |
| 2002/0157415 | A1 | 10/2002 | Liu | |
| 2003/0084682 | A1 | 5/2003 | Choi | |
| 2005/0011743 | A1 | 1/2005 | Hernandez | |
| 2006/0223434 | A1 * | 10/2006 | Barker | E06B 7/10 454/203 |
| 2009/0081940 | A1 | 3/2009 | Jang | |
| 2011/0174013 | A1 | 7/2011 | Moraes | |
| 2011/0226000 | A1 | 9/2011 | Chiu | |
| 2016/0047559 | A1 | 2/2016 | Swanson | |
| 2016/0097547 | A1 | 4/2016 | Selg et al. | |
| 2016/0375744 | A1 | 12/2016 | Kakizaki | |
| 2017/0082317 | A1 | 3/2017 | McKay | |
| 2017/0097164 | A1 | 4/2017 | Chang | |
| 2017/0307251 | A1 | 10/2017 | Baruch | |

* cited by examiner

AIR CONDITIONER AND AN AIR CONDITIONER HOUSING

CROSS REFERENCE TO RELATED APPLICATION

This application claims the benefit of Provisional Application No. 62/408,811, filed on Oct. 16, 2016, which is incorporated herein by reference as if fully set forth.

FIELD OF INVENTION

This application is generally related to air conditioning systems and devices, and more particularly related to an air conditioning and fan system that may be easily and safely mounted.

BACKGROUND

Air conditioning systems are in widespread use in homes, offices, and other buildings to cool the space in warm weather, circulate air, and control humidity. Existing air conditioning systems range from large central air conditioning systems with the capacity for cooling an entire building or home, to split or ductless air conditioning systems mounted through a wall in a home or hotel, to more portable and less permanent solutions such as standalone portable air conditioners in a mobile unit having a hose vent, and window air conditioners that are mounted in a window and removed during the cooler months of the year. Portable air conditioners, especially window air conditioners, are very popular for apartments and other rental properties, temporary or student housing, older homes without a central air conditioning system, as well as buildings in cooler climates that only require cooling occasionally, as such air conditioning units are generally cost-effective, can be installed, removed, and stored when not in use, and can be moved based on the owner's needs.

Despite the popularity of window air conditioners and the large market for them, there exist a number of disadvantages in existing window air conditioning units. These disadvantages including the significant size and weight of current window air conditioners, which makes installation difficult and potentially dangerous, especially for users attempting to install a unit by themselves. Existing window air conditioners often weigh between 50 to 120 pounds, range between 14"-48" in width, range between 18"-34" in height, and range between 18"-36" in depth. Accordingly, these existing units are often too large and heavy for an individual to carry and move safely and comfortably. In addition, installation of a window air conditioner typically requires lifting the unit and aligning it in a window opening, and then holding the unit in place until it is sufficiently secured, which can be made significantly more difficult by the size and weight of existing units. Removing a window air conditioner from a window is similarly demanding, causing many users to keep their window air conditioners installed even during colder weather such as the winter months, which leads to a significant loss of heat from the home and higher energy bills. The large dimensions of existing window air conditioners may not fit smaller windows, and large interior space with only one or a few windows that require particularly high levels of cooling capacity relative to the available window area are not well served by existing units. Furthermore, the large form factor of existing window air conditioners blocks much of the view and light from the window, and is commonly regarded as an eye sore from both inside and outside of the building. Existing window air conditioners also produce a large amount of noise during operation, and do not offer an efficient air circulation option to bring in fresh air from outside without utilizing all of the fans in the unit, which increases power consumption and noise.

Given the disadvantages discussed above and the prevalence of window air conditioners worldwide, a need exists for an air conditioning system that has an aesthetically pleasing form that make efficient use of the available space within the housing and has high efficiency, low noise, yet an effective cooling system, and, when desired, can be easily installed, uninstalled, moved, and stored. A need further exists for an air conditioning system that offers an air circulation mode to bring fresh air in from outside of the building without utilizing the cooling components of the air conditioner, so that the air conditioner can be used as a fan when cooling is not necessary or desired. In addition, a need exists for a window air conditioner that includes a user interface with the ability to be incorporated into the user's home thermostat system or to be remotely controlled, such as via the user's computing device.

SUMMARY

The present solution to the prior art needs provides an arrangement of air conditioner components in a space efficient assembly and a housing that facilitates that space efficient assembly. The air conditioning components of a preferred embodiment are arranged to maximize utilization of space within the housing. The preferred housing employs a two-part construction that is preferably molded and includes defined airflow paths. In addition, the preferred mounting frame has interconnected accordion panels that expand to fit the available opening and can be removed or added to approximate the expanse necessary to seal the opening.

The present solution also provides a method of cooling a room with the air conditioner. The method includes the steps of providing an air conditioner housing having an internal cavity and an outer surface with a length that extends along a longitudinal direction and a width that extends along a horizontal direction that is substantially perpendicular to the longitudinal direction, providing an evaporator assembly arranged within a front portion of the internal cavity of the housing, providing a condenser assembly arranged within a back portion of the internal cavity of the housing, providing a compressor associated with the evaporator assembly and the condenser assembly, and providing an electrical control system associated with the evaporator assembly, the condenser assembly, and the compressor.

BRIEF DESCRIPTION OF THE DRAWINGS

The following detailed description of the preferred embodiments of the present application will be better understood when read in conjunction with the appended drawings. For the purpose of illustrating the invention, there is shown in the drawings embodiments that are presently preferred. It should be understood, however, that the inventions are not limited to the precise arrangements shown in the drawings.

DETAILED DESCRIPTION OF THE PREFERRED EMBODIMENTS

Figure 1:
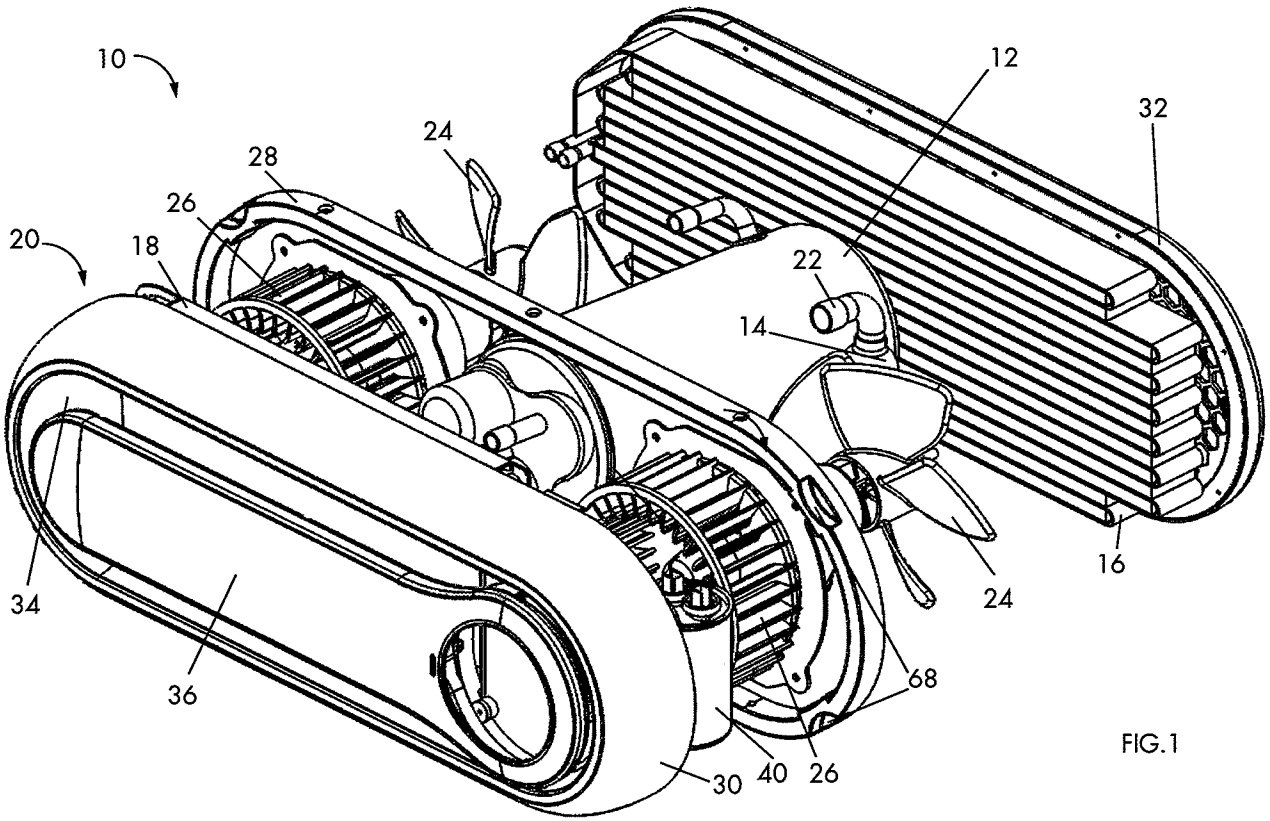
FIGS. 1 and 2 illustrate and exploded view of one embodiment of an air conditioner according to the present solution without out the housing.
Figure 2:
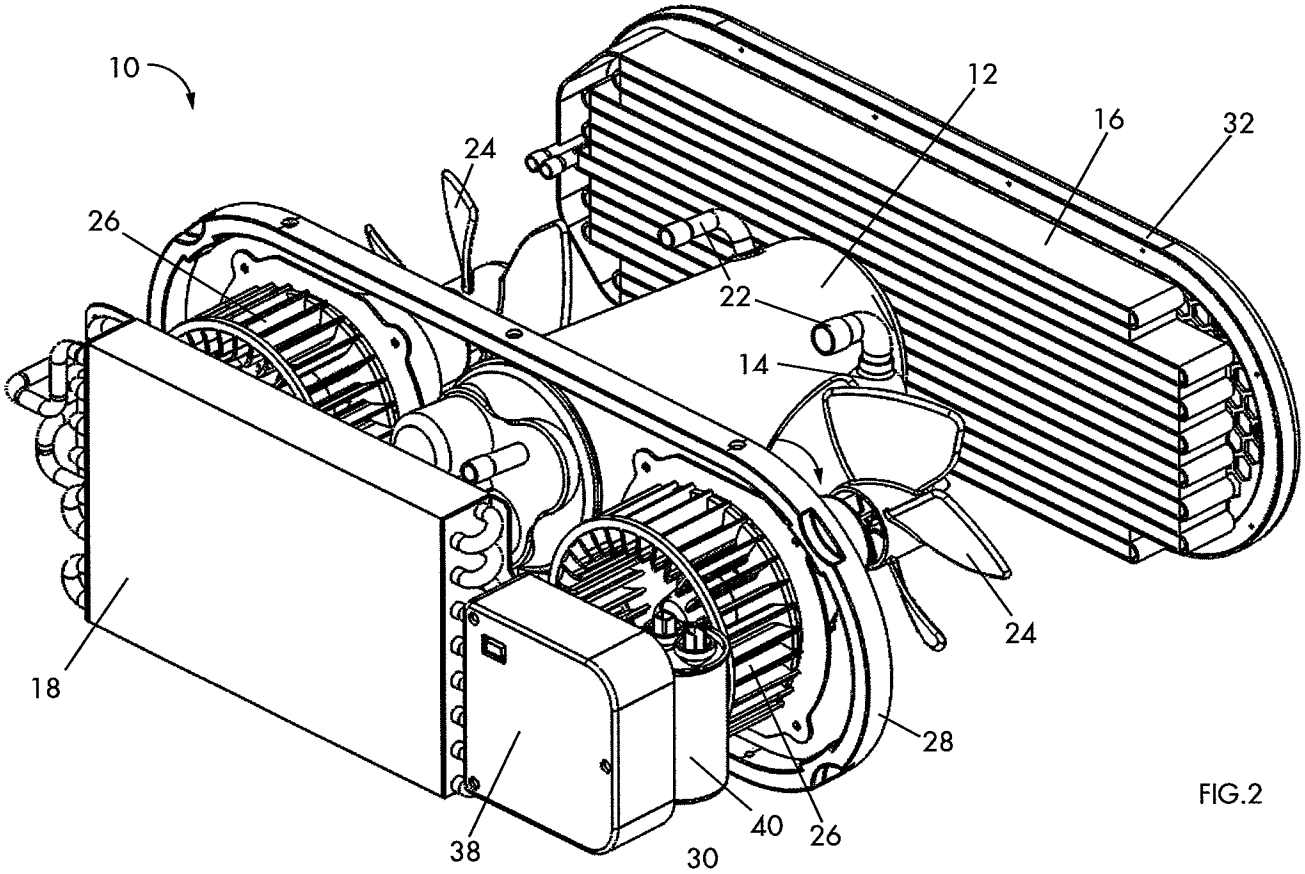

Certain terminology is used in the following description for convenience only and is not limiting. The words "front," "back," "top," "bottom," "inner," "outer," "upper," "lower," "internal," and "external" designate directions in the drawings to which reference is made. The words "upward," "downward," "above," and "below" refer to directions towards a higher or lower position from the parts referenced in the drawings. The words "inward" and "outward" refer to directions towards an inner or outer portion of the element referenced in the drawings. The words "clockwise" and "counterclockwise" are used to indicate opposite relative directions of rotation, and may be used to specifically refer to directions of rotation about an axis in accordance with the well-known right hand rule. Additionally, the terms "a" and "one" are defined as including one or more of the referenced item unless specifically noted otherwise. A reference to a list of items that are cited as "at least one of a, b, or c" (where a, b, and c represent the items being listed) means any single one of the items a, b, or c, or combinations thereof. The terminology includes the words specifically noted above, derivatives thereof, and words of similar import.

Figure 57:
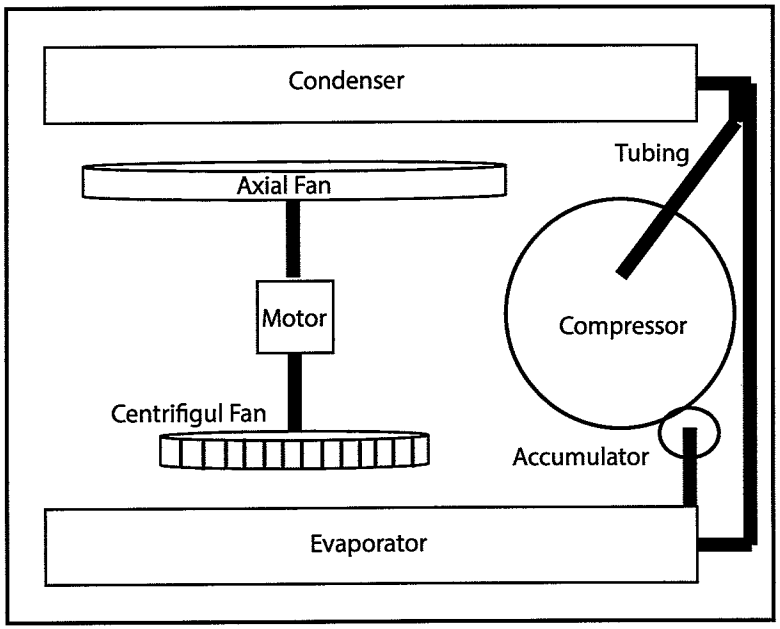
PRIOR ART FIG. 57
FIG. 57 illustrates one prior art arrangement for the air conditioner components; and, FIGS. 58-62 illustrate an alternative arrangement having the compressor or refrigerant pump located in a generally central position between the air movers.

The present application includes a description of a compact air conditioner which more efficiently utilizes given space by including a pair of air movers and a centrally-located compressor. A conventional air conditioner is shown in FIG. 57 and typically includes a single motor driving an axial fan and a centrifugal fan which are offset from the compressor and which does not efficiently utilize space.

One of ordinary skill in the art will appreciate that there are many different types of compressors, including without limitation rotary compressors, piston compressors, and electrolytic compressors, any of which may be used with the present air conditioner. Furthermore, a variety of coolants having the requisite heat transfer characteristics may be used in the present air conditioner, including without limitation coolants that undergo phase transitions as it circulates throughout the system, which are common known as refrigerants. In an embodiment of the present air conditioner where a thermoelectric heat pump is used in place of the compressor, the coolant does not circulate between the evaporator and the condenser, but rather is separately contained in the evaporator and the condenser individually, as will be described in detail below. For purposes of the present application, the reference to a "refrigerant" is used for convenience only, and does not limit the specific coolant that may be used to a known AC refrigerant or a coolant that undergoes phase transitions, and instead may refer broadly to any coolant or heat transfer fluid that is capable of being circulated to transfer heat between components of the present air conditioner 10, including coolants that keep its phase or the use of solid materials as coolants.

FIGS. 1 through 6 show exemplary components of the air conditioner 10 arranged to provide a more compact arrangement of parts that enables the use of a housing with a smaller exterior envelope. In an exemplary embodiment, the air conditioner 10 includes a compressor 12, an accumulator 14, a condenser 16, and an evaporator 18 arranged inside of a compact housing 20. The compressor 12 may be centrally located in the housing 20 of the air conditioner 10 and be connected to the condenser 16 and evaporator 18 by piping 22 (some of the piping omitted for ease of view).

As will be described, the housing 20 includes a face plate 30 which may be located adjacent to and/or form part of a room air intake grate 32 through which air from inside of the room or building to be cooled may be drawn into the internal cavity of the housing. The room air intake grate 32 may also be referred to as the "evaporator fan air intake" in the present application, as the air flowing through the room air intake grate is being drawn into the internal cavity of the housing 20 by the evaporator fans. The housing 20 may further include a cold air exit vent 44 through which cooled air is expelled back into the interior of the space to be cooled. The cold air exit vent 44 may also be referred to as the "evaporator fan air outlet" in the present application, as the air (whether cooled interior air or fresh external air) flowing through the cold air exist vent is being expelled out from the internal cavity of the housing by the evaporator fans. The cold air exit vent may be located at the front portion of the housing 20, such as, for example and without limitation, on a top portion of the outer surface of the housing. The housing 20 may also include one or more external air intake grates 70, which may also be referred to as "condenser fan air intakes." The external air intake grates are located at the back portion of the housing, and may further be arranged on at least one of the top portion, the bottom portion, or the sides of the outer surface of the housing. Air from an exterior of the room or building to be cooled is drawn into the internal cavity of the housing through the external air intake grates to cool the condenser 16, and then the heated external air is expelled back out to the exterior atmosphere through a hot air exit vent (also known as the "condenser fan air outlet") located in a back plate 32 of the housing 20.

If a thermoelectric heat pump is used in place of a traditional compressor 12, each of the evaporator 18 and condenser 16 may include a heat pipe containing a suitable coolant, and be thermally associated with the thermoelectric heat pump, such that the coolant within the heat pipes of the evaporator 18 and condenser 16 is being heated or cooled by the thermoelectric heat pump to transfer heat out of the interior of the room to be cooled.

Figure 3:
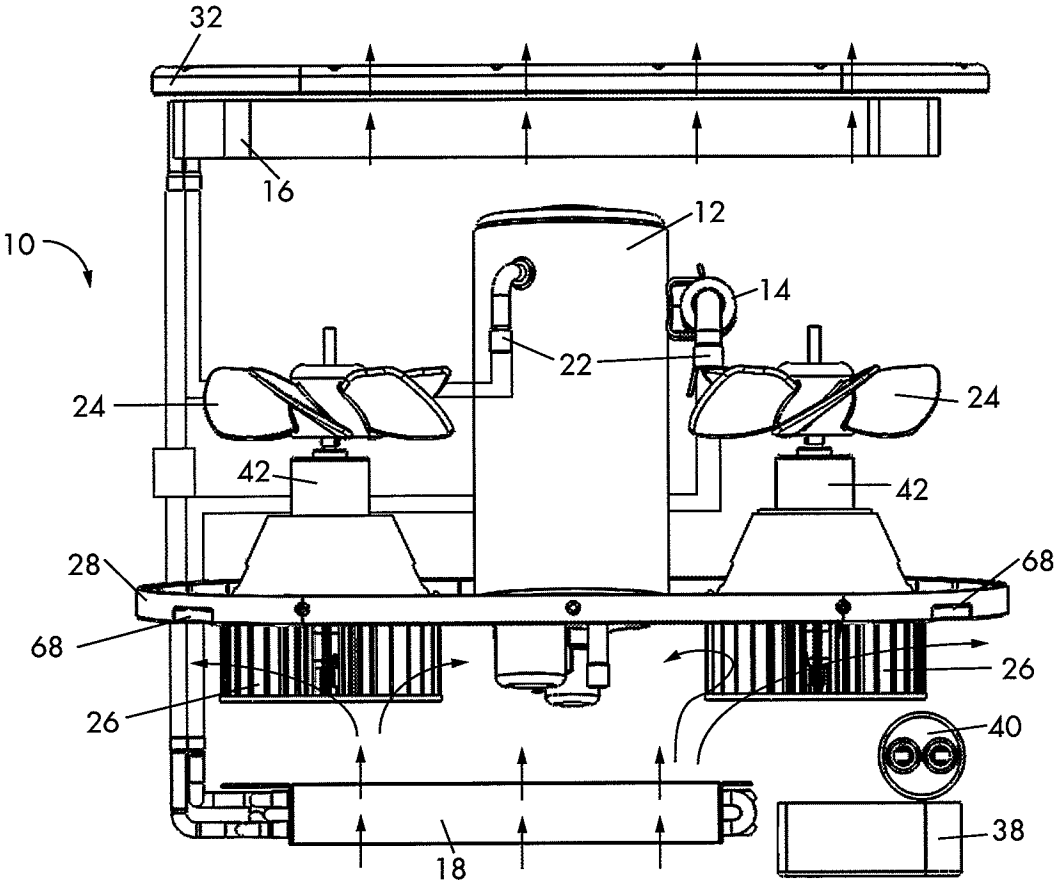
FIG. 3 is a top plan view that illustrates the refrigerant connections and air flow of the embodiment in FIG. 1.

The air conditioner 10 includes air movers in the form of a pair of condenser fans 24 and a pair of evaporator fans 26 which are arranged on opposing sides of the compressor 12. The condenser fans 24 are preferably axial fans and the evaporator fans 26 are preferably centrifugal fans. The condenser fans 24 and the evaporator fans 26 may be driven by a common motor 42 positioned respectively between each set of fans (as shown in FIG. 3).

Although centrifugal fans are known in air conditioners, known window air conditioners usually are driven by a single motor in the prior art fan assembly. By way of contrast, the present air conditioner 10 utilizes two separate sets of evaporator and condenser fans, each driven by a separate motor along a rotational axis that is aligned with the longitudinal direction Y along the length (i.e. the depth) of the housing, thus allowing the compressor 12 to be uniquely positioned between the two sets of fans.

The evaporator fans 26 need high pressure but less overall airflow, as the goal of the evaporator fans 26 is to pull air through the face plate 30 and/or room air intake grate, possibly through a filter in the air filter slot. The backward curved or inclined blades of the evaporator fans 26 are well suited to this need, and provide more energy efficient than straight radial blades, which extend straight out from the center of the fan axis. On the other hand, the condenser fans 24 do not need as high of pressure but does require greater overall airflow, as the goal of the condenser fans 24 is to move as much external atmosphere air as possible along the surface of the condenser 16 in order to cool the refrigerant in the condenser 16. The figures illustrate preferred fan blade configurations in the presently preferred air conditioner. One of ordinary skill would understand that the desired performance characteristics of the blades will inform how they are curved and inclined.

The condenser 16 may include a non-rectangular shape in order to match a shape of the housing 20 and achieve higher efficiency. The non-rectangular shape may maximize cross-sectional area within the slot external shape of the air conditioner 10 and take advantage of the full diameters of the condenser fans 26 so that there is no wasted surface area on the condenser 16. In known air conditioners, the condenser is rectangular in shape while the fans have a circular cross-sectional area, resulting in areas of the condenser that does not receive direct airflow from the fans. The compressor 12, condenser fans 24, and evaporator fans 26 may be at least partially surrounded and/or positioned by a retainer strap 28. The retainer strap 28 may also be the point at which the air conditioner 10 is divided between the portion indoors and the portion outdoors when positioned in a window.

The evaporator 18 preferably includes evaporator piping or tubing that coils through the body, preferably in a serpentine path so as to maximize the path of the refrigerant that flows through the tubing and the evaporator. The body of the evaporator 18 is a heat exchanger, which includes a plurality of fins that may be formed out of a material having good heat transfer properties, such as a highly thermally conductive metal such as aluminum or copper. One of ordinary skill in the art would appreciate that there are a variety of shapes, such as pins, straight fins, or flared fins suitable for heat sink fins. The body of the evaporator 18 may be further configured to include what is commonly known as "offset interrupted fins" or "louvered fins." In the offset interrupted fins configuration, each "fin" or "plate" of the evaporator body includes a plurality of slits (the "interruptions") that are generally placed close together at regular intervals. As airflows along the longitudinal direction Y between two fins of the evaporator body, the air enters and exits the plurality of slits/interruptions formed in the fins, which increases heat transfer and causes the airflow to become turbulent, thus ensuring that the cooled air immediately mixes with the surrounding air. To further optimize performance of the evaporator 18 and increase heat transfer, the material between adjacent slits/interruptions in the fins may be stamped to create an "offset," adjacent offsets being stamped in opposite directions. The offsets interrupt the boundary condition of the airflow and further increase air turbulence, which improves the heat transfer capabilities of the evaporator. In the louvered fins configuration, the offsets are at an angle, and adjacent offsets are formed with opposing angles, so that air flowing through one offset out through a slot is forced to change angles before entering an adjacent slot to flow through the next offset, once again increasing turbulence and improving heat transfer.

The fins of the evaporator 18 and condenser 16 heat exchangers are preferably formed from a material having good heat transfer properties, and may be arranged vertically such that air may flow between adjacent fins. The fins are very thin and are arranged vertically along the body of the condenser 16 to maximize the surface area of the fins as external air is blown through the body of the condenser 16 to cool down the refrigerant or other coolant circulating through the condenser tubing.

In existing window air conditioners, positioning the evaporator behind the fan results in "wasted" areas of the evaporator (usually at the four corners) that do not receive direct airflow from the evaporator fan. By taking full advantage of the non-rectangular surface area of the evaporator, the present evaporator assembly configuration is able to utilize a relative smaller evaporator 18, which also contributes to the overall smaller size of the air conditioner.

Further advantages of the present evaporator assembly include a reduction in noise. Since there is no direct line of sight from the faceplate of the housing and room air intake grate into the evaporator fans due to their orientation, the sound of the evaporator fans during operation is decreased.

The refrigerant that exits the compressor is in a high-pressure hot gaseous state, and flows through the condenser 16 within the condenser tubing. Like the evaporator 18, the condenser 16 includes a substantially rectangular body that extends and is arranged along the vertical direction, and condenser piping or tubing that coils through the body, preferably in a serpentine path. The body of the condenser 16 is a heat sink having a plurality of fins, which may be arranged like the fins in the evaporator body and configured as "offset interrupted fins" or "louvered fins." Although the condenser body has a substantially straight profile without any curvature along the horizontal direction, one of ordinary skill in the art would understand that the body of the condenser 16 may also be curved in a way to optimize airflow between the external air drawn in through the external air intake grates, the condenser fans 24, the condenser 16, and the hot air exit vent. Furthermore, the exact form and extent of the curvature for the condenser body will be determined based on specific operational parameters desired when taking into account the present teachings.

The connection tubing may be associated with the evaporator tubing and the condenser tubing to allow for the flow of refrigerant from the compressor 12 to the evaporator 18. The connection tubing may be coiled in a serpentine path, and may further include an expansion valve located adjacent to the condenser 16, which may be for example and without limitation a capillary expansion valve. The expansion valve quickly decreases the cross-sectional flow area of the connection tubing and thus drops the pressure of the refrigerant flowing out of the condenser 16, which changes the state of the refrigerant form a high-pressure hot liquid to a low-pressure cold boiling liquid. The compressor 12 may be associated with the evaporator 18 and condenser 16 through a series of compressor tubing, which is preferably arranged in a coiled configuration so as to act as a spring between the compressor 12 and the rest of the components in the air conditioner 10. By acting as a spring, the compressor tubing mechanically isolates the compressor 12 from the evaporator 18 and condenser 16 assemblies, which is desirable because the compressor 12 causes a large amount of vibration during operation, which may damage the other components if not isolated. Where a thermoelectric heat pump is used in place of a compressor, the connection tubing between the evaporator 18 and condenser 16 is not required, as the coolant remains within the evaporator tubing and condenser tubing separately. In such an embodiment the thermoelectric heat pump is thermally associated with and arranged between the evaporator 18 and the condenser 16, such that the cold side of the thermoelectric heat pump is thermally associated with the evaporator to cool the coolant contained in the evaporator tubing, while the hot side of the thermoelectric heat pump is thermally associated with the condenser to transfer heat into the coolant contained in the condenser tubing. In such an arrangement, the evaporator and condenser tubing may each be formed as a heat pipe, which is well known heat transfer device, and the coolant used may be, for example and without limitation, a liquid such as methanol or acetone.

As discussed above, the refrigerant that leaves the compressor 12 is in a high-pressure hot gaseous state as it enters the condenser 16, which is cooled by drawing in external ambient air from outside of the space to be cooled, and utilizing air movers (e.g., condenser fans 24) to move the relatively cooler external air through the condenser 16. The external air is drawn in to the back portion of the internal cavity of the housing 20 through one or more external air intake grates. The external air intake grates may be located at locations of the housing best suited for ingestion by the condenser fans 24, such as at the top portion of the housing 20, the side portions of the housing 20, and on the bottom portion of the housing 20, as will be described in more detail. The external air is expelled towards the condenser 16 to cool the condenser body and the refrigerant circulating within the condenser tubing. As the external air blows through the body of the condenser 16, the high-pressure hot gaseous refrigerant flowing through the condenser tubing is in cooled liquid state when it leaves the condenser 16. The external air blown through the body of the condenser exits the back of the condenser body as hot air through the hot air exit vent located at the back of the housing 20 in the back plate 32. Preferably, the hot air exit vent takes up a most of the back of the housing.

Figure 25:
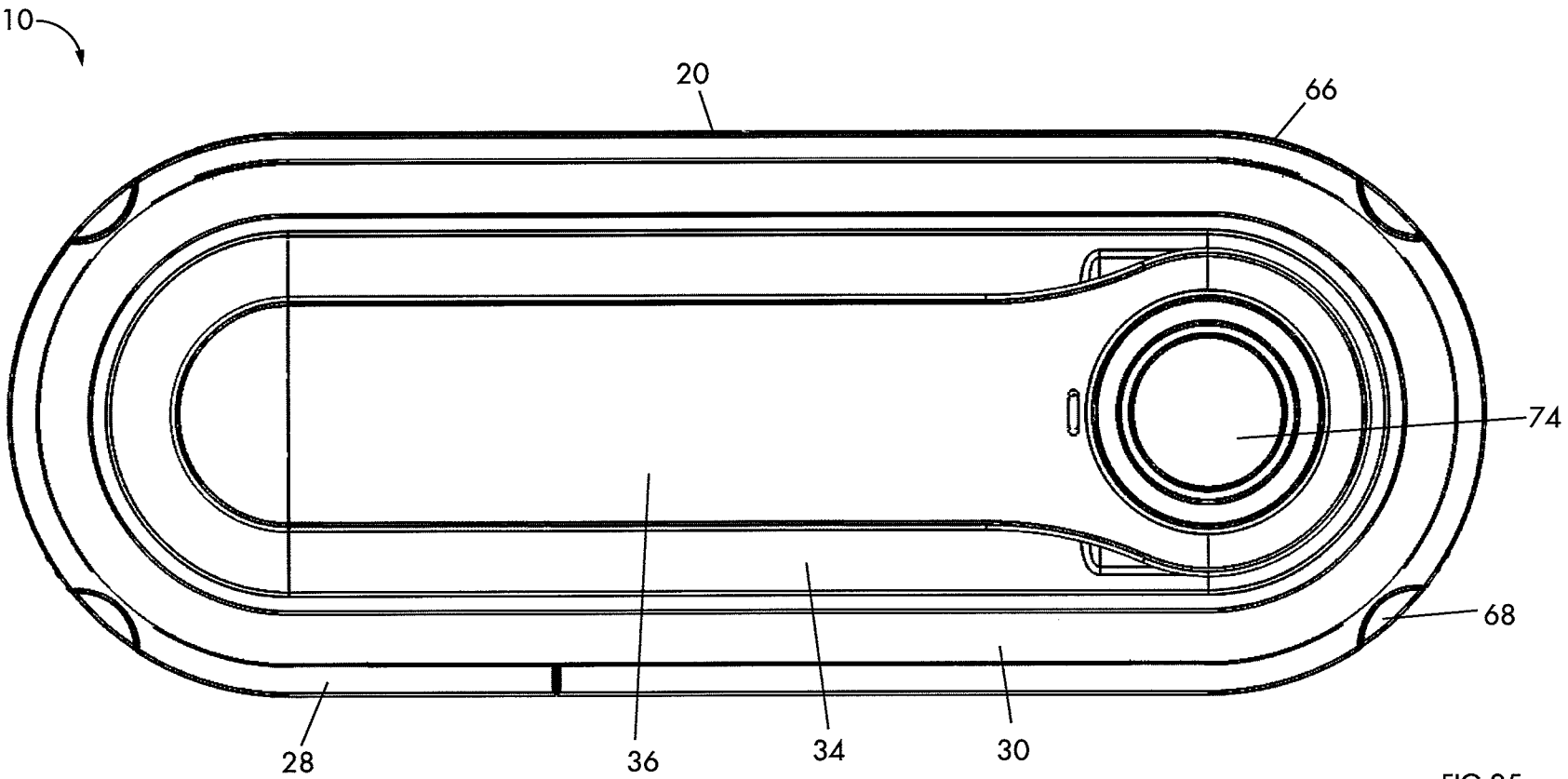
FIGS. 25-29 illustrate the exterior details of the preferred housing for the embodiment of FIG. 1.
Figure 26:
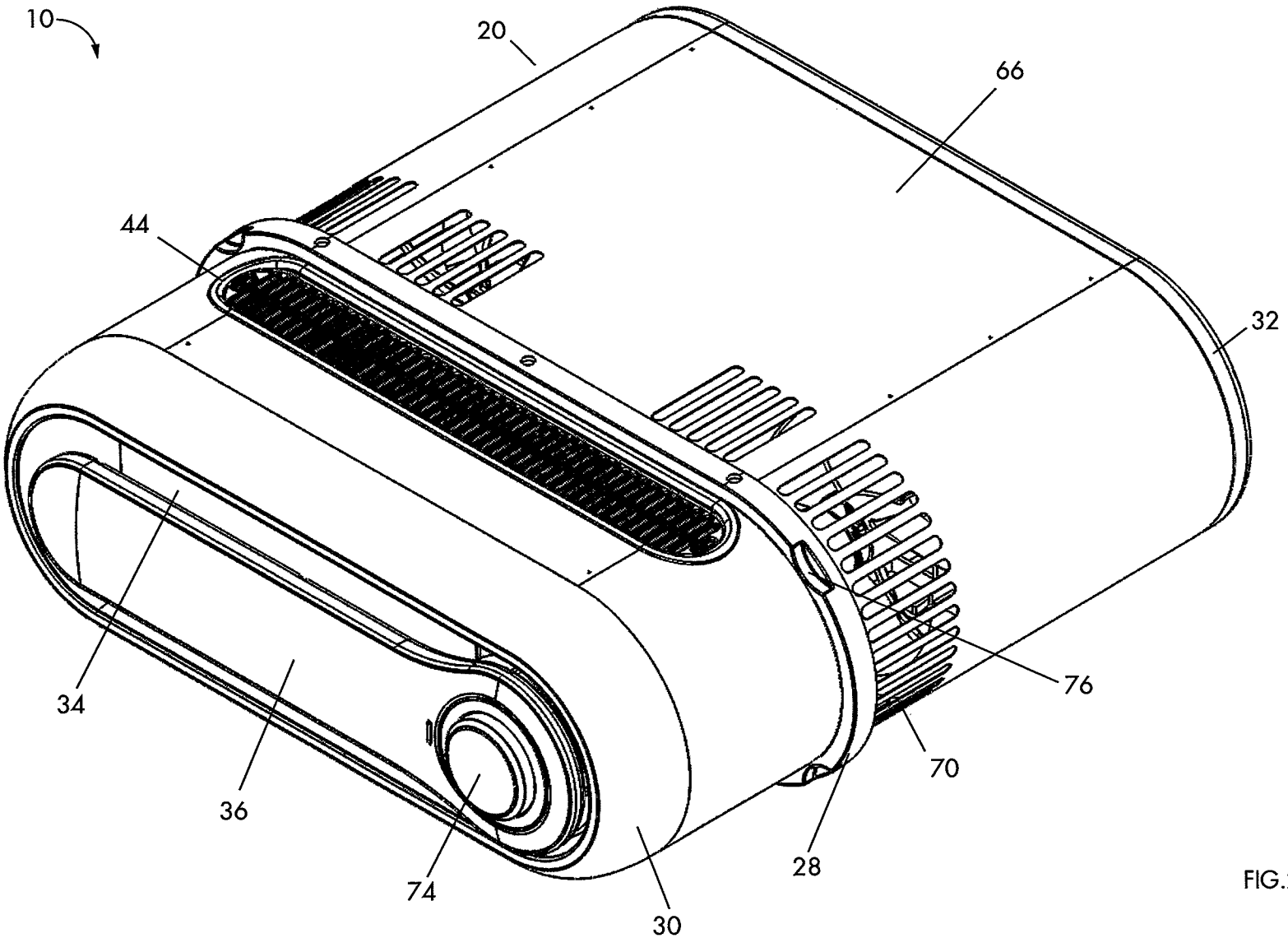
Figure 27:
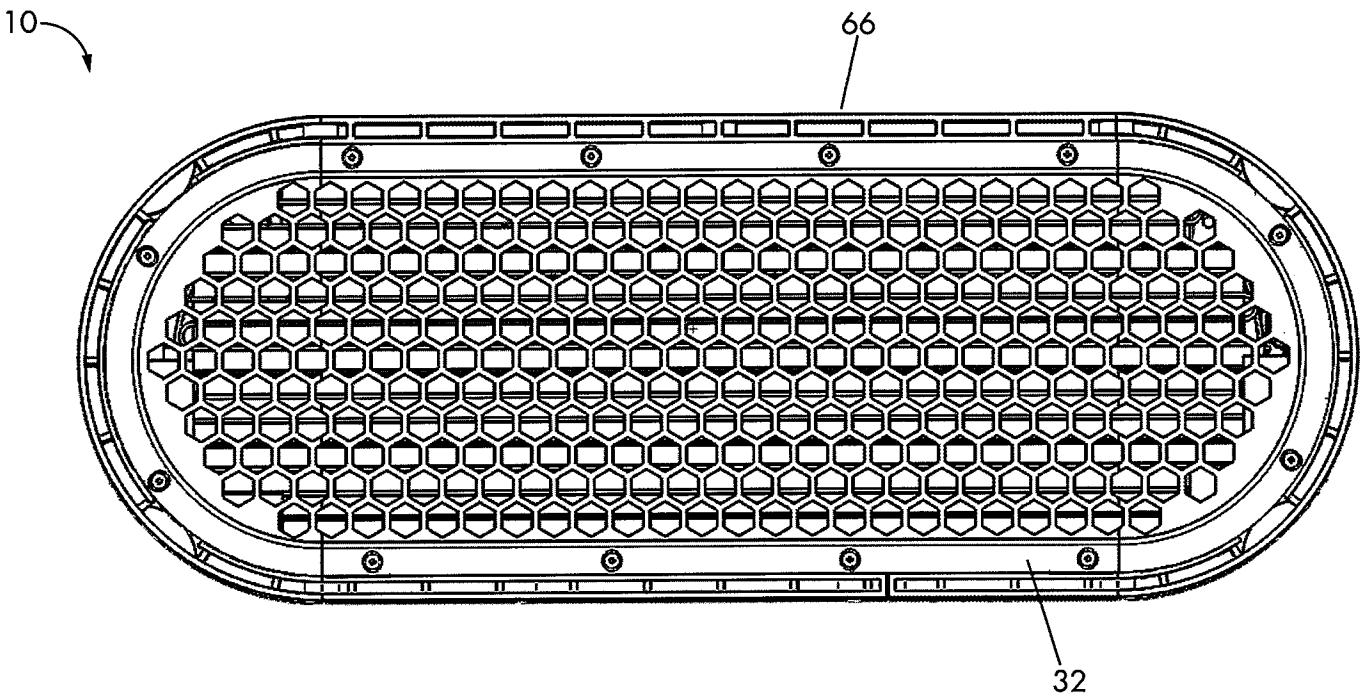
Figure 28:
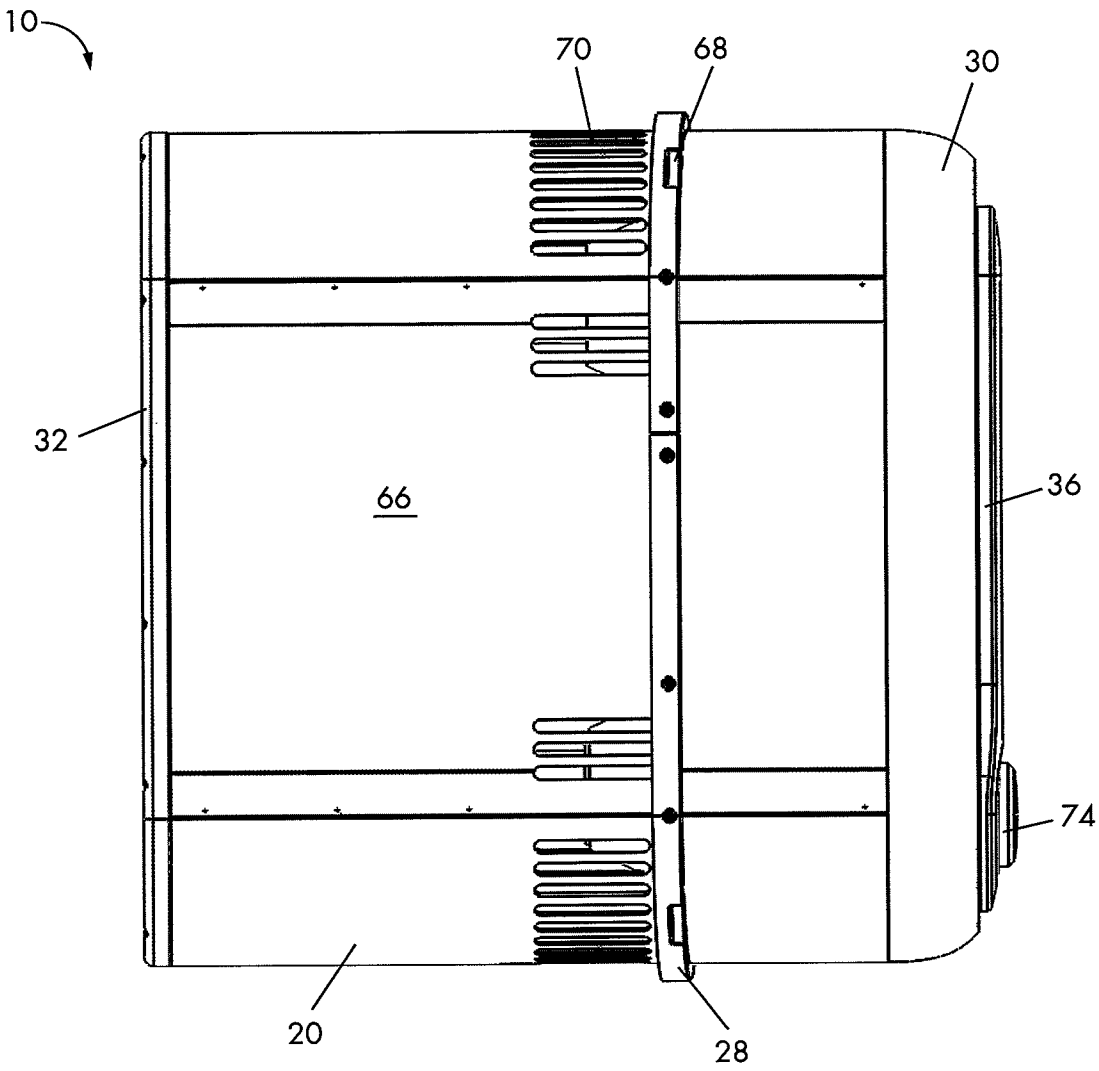
Figure 29:
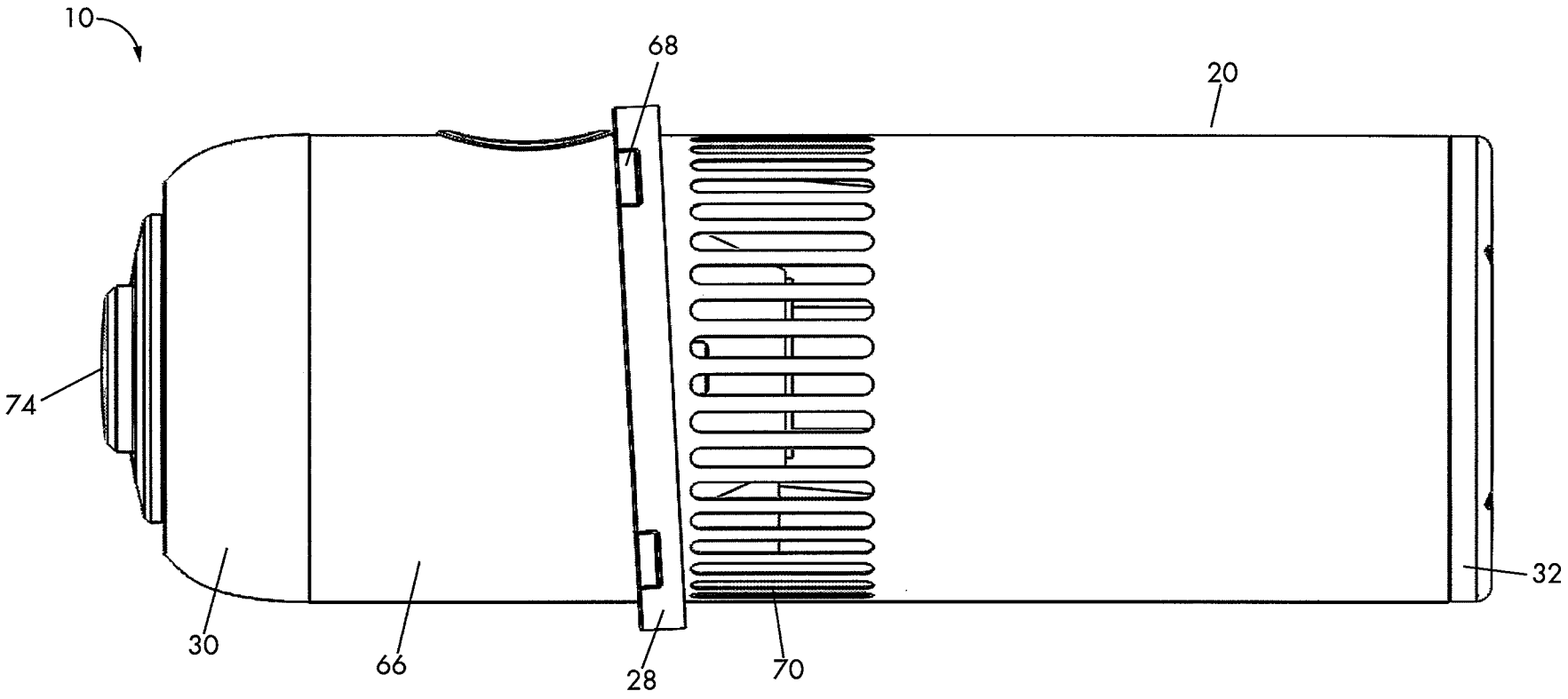

The interior face of the air conditioner 10 has face plate 30 that serves as a handle 36, a control knob 74 (shown in FIGS. 25-26), and a light pipe or LED display. The housing 20 includes the face plate 30 and a back plate 32. The face plate 30 may be positioned in front of the evaporator 18 while the back plate 32 is positioned behind the condenser 16. The face plate 30 may be a shell component configured to receive a portion of the evaporator 18. The face plate 30 preferably includes a room air intake vent 34 which may have a grill with perforations for safety and to visually obstruct the internal components. The room air intake vent 34 is formed all around the handle 36. Instead of a visible grate, the vent 34 is integrated into the face plate 30 and handle 36 combination design which provides efficient functionality while being aesthetically pleasing. The vent 34 is sized to accommodate a user's fingers so that the handle 36 can be grasped. The face plate 30 may also include a space for a control knob (shown in FIG. 26). The back plate 32 is preferably a grill including perforations for acting as a hot air exit vent.

The air conditioner 10 may also include an electronics enclosure 38 and a capacitor 40 positioned adjacent to the evaporator 18 and configured to fit within the face plate 30. The electronics are positioned so that they can be manipulated by a control knob protruding from the face plate 30. The capacitor 40 is electronically connected to the compressor 12.

The compressor 12 is centrally mounted between the two sets of fans 24 and 26 which may be symmetrically arranged on opposing sides of the compressor 12. This configuration inside of the housing 20 provides a balanced design and enables a compact arrangement of the components. Another advantage of the centrally located compressor 12 is that it can be mounted using horizontal mounting fixtures (e.g., mounting feet 46 shown in FIG. 4) without modification, as will be described in further detail below. This also helps reduce vibrations in the unit, as the mounting fixtures can incorporate shock absorbers.

Figure 4:
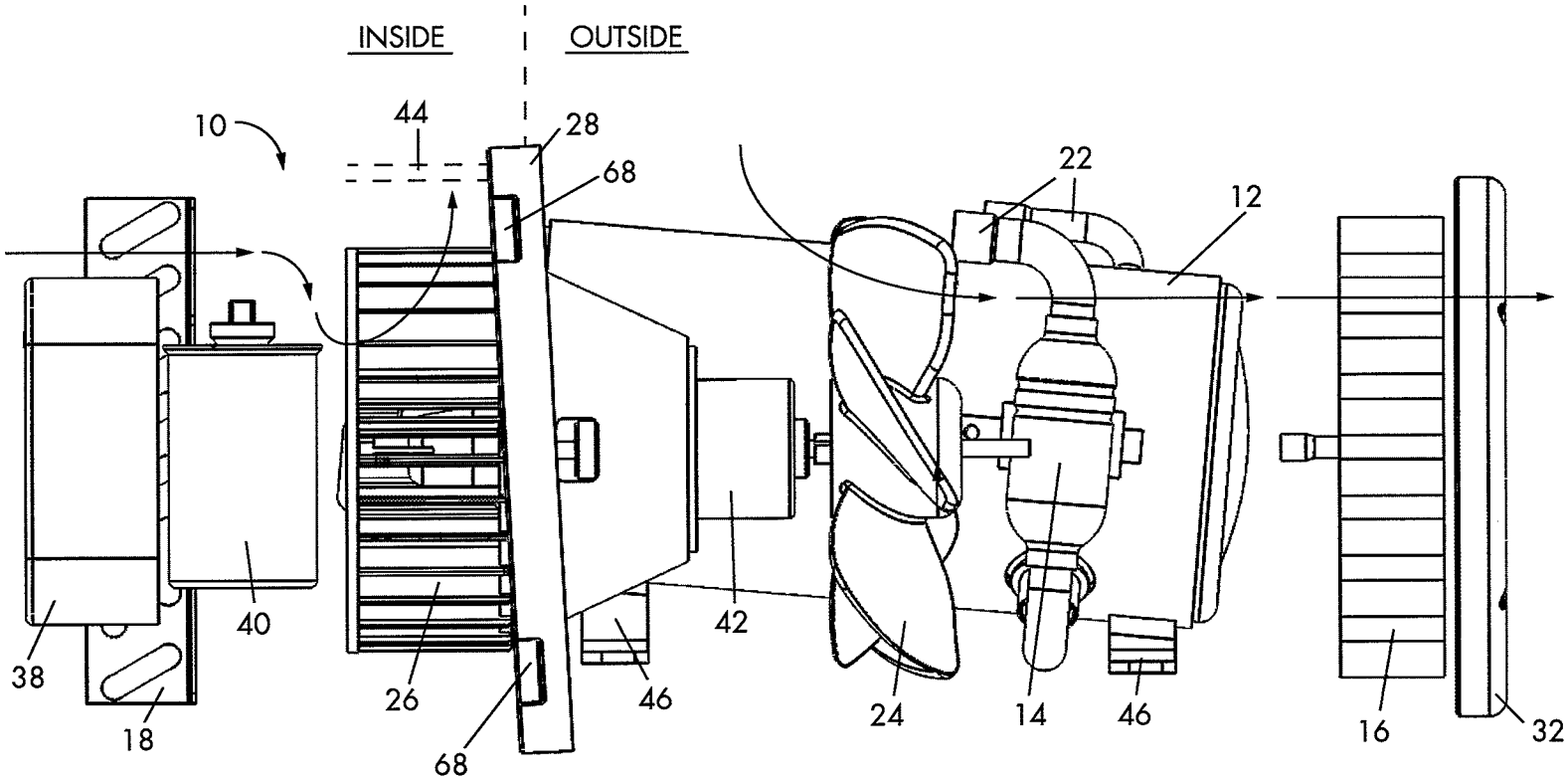
FIG. 4 illustrates a side view of the solution in FIGS. 1-3.

FIGS. 3 and 4 illustrate top and side views, respectively, of the internal components of the air conditioner 10. As shown, room temperature air is directed though the evaporator 18 and expelled by the evaporator fans 26 into the room through a cold air exit vent 44. External air is drawn in by the condenser fans 24 and expelled through the grill of the back plate 32.

The positioning of the cold air exit vent 44 on the top portion of the housing 20 reduces re-ingestion of cold air back into the room air intake grate, thus increasing the efficiency and effectiveness of the present air conditioner 10. In known air conditioner units, the cold air exit vent is usually located on the front of the housing, such as near the top edge of the face plate. As cold air is expelled through such a cold air exit vent, the air "sinks" in the downward direction due to the higher density of cooler air, and in the process of sinking some of the already-cooled air is re-ingested into the air conditioner through the room air intake grate located on the front of the housing, resulting in inefficiencies for the system. The present air conditioner 10 addresses this issue by positioning the cold air exit vent 44 on the top portion of the housing at a sufficient distance away from the face plate 30 and room air intake grate 34 located at the front of the housing 20 and utilizes the curved turning vanes to expel the cooled air upwardly at an angle into the room.

FIG. 4 further illustrates mounting feet 46 which provide support for the compressor 12. The mounting feet 46 may include a force absorbing feature, such as springs, shock absorbers, and/or dampers, incorporated into the support mechanism in order to reduce vibrations caused by the compressor 12. The compressor 12 may be angled upward toward the front of the air conditioner 10, with forward mounting feet being larger than rearward mounting feet.

The retaining strap 28 is arranged at an angle with respect to the housing 20 and helps to ensure that the air conditioner 10 is affixed to a window adapter at an angle for facilitating draining of condensation. In other words, the angle of the retaining strap 28 ensures that the housing 20 is angled downward slightly out of the back of the window in which it is mounted. As an alternative to arranging the retaining strap 28 at an angle to achieve the necessary condensation draining angle, the retaining strap 28 may be arranged substantially perpendicular to the longitudinal direction of the housing 20, and instead the window adapter may incorporate an angle in the opening of the adapter that receives the housing 20 of the air conditioner. As a further alternative, the window adapter may include a stop member adjacent to the opening of the adapter, the stop member being arranged at an angle with respect to the window in which the air conditioner is mounted, such that when the air conditioner housing 20 is received within the opening of the adapter and the retaining strap 28 abuts against the stop member, the air conditioner housing 20 is angled downward with the appropriate draining angle.

Figure 5:
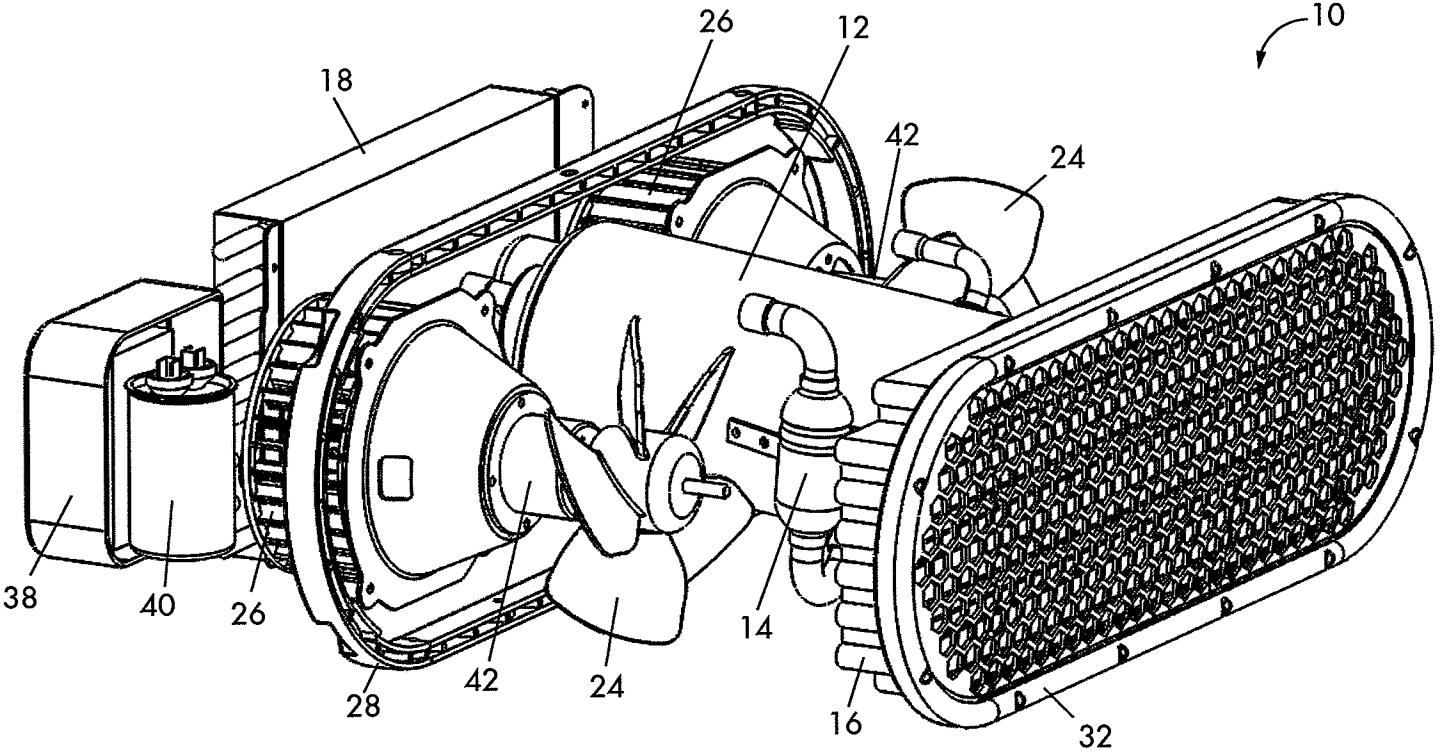
FIG. 5-7 illustrate various angles of the components of FIGS. 1-3 and a portion of the preferred housing.
Figure 6:
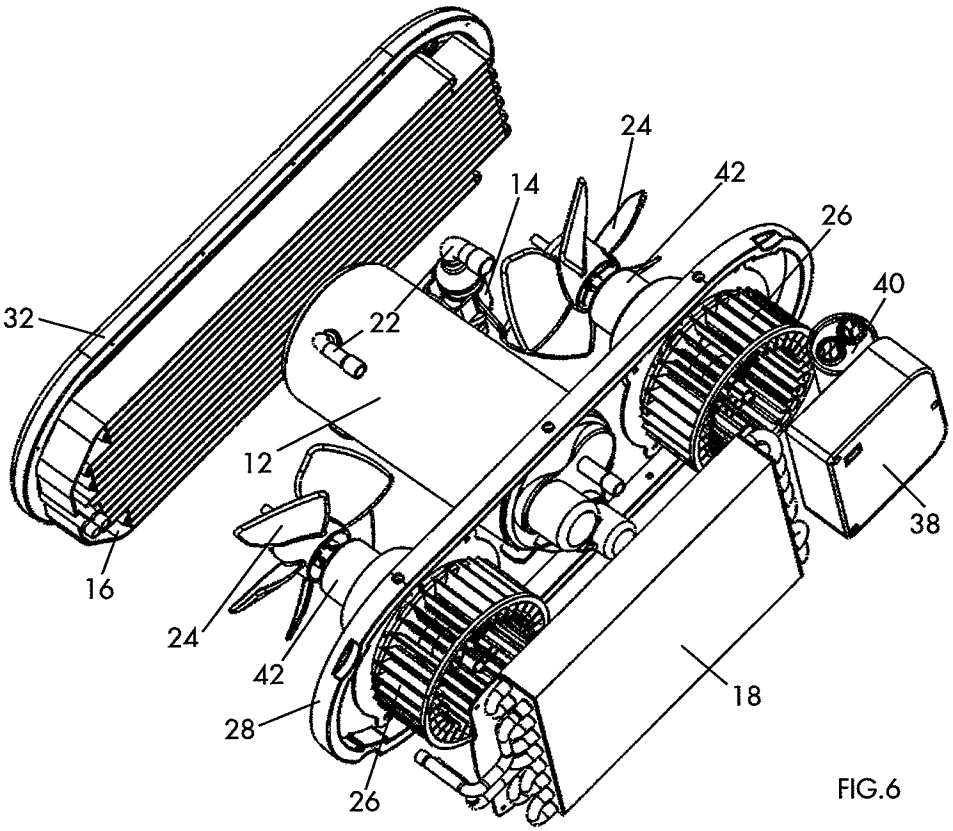

FIGS. 5 and 6 provide additional views of the internal components of the air conditioner 10. FIG. 5 includes a view partially from the rear of the air conditioner 10, illustrating an exemplary embodiment of the rear plate 32, including perforations for venting hot air of the condenser flow.

Figure 7:
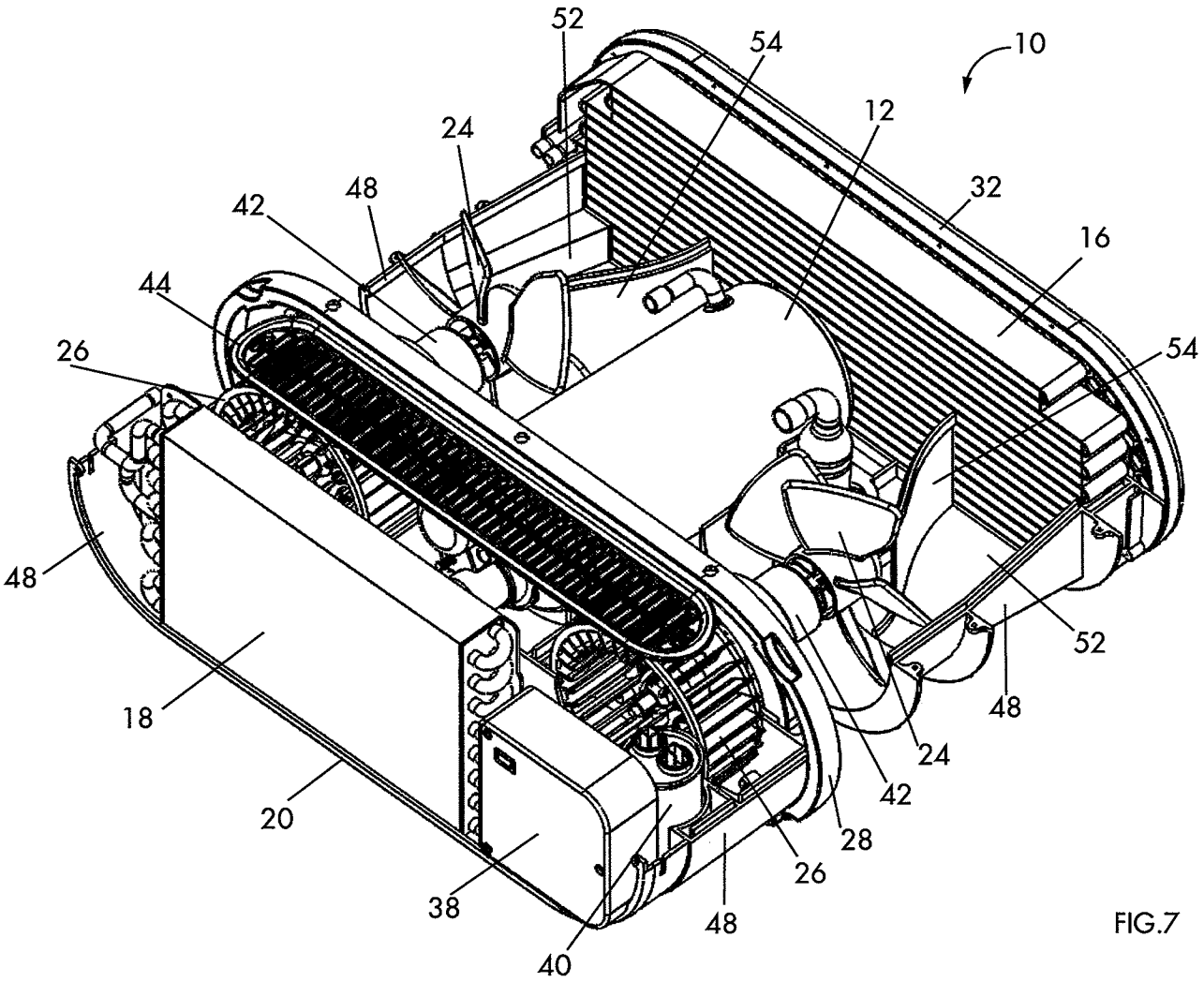

FIG. 7 shows additional components of the preferred housing 20, including the cold air exit vent 44 and a lower manifold 48. The lower manifold 48 forms a bottom internal portion of the housing 20 and may include a clam shell design which cooperates with an upper manifold 50 (shown in FIG. 9) to surround and support the internal components of the air conditioner 10.

The lower manifold 48 (and upper manifold 50) are preferably formed as separately-molded pieces. Conventional air conditioning units usually include a bottom plate (instead of a manifold) or a bottom tray that all major components are affixed to and a metal sheet enclosure which provides less than ideal structural integrity for the unit. The clam shell manifolds 48, 50 combine to hold internal components in place while adding structural integrity to the overall unit.

Figure 8:
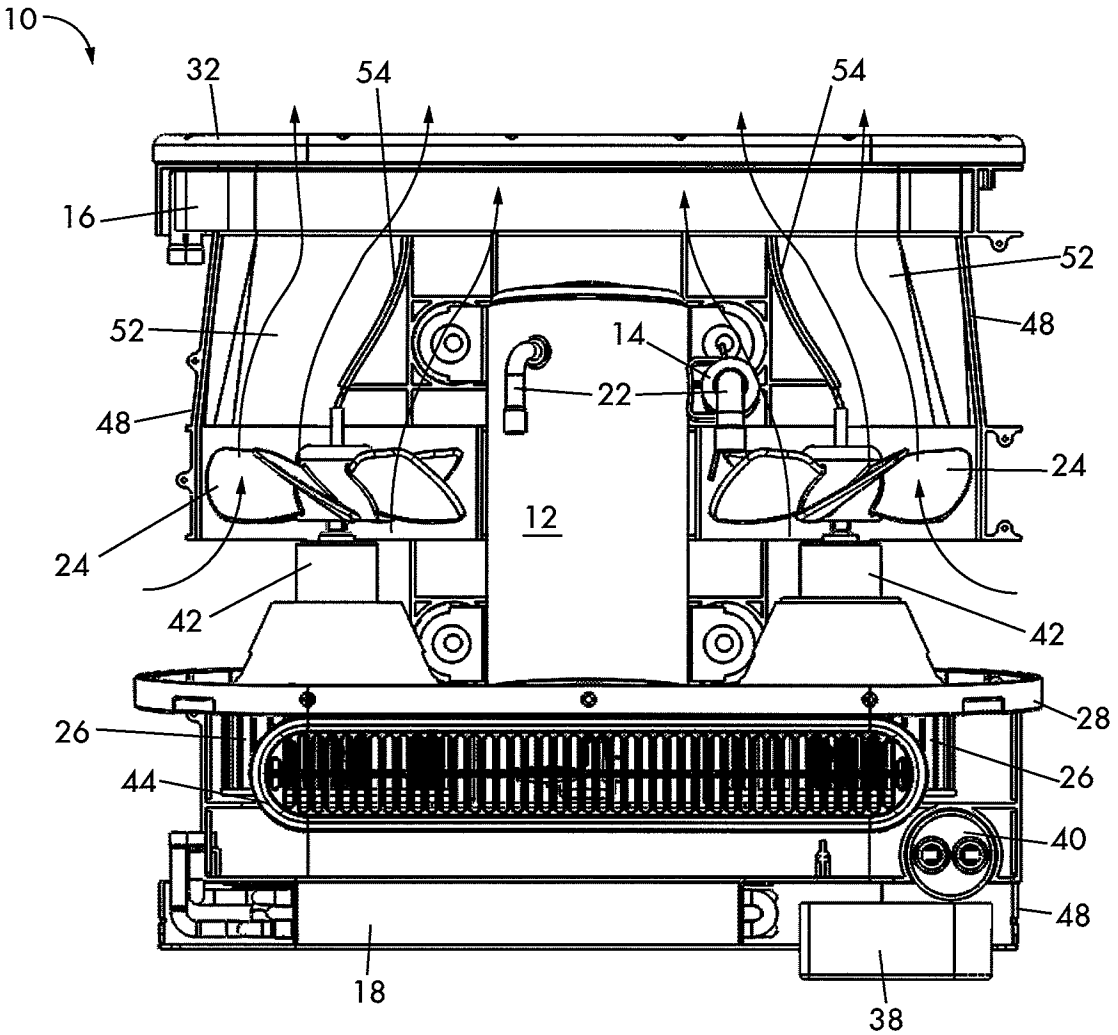
FIG. 8 is a top plan view illustrating the air flow in the embodiment of FIG. 1.

FIG. 8 further illustrates the air flow path for outside air through the condenser 16. The lower manifold 48 includes a pair of molded air guides 52 adjacent to the condenser fans 24 for guiding air pulled in from the outside through the condenser 16. The shape of the molded air guides 52 in the lower manifold 48 are designed to enhance air flow through the condenser. Conventional air conditioners do not include air guides and instead include only an axial fan in front of a rectangular heat exchanger. The presently-disclosed air conditioner 10, including separate axial condenser fans 24 and lower manifold 48 with air guides 52 spreads the air flow across the entire heat exchanger portion of the condenser 16 to thereby improve efficiency of the condenser 16 (over previous designs) while allowing for a more compact design.

The air guides 52 preferably include turning vanes 54 which direct the flow of air toward the condenser 16. The turning vanes 54 may create flow channels 56 which include outer channels which direct air toward the outer ends of the condenser 16 and a central channel between the outer channels. The turning vanes 54 may be angled inward to direct flow through the central channel toward the center of the condenser 16.

Figure 9:
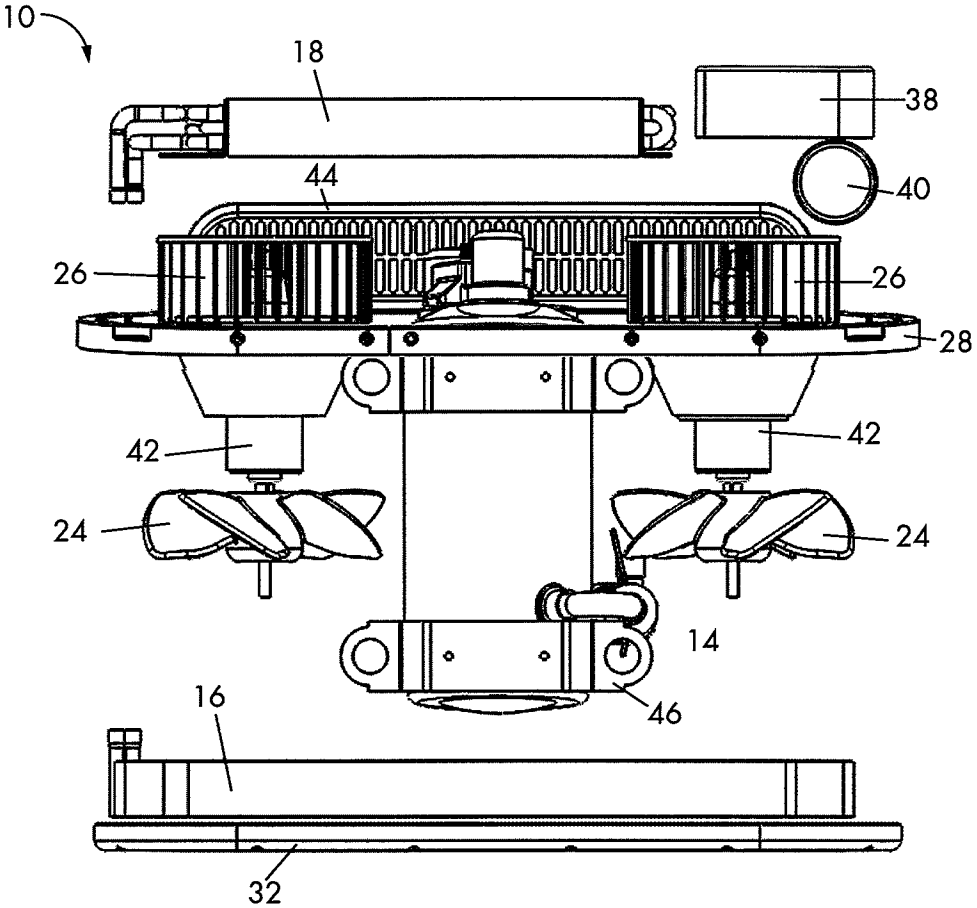
FIGS. 9-10 illustrate details of the component arrangement in in the embodiment of FIG. 1.
Figure 10:
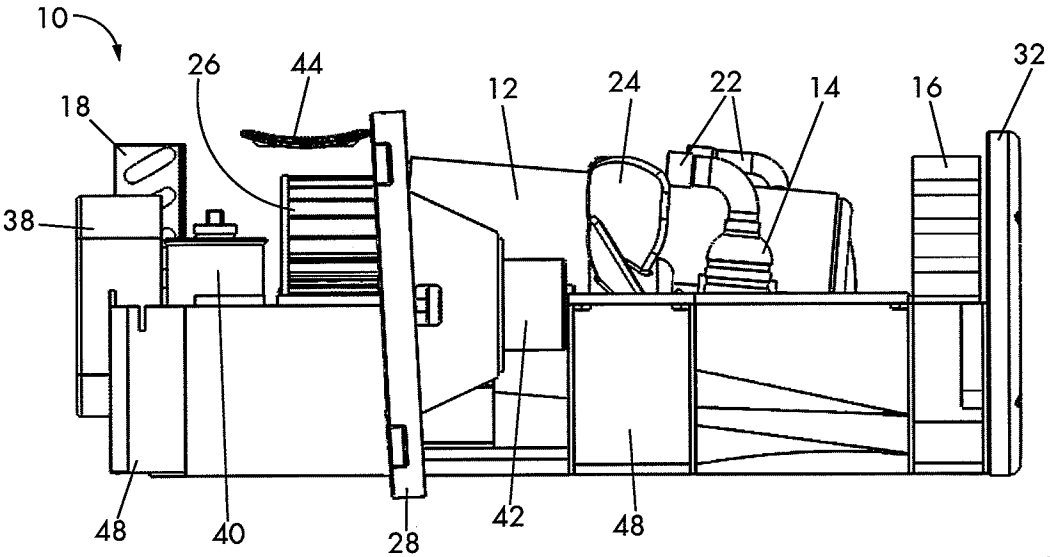
Figure 11:
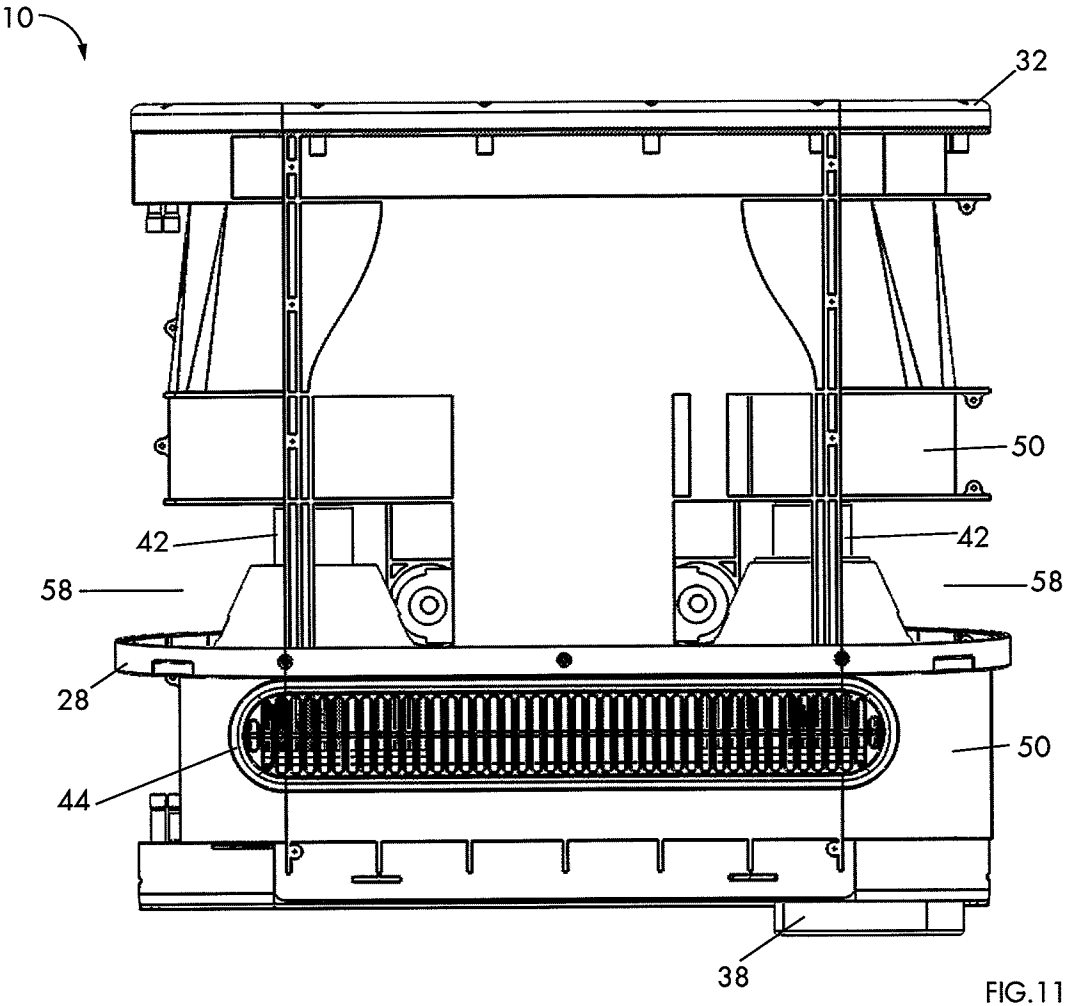
FIGS. 11-12 illustrates the exterior of the housing in the embodiment of FIG. 1.

FIGS. 9 through 11 illustrate the location of the compressor 12 between the air movers (e.g., condenser fans 24 and evaporator fans 26) that are located between the condenser 16 and the evaporator 18. FIG. 9 includes a bottom view of the internal components of the air conditioner 10 with the lower manifold 48 removed. The compressor mounting feet 46 extend around the compressor 12 to provide support at either end. The mounting feet 46 being positioned at the ends of the compressor 12 allows the axial compressor fans 24 to overlap the space between the mounting feet 46, thereby achieving a compact profile. The centrally-located compressor 12 and dual air movers also allows space for the piping 22 (referring to FIG. 3) to extend in a compact manner.

FIG. 10 further illustrates a side view of the air conditioner 10 with the lower manifold 48 in place and further including the cold air exit vent 44. The cold air exit vent 44 may be curved to provide additional surface area in a compact space. FIG. 11 illustrates a top view of the air conditioner 10 with the upper manifold 50 in place and connected to the lower manifold 48 to form the internal support portion of the housing 20. The interconnected manifolds 48, 50 form the clam shell manifold assembly which forms a duct around the four fans 24, 26 to direct air flow appropriately to enhance cooling density of the heat exchanger portions of the condenser 16 and evaporator 18. The upper manifold 50 covers the fans 24, 26 but includes an opening on the condenser side of the retaining strap 28 to form an air intake 58 for the condenser air flow. The air intake may be a side and top opening in the upper manifold 50 between the retaining strap 28 and the condenser fans 24, for example.

Figure 12:
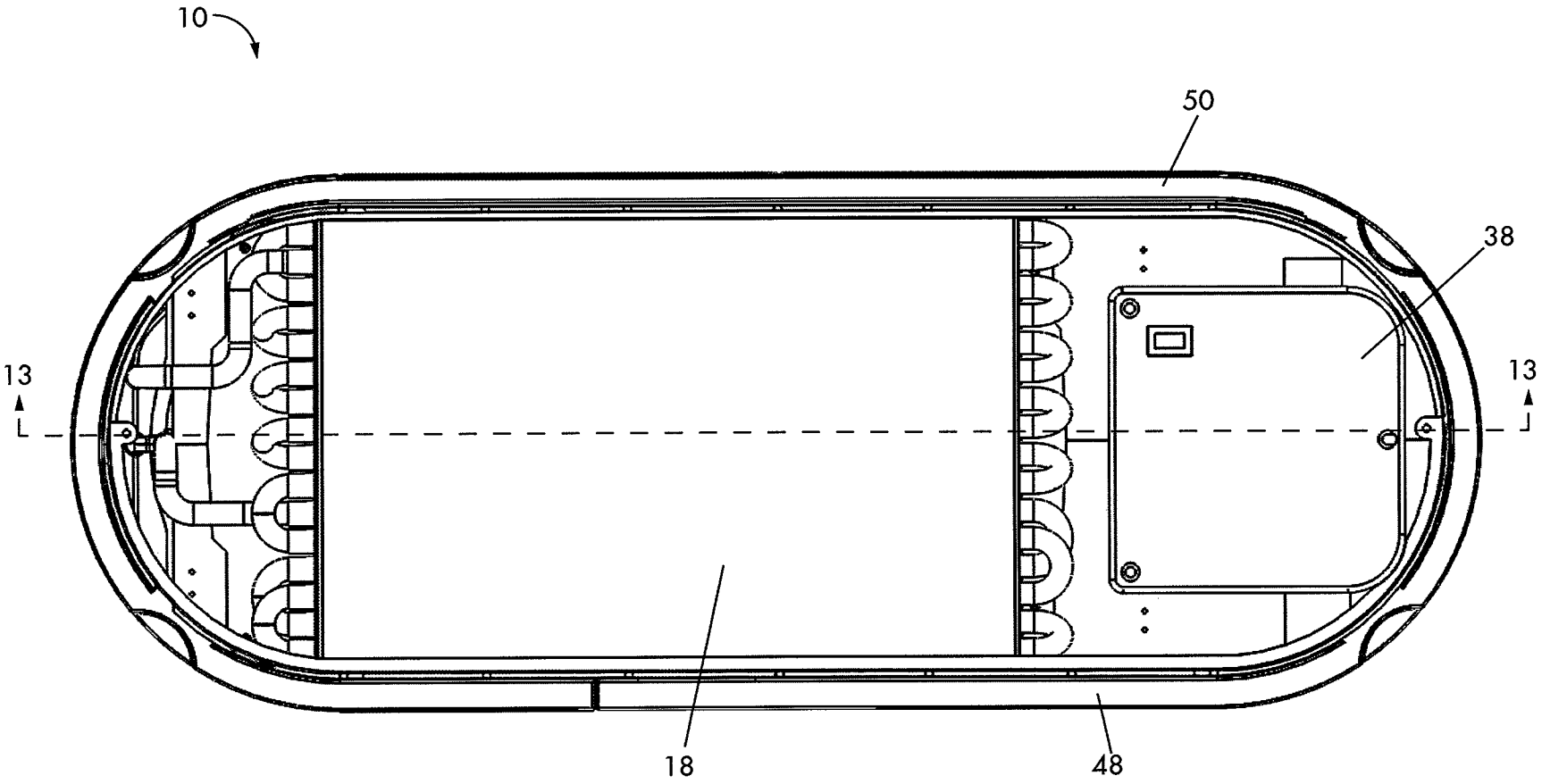
Figure 13:
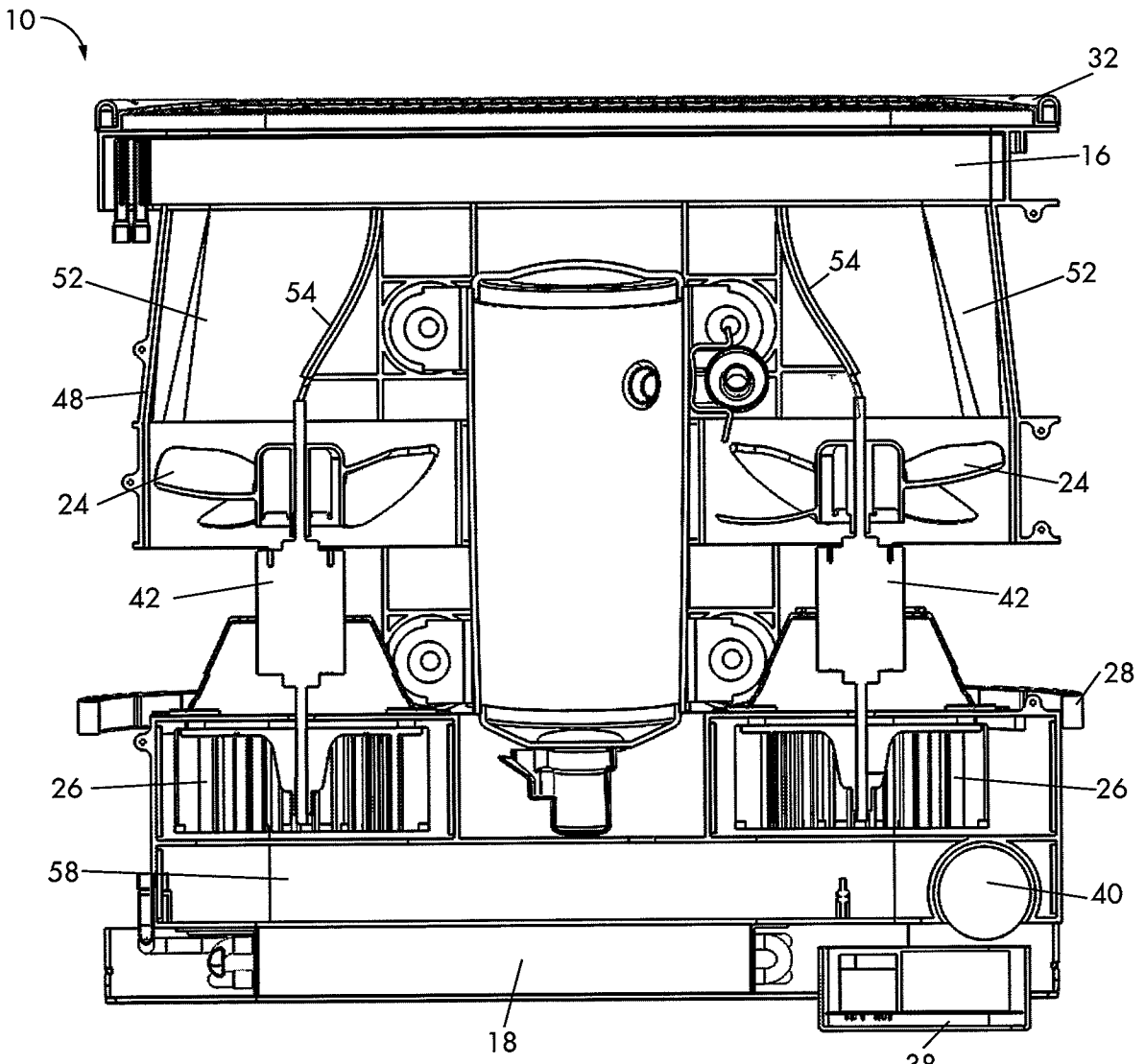
FIG. 13 is a top plan views illustrating the flow of air in the embodiment of FIG. 1 over the evaporator into the housing and through the condenser to the outside.

FIG. 12 is a front view of the internal structure of the air conditioner 10, including the manifold assembly of the lower manifold 48 and upper manifold 50 with the face plate 30 removed. FIG. 13 is a cross-sectional view taken along line 13-13 in FIG. 12. FIG. 13 provides an additional illustration of the internal components of the air conditioner 10. It can be seen in FIG. 13 that an intake plenum 58 is present between the evaporator 18 and the evaporator fans 26. The intake plenum 58 is an open space create by the manifold assembly that allows room air sucked in through the evaporator 18 to reach the evaporator fans 26.

FIGS. 14 through 29 illustrate the features of the preferred housing that provide the reduced envelope size that accommodates the compact component arrangement and establishes the airflow paths that increase the efficiency of the completed air conditioner 10.

Figure 14:
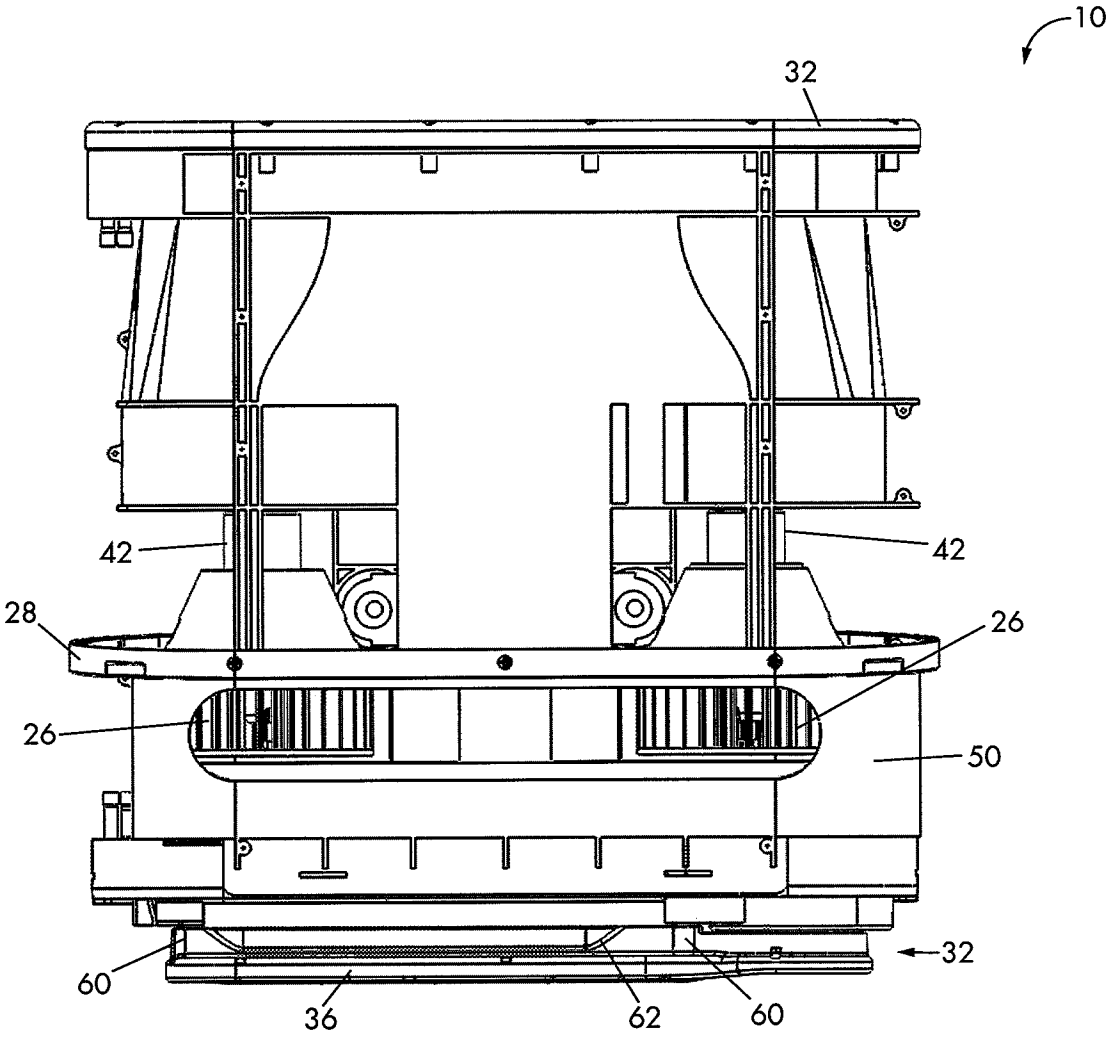
FIGS. 14-21 illustrate exterior details of the housing in the embodiment of FIG. 1.

FIG. 14 includes a top view of the air conditioner 10 including the upper manifold 50 and the face plate 32. The face plate 32 includes handle attachments 60 which connect the handle 36 to the manifold assembly. The handle 36 further includes a structural element 62 which acts as a stiffener.

Figure 15:
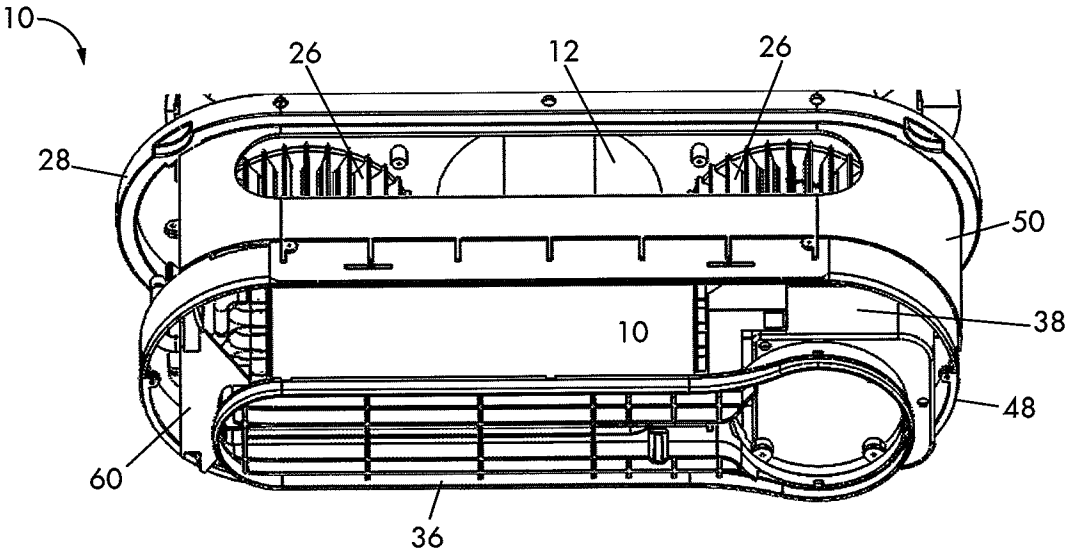
Figure 16:
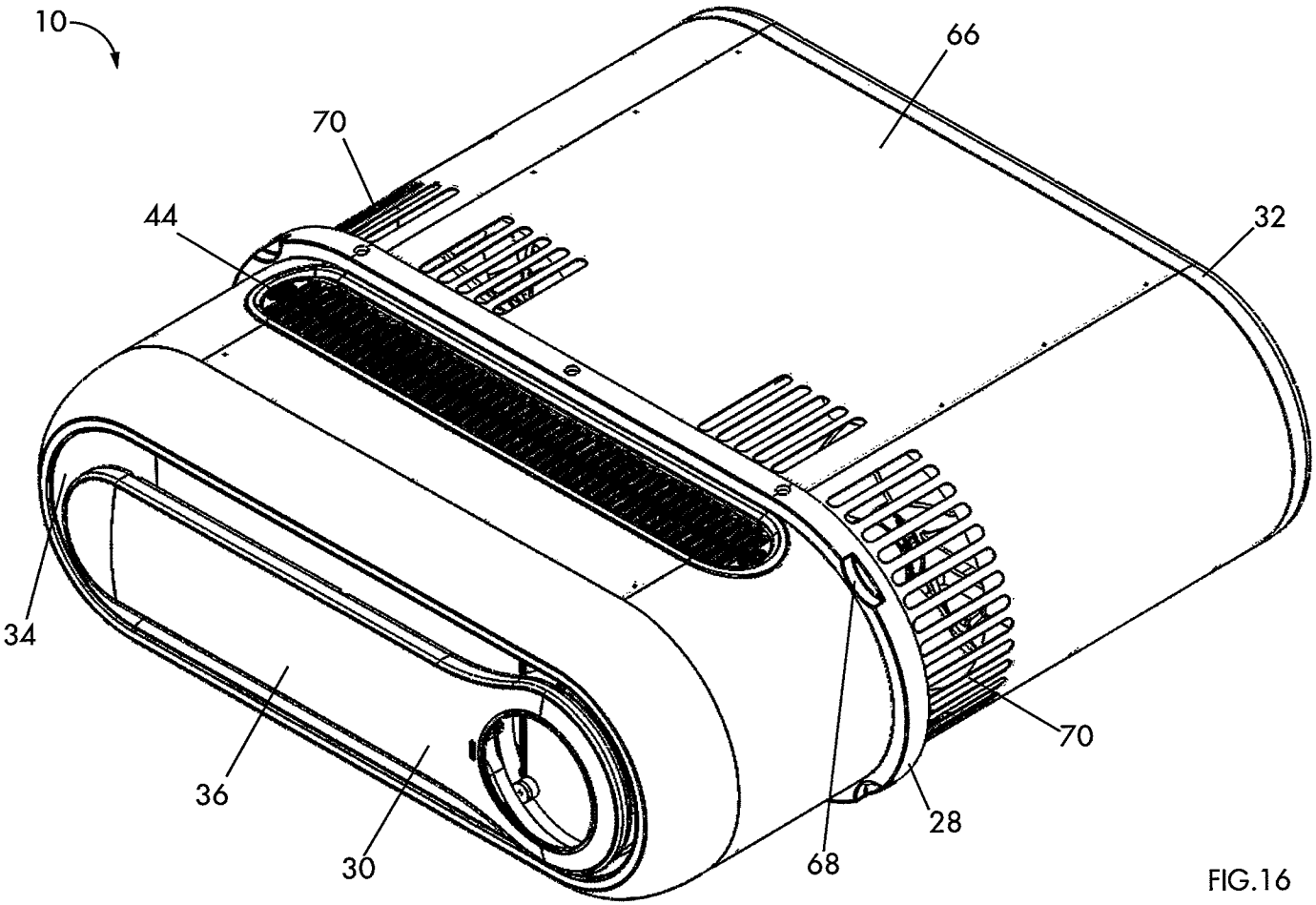
Figure 17:
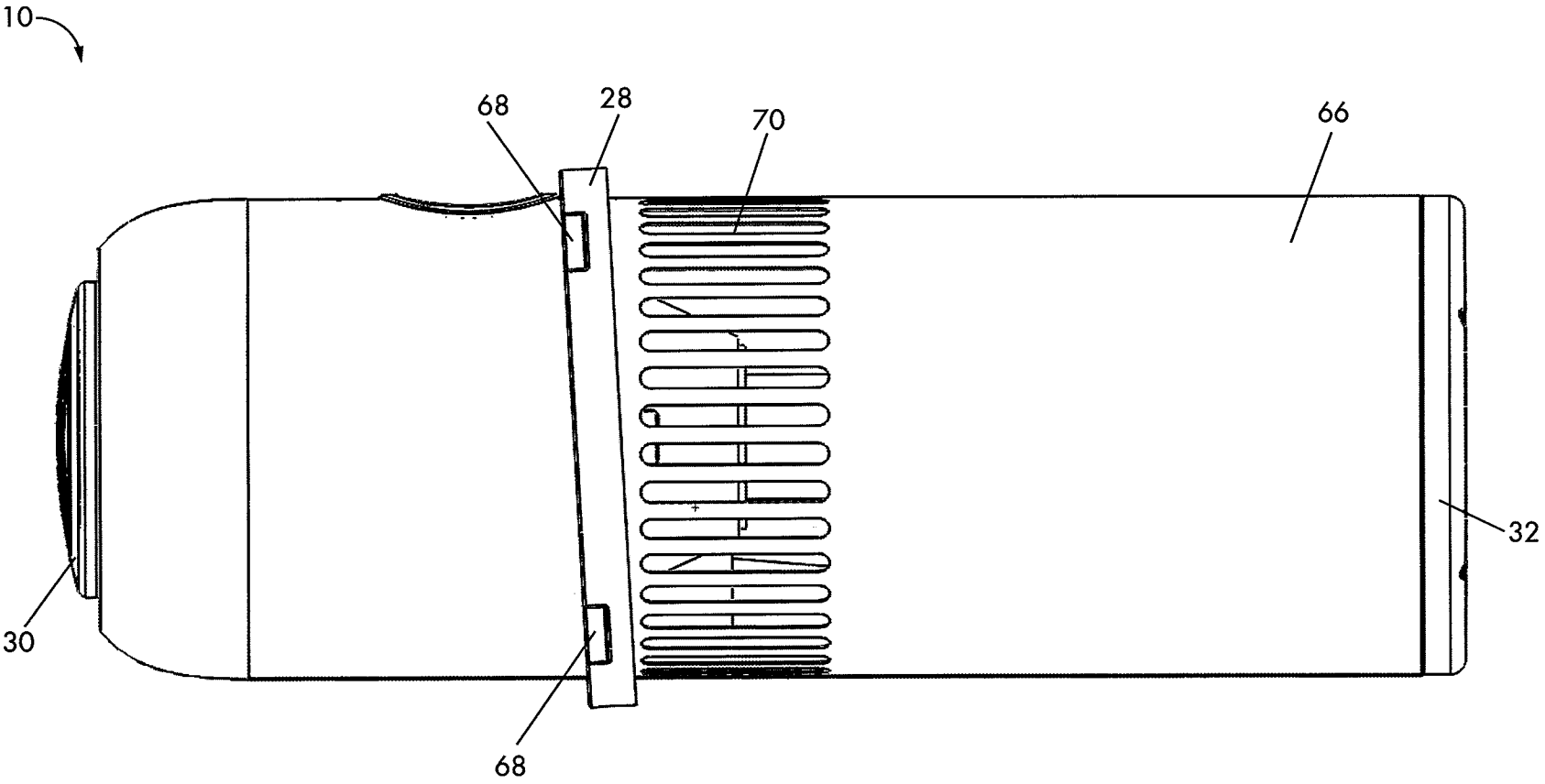
Figure 18:
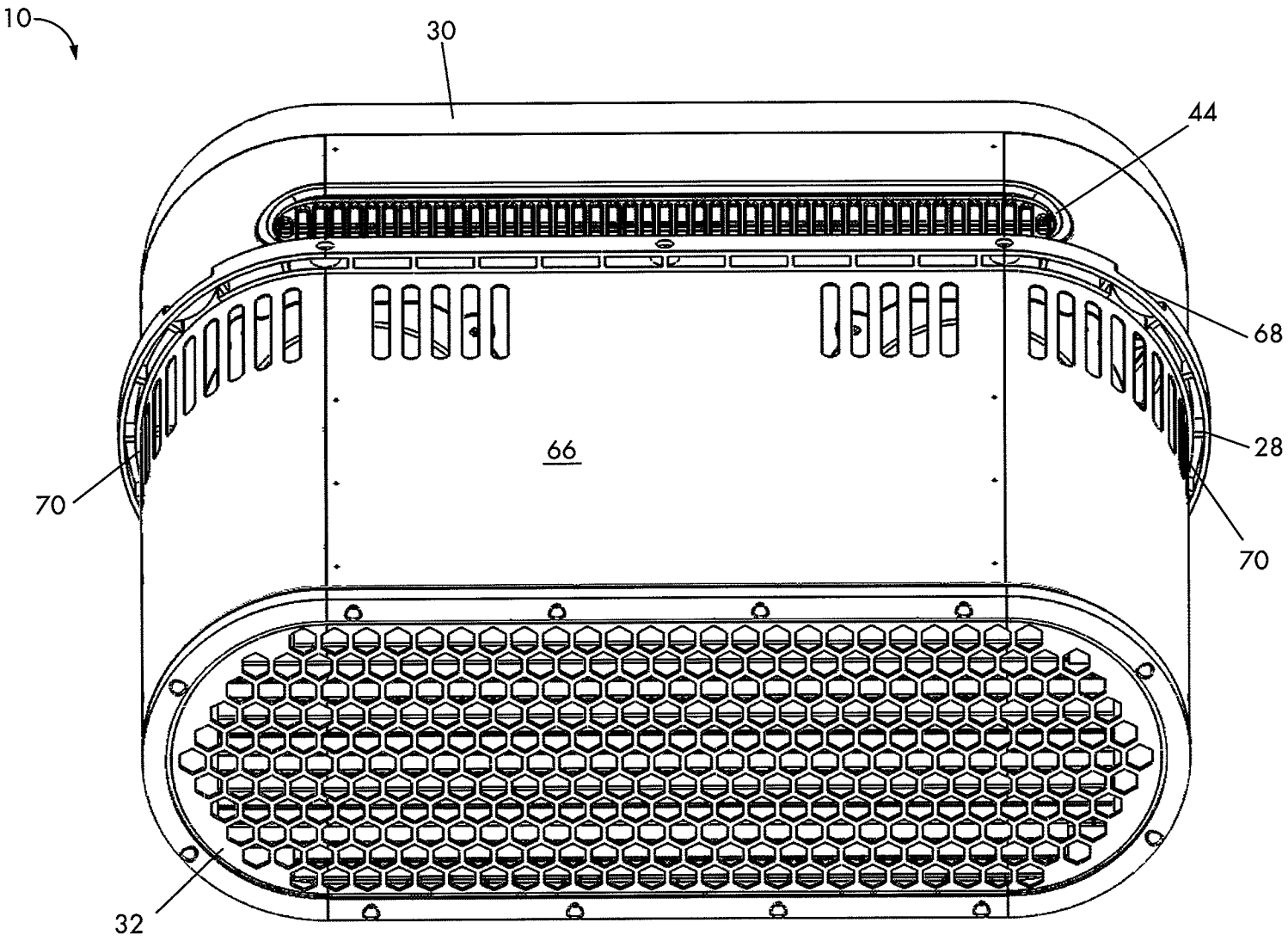
Figure 19:
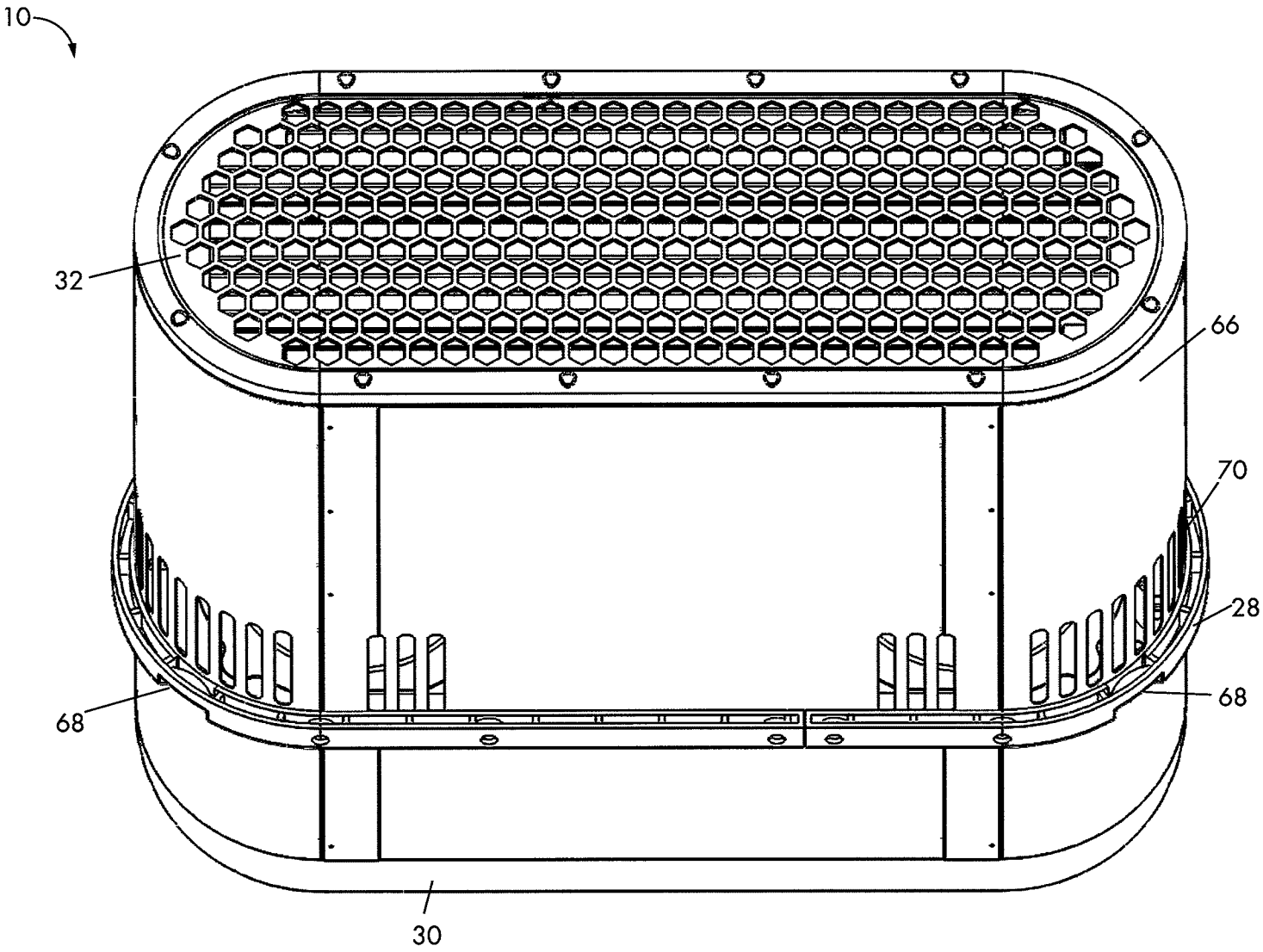
Figure 20:
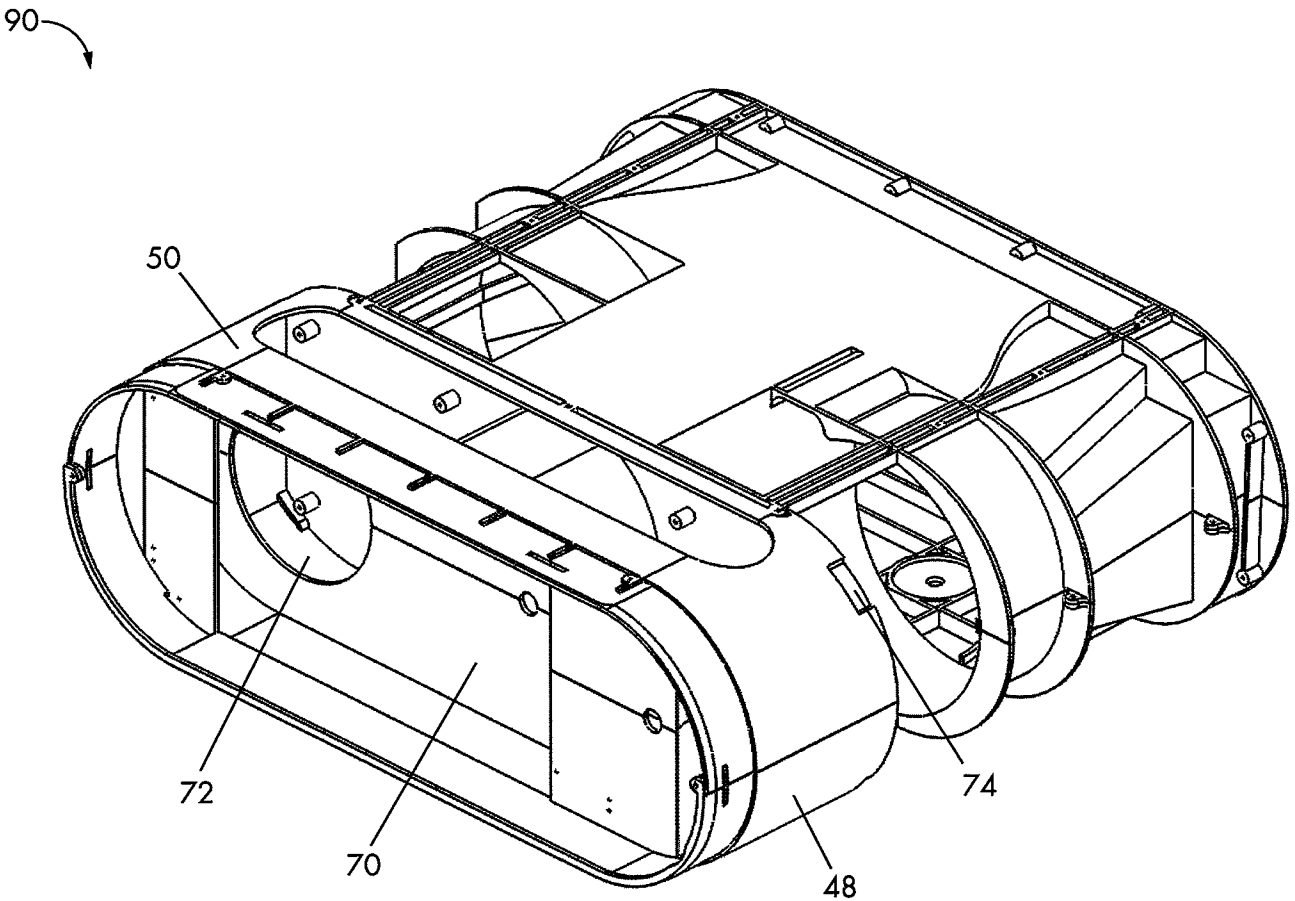
Figure 21:
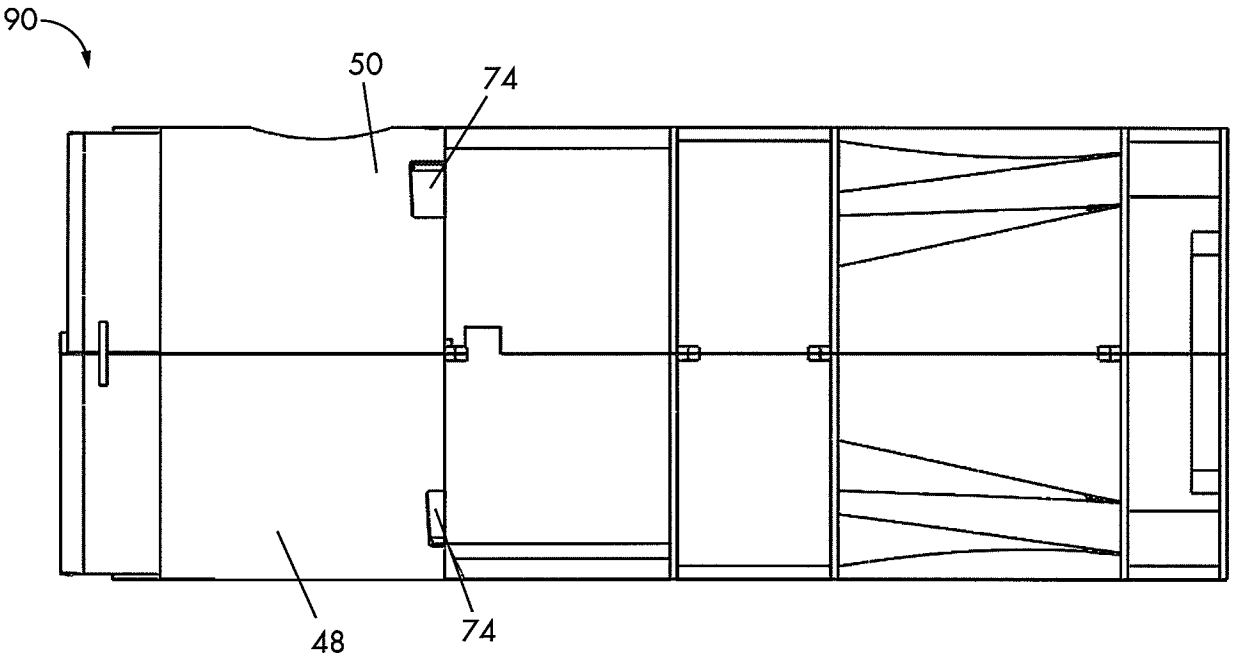

FIG. 15 further illustrates the front portion of the air conditioner 10 including the handle 36 and the handle attachments 62 without the front cover of the face plate 30. The handle attachments 62 are connected to both the upper and lower manifolds 48, 50 for full support so that the entire air conditioner 10 can be lifted by the handle 36 safely and easily.

FIGS. 16-19 various views which illustrate the full external housing 66 of the housing 20, The external housing 66 forms an outer most protective portion of the air conditioner 10 and extends between the face plate 30 and the back plate 32. The retaining strap 28 protrudes from the external housing 66 and includes window frame adapter fastening receptacles 68, which will be described in more detail below. The external housing 66 further includes an external air intake grate 70 which is aligned with the air intake 58 to facilitate the condenser air flow. The air intake 58 may be formed along the perimeter of the handle 36, such that instead of a visible air intake grate, the air intake 58 takes the form of a vent that is integrated into the front cover of the face plate 30, which is both functional and aesthetically pleasing in design. In addition, the air intake 58 provides additional spacing around and behind the handle 36, which accommodates the user's fingers and hand when grasping the handle 36 during use. The external air intake grate 70 extend around the top, bottom, and sides of the external housing 66 in order to enhance air flow to the condenser fans 24 to ensure sufficient air flow to effectively cool the condenser 16.

In use, the interior room air is drawn in and is cooled by the relatively colder surfaces of the fins of the evaporator body due to the cold boiling liquid refrigerant flowing through the evaporator tubing. As the cooled interior room air exits the back of the evaporator body, the cooled air is guided upwards and back into the interior of the room or building by an air guide assembly through the cold air exit vent 44 located at the top portion of the housing. The thermal energy (i.e. heat) from the cooled interior room air IA is transferred into the refrigerant that flows through the evaporator tubing of the evaporator, which is in turn warmed from a low-pressure cold boiling liquid into a low-pressure cold gas as the refrigerant flows from the evaporator 18 through the accumulator 14 and into the compressor 12 to be pressurized and heated. The accumulator 14 ensures that any liquid left in the refrigerant is removed before the refrigerant enters the compressor 12, so as not to damage the compressor 12 when the gaseous refrigerant is pressurized and heated.

FIGS. 20-24 further illustrate the manifold assembly 90, including the lower manifold 48 and the upper manifold 50. The manifold assembly is a clamshell design with the lower and upper manifolds 48, 50 that are singular molded parts which reduces the overall part count and improves stiffness of the structural design. Each of the lower and upper manifolds 48, 50 may be a single injection molded part, which reduces the part count for the entire air conditioner assembly and improves overall stiffness. When connected to each other, the manifolds 48, 50 include a wall 70 which divides the evaporator portion from the condenser portion of the air conditioner 10. The wall 70 includes openings 72 for the motors of the sets of air movers (formed by fans 24, 26). The manifolds 48, 50 include receptacles 74 for receiving a portion of the retaining strap 28. The receptacles 74 are preferably located in the corners. The locations of the receptacles 74 correspond to the fastening receptacles 68 for the window frame adapter. Once installed, these corner locations receive a majority of the load on the air conditioner 10 so the receptacles are positioned to directly receive the load at the attachment point.

Figure 22:
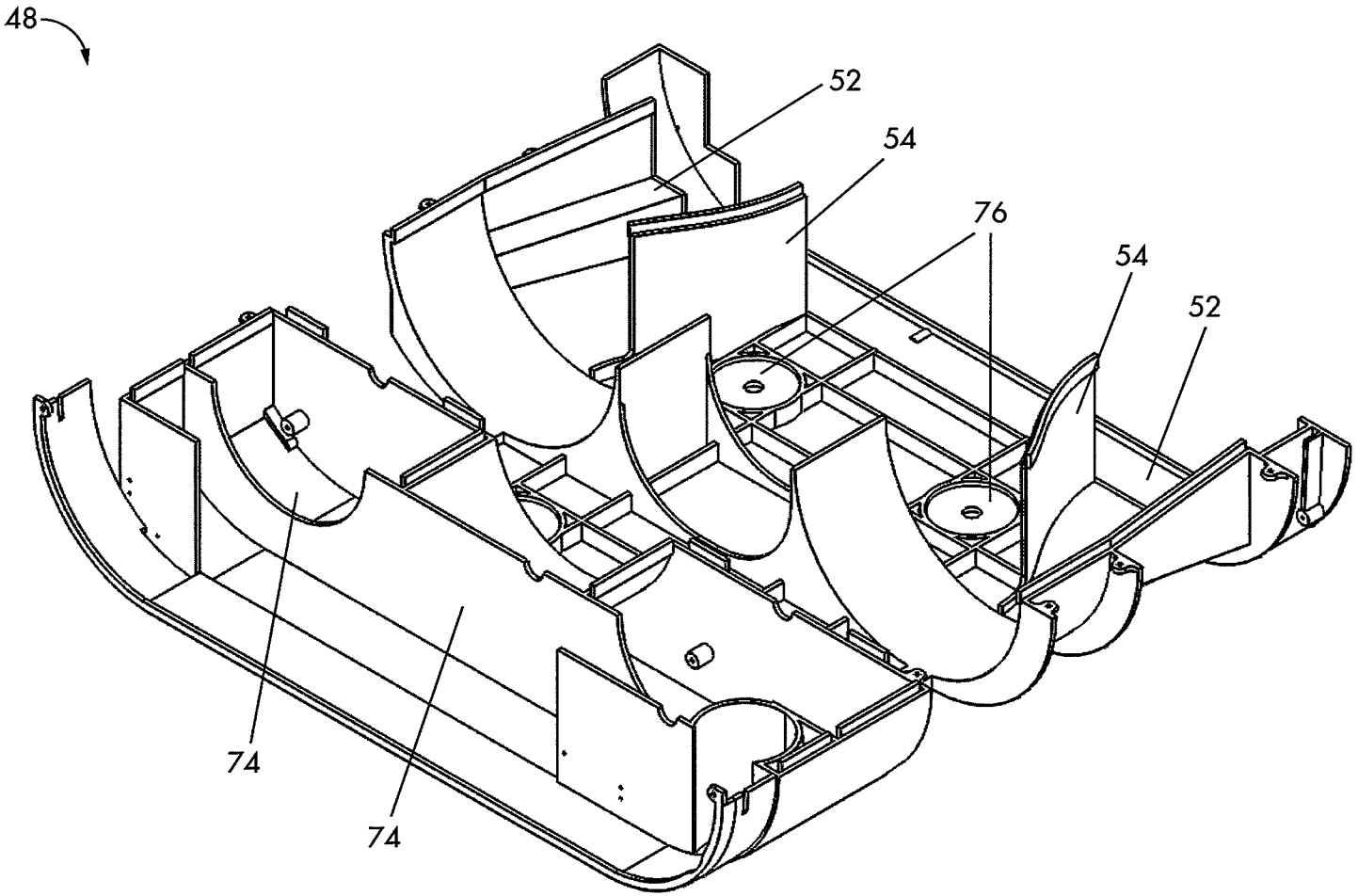
FIGS. 22-24 illustrate details of the interior housing structure for the air flow path in the embodiment of FIG. 1.
Figure 23:
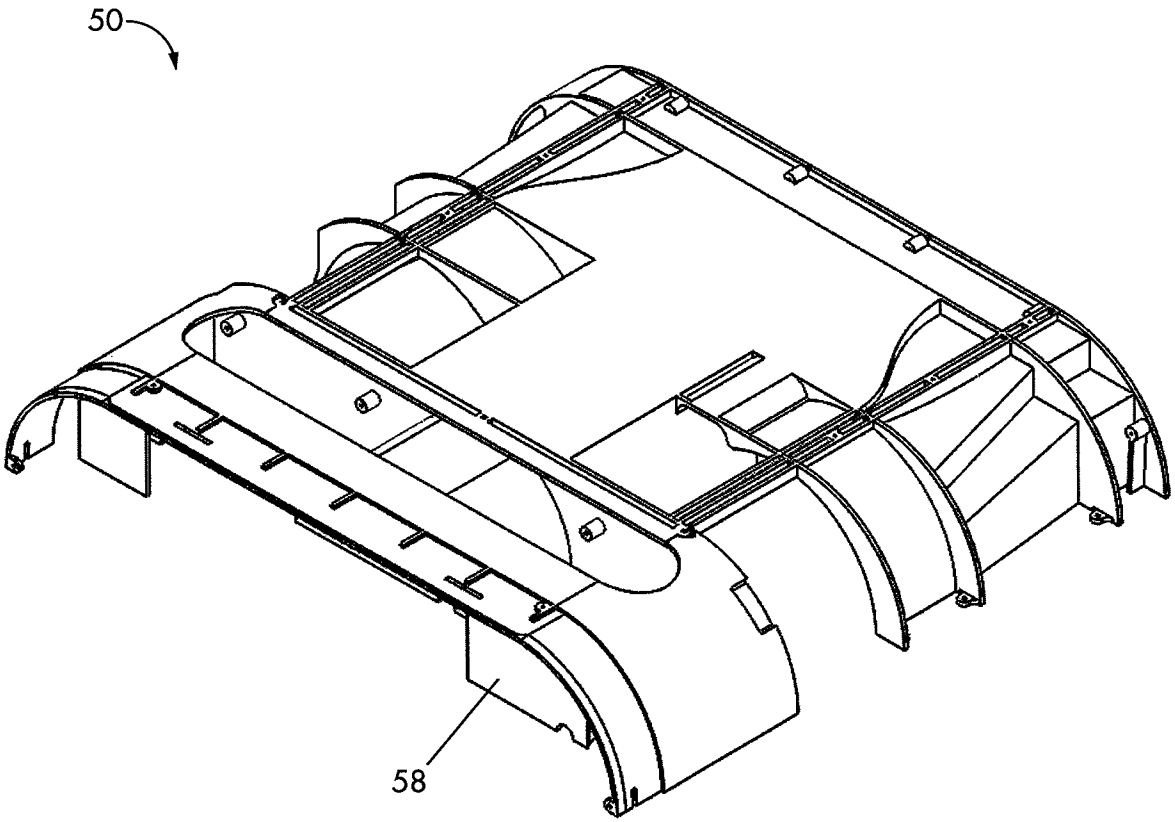
Figure 24:
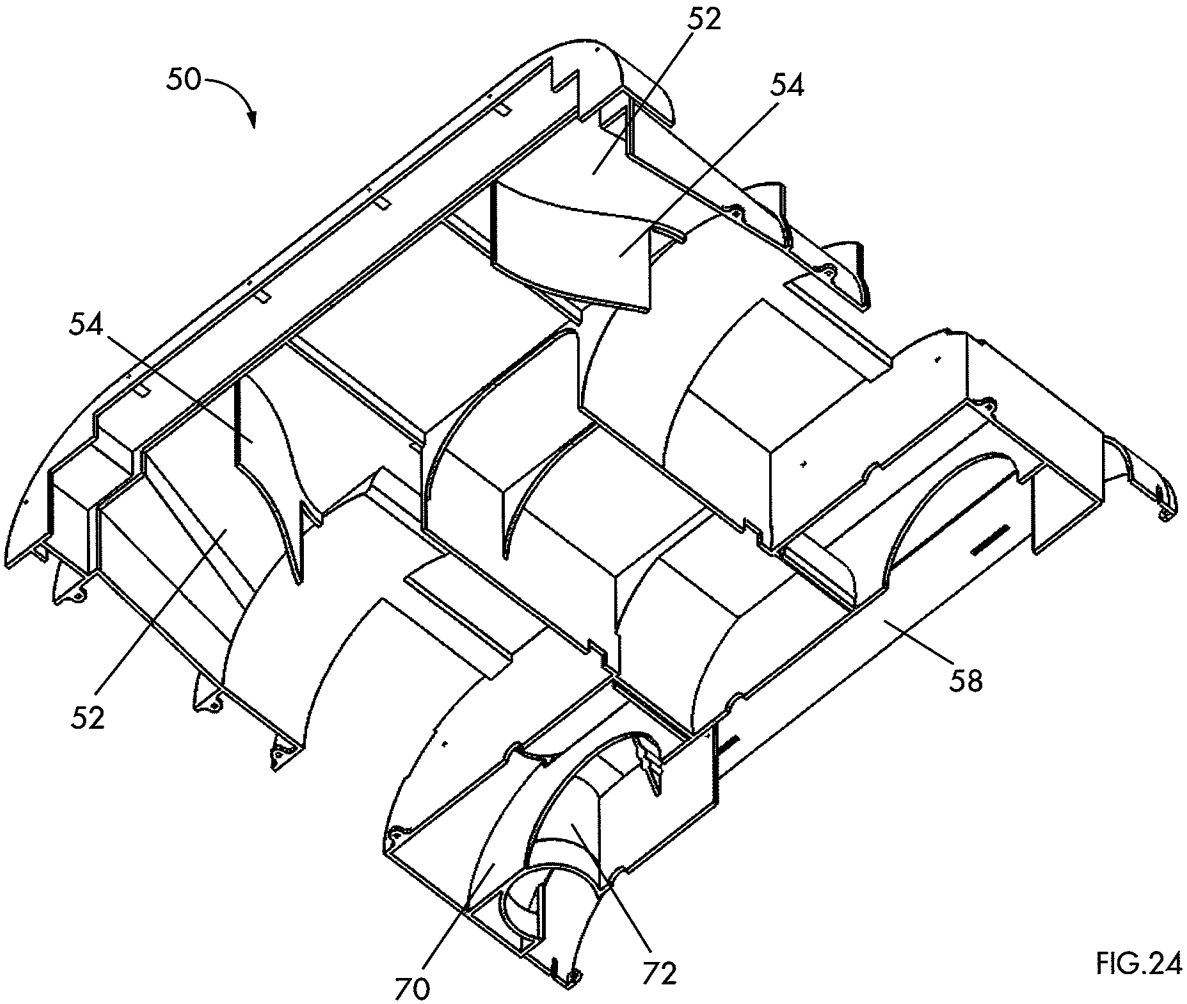

FIG. 22 includes a view of the lower manifold 48. The lower manifold 48 includes various integral compartments for receiving the internal components of the air conditioner 10. The lower manifold 48 includes supports 76 for the compressor mounting feet 46. FIGS. 23 and 24 further illustrate the upper manifold 50, which includes integral compartments which align and combine with the lower manifold 48 to form appropriate ducts and air guides around the fans to direct the air through the evaporator portion and condenser portion. The manifolds 48, 50 also provide convenient points of fixation for the various components.

FIGS. 25-29 further illustrate the completed assembly of the air conditioner 10. The face plate 32 is arranged with the control knob 74 which may include light pipe or LED display for controls. When viewed from the rear (FIG. 27) it is evident that the retaining strap 28 may not be a solid piece. Instead, the retaining strap 28 is a shelled structure with an appropriate thickness for injection molding. The shelled structure uses less material but is strengthened by the ribs between the openings.

Figure 30:
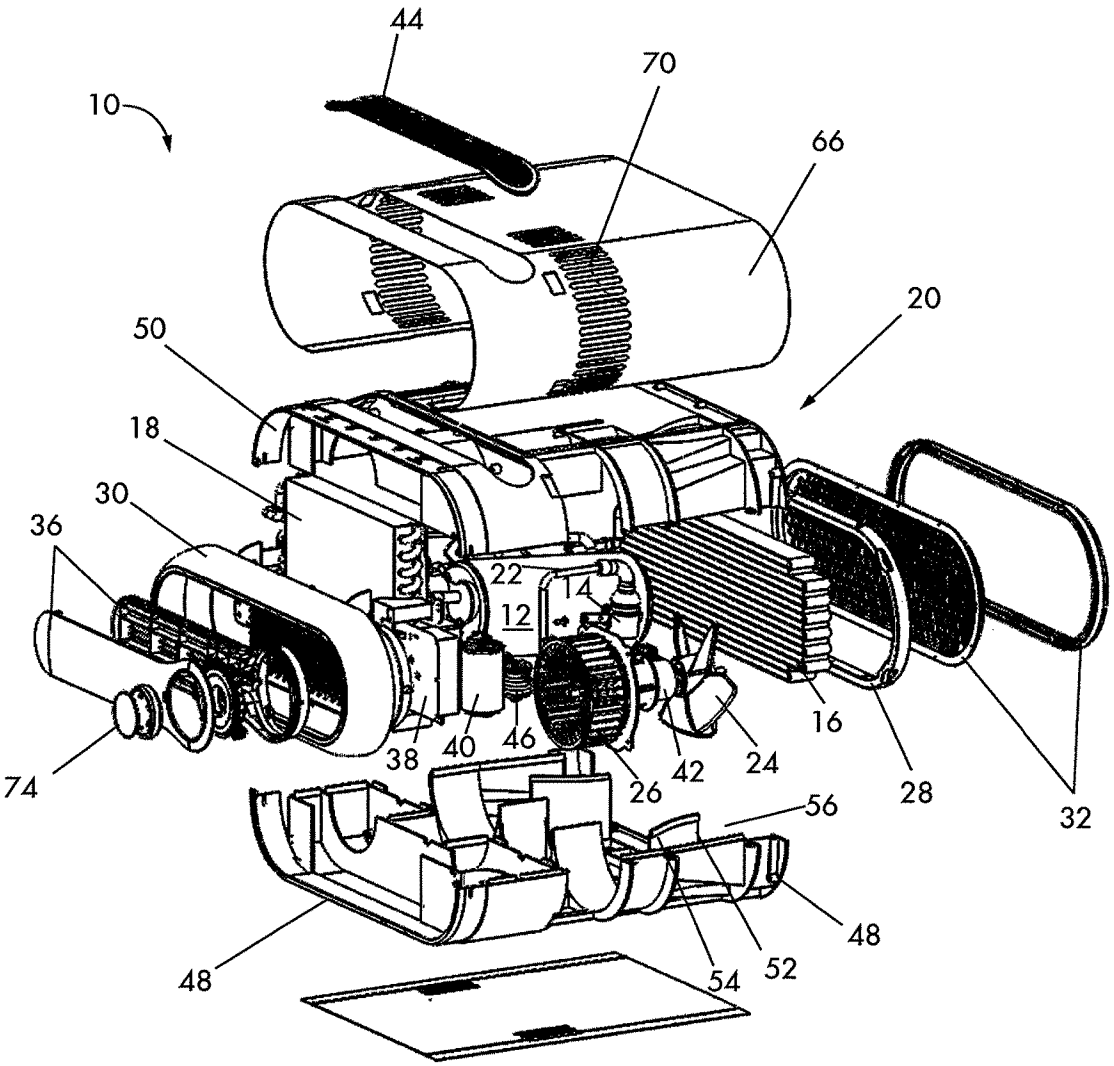
FIG. 30 is an exploded view of the air conditioner components and housing for a second embodiment.
Figure 31:
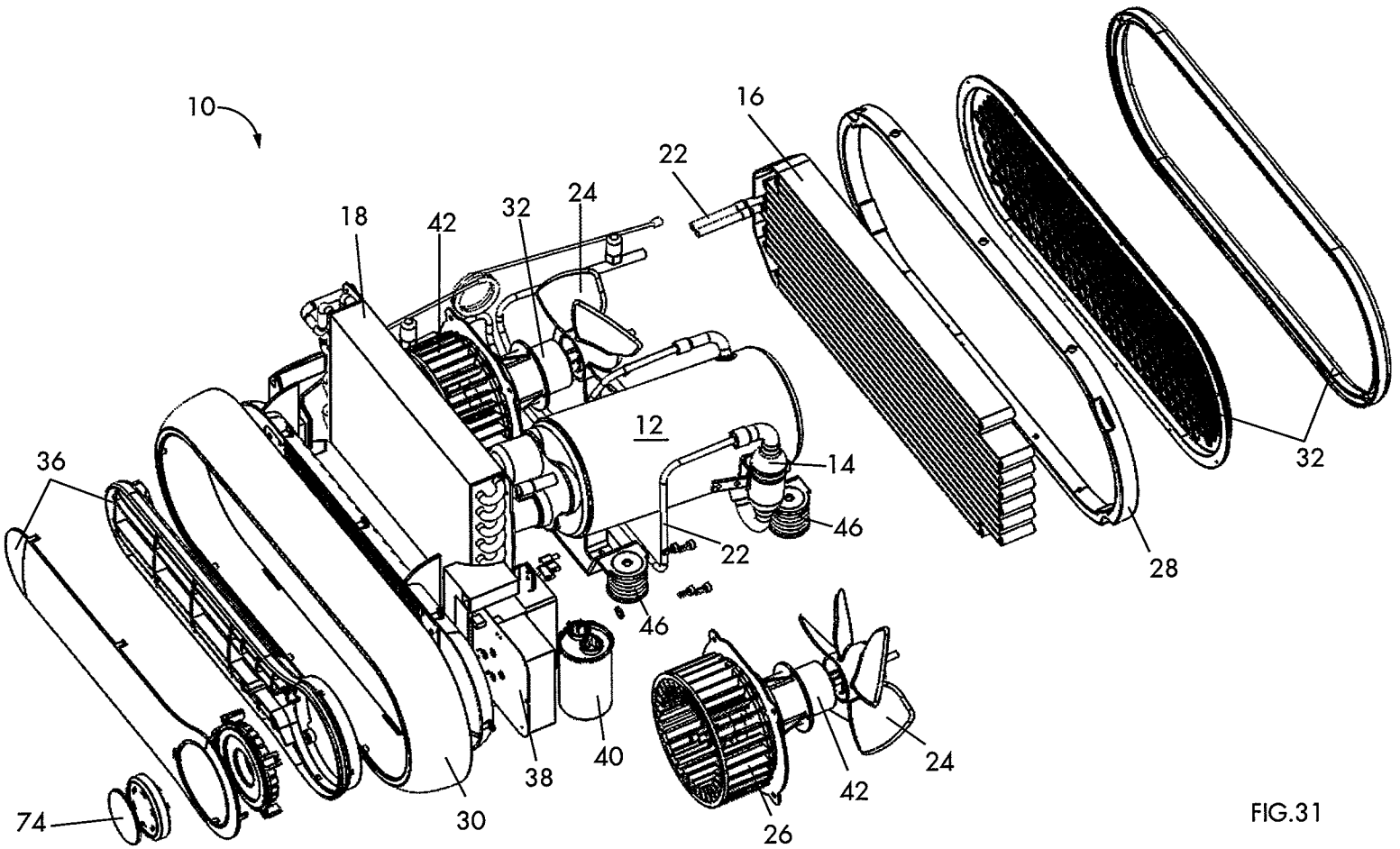
FIG. 31 is an exploded view of the air conditioner components and the front and rear parts of the housing in the embodiment of FIG. 30.

FIGS. 30 and 31 illustrate exploded view of the air conditioner 10. In FIG. 30, the external housing 66 can be seen to be made up of curved side portions connected by flat plate elements. FIG. 31 shows an exploded view of selected components of the full window air conditioner assembly, and better illustrates the various piping 22 that connects the compressor and heat exchangers. Specifically, each heat exchanger has two ports. On each of the condenser and the evaporator, one of these ports is used to connect one to the other via an expansion valve, which is shown in FIG. 31 in the form of a capillary valve that is formed as a thin coil of tubing. The other ports of the condenser and the evaporator are each connected to the compressor through tubing, the condenser being connected to the compressor outlet, while the evaporator is connected to the compressor suction port.

Figure 32:
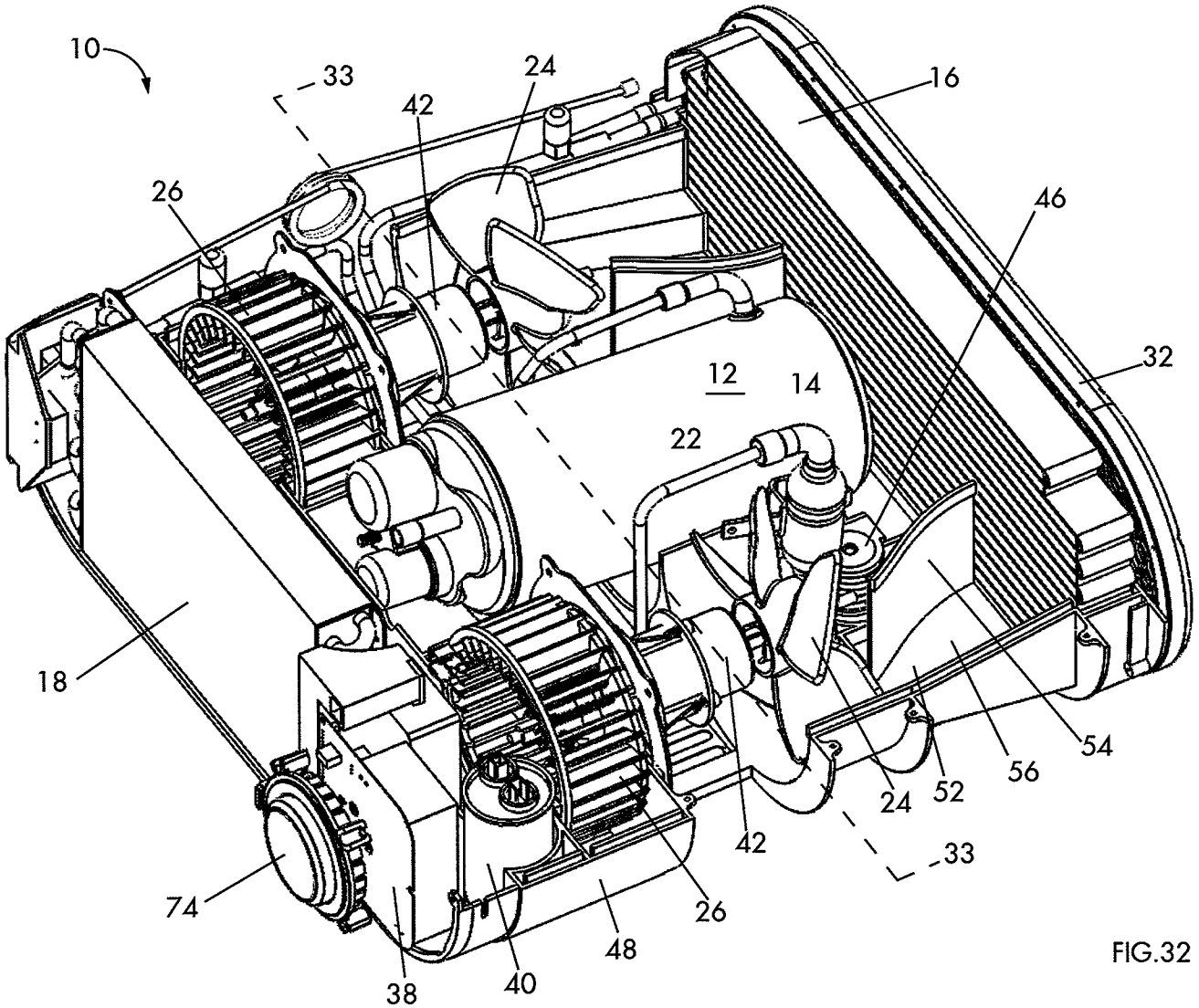
FIG. 32 illustrates the components assembled in the lower portion of the housing for the embodiment of FIG. 30.
Figure 33:
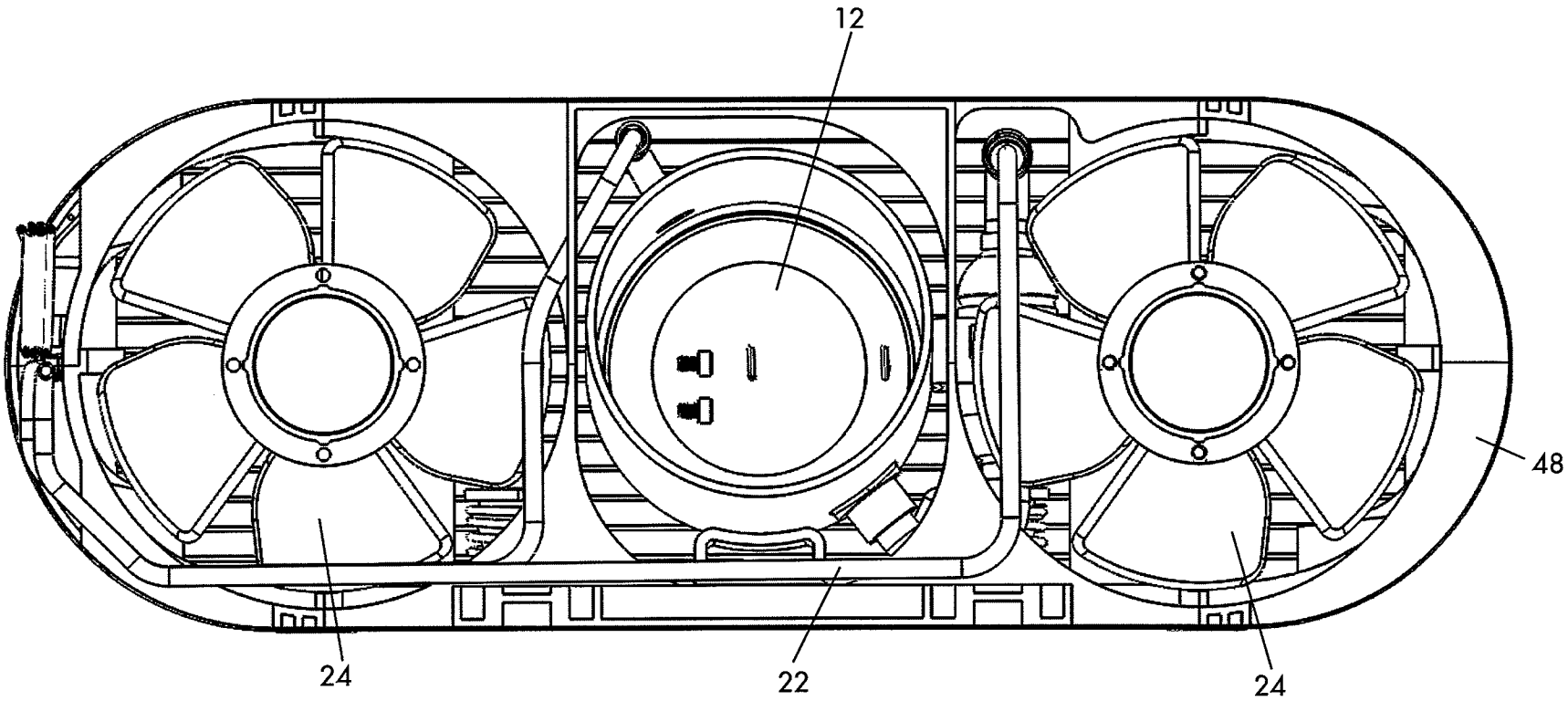
FIG. 33 is a section along 33-33 of FIG. 32.

FIG. 32 includes a view inside of the air conditioner 10 and further illustrates the piping 22 which was not previously shown. FIG. 33 is a cross-sectional view taken along line 33-33 in FIG. 32 and shows the routing of the piping 22 between the compressor 12 and the opposing heat exchangers (condenser 16 and evaporator 18) in the spaces between the condenser fans 24. Another advantage of the unique configuration of the present invention is that by placing the compressor 12 in a central location between the air movers, the gaps between the compressor 12 and condenser fans 24 can be utilized in a space-efficient manner, as shown in FIGS. 32-33. This configuration of the compressor 12 and fan assemblies allow the piping 22 to be routed in a unique manner given the space constraints within the body of the air conditioner. Specifically, as shown in FIG. 33, the present invention allows the piping 22 to occupy the space between three tangent collinear circles (i.e., the compressor and the two axial fans on either side of the compressor). When viewed from the front, as shown in FIG. 33, there is a small amount of space available between the three "circles" formed by the cross section of the axial condenser fans and the compressor, and the compressor outlet tube and the suction tube connected to the accumulator are routed through those spaces to fully take advantage of the limited available space within the air conditioner body, without requiring the form factor to change such that the overall cross sectional area of the air conditioner is not larger than the heat exchangers and the diameters of the compressors and fans being utilized. In a traditional window air conditioner, where the compressor is vertically mounted on the side of the evaporator and condenser fans, as shown in the simplified prior art assembly shown in FIG. 57, the tubing is arranged in a different area, which is not as efficient a use of space as it is in the present air conditioner.

Figure 34:
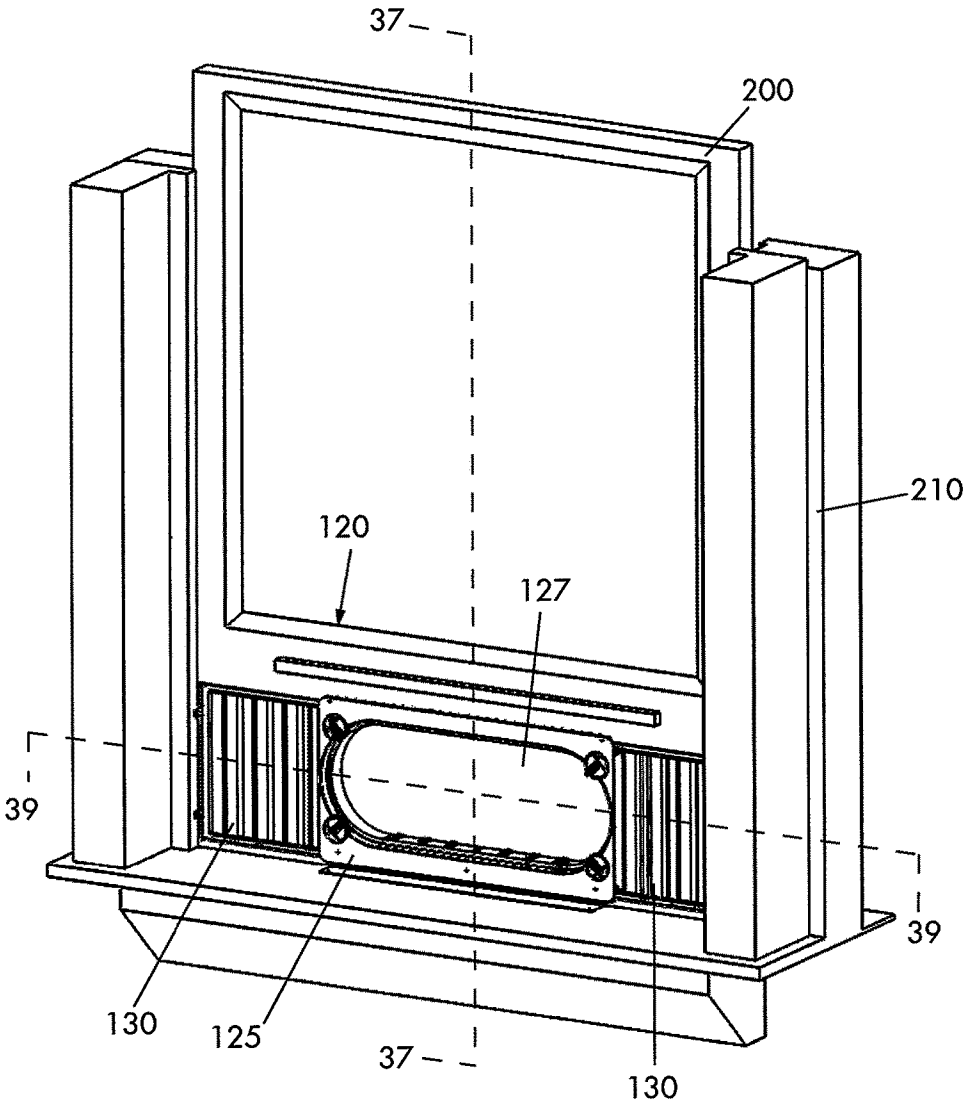
FIGS. 34-38 illustrate a preferred air conditioner mounting frame in a building structure.
Figure 35:
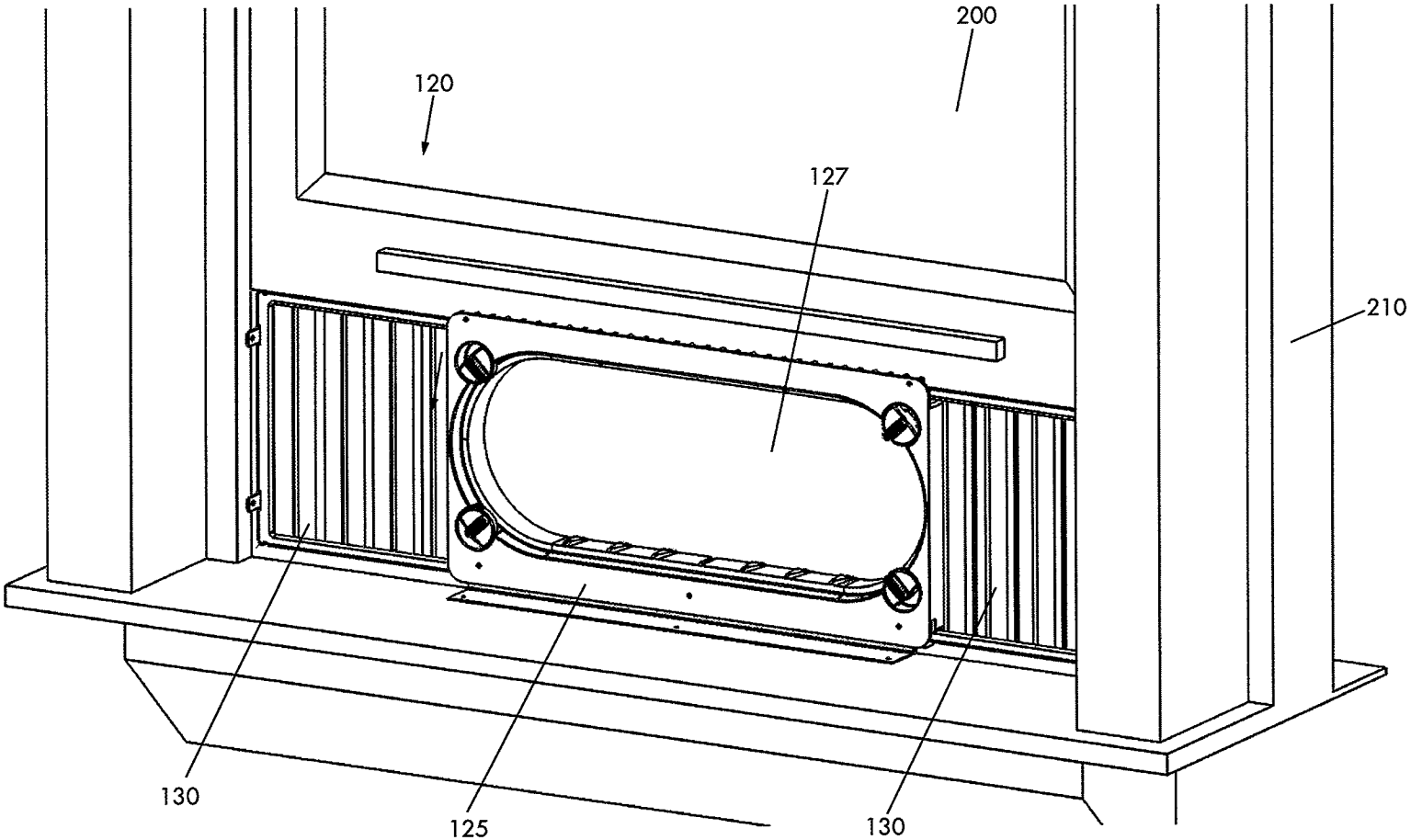
Figure 36:
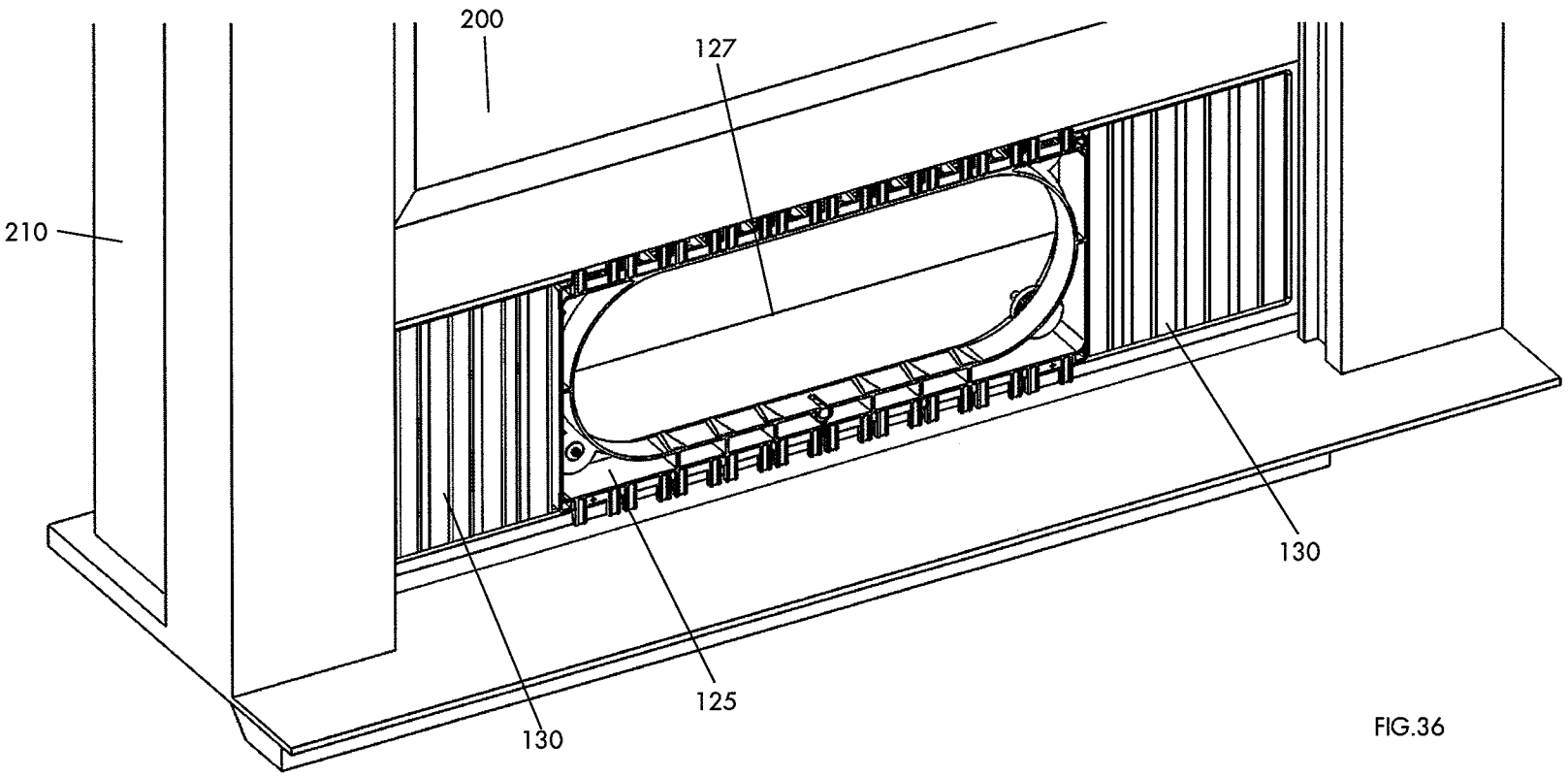

FIGS. 34-56 illustrate the various features of the mounting of the air conditioner 10 to a window frame through an installation frame 120. The preferred air conditioner installation frame 120 is a separate assembly and can be secured to the window structure before the air conditioner 10 is installed. FIGS. 34-36 illustrate the installation frame 120 positioned in a window frame 210 having a sliding window 200. The installation frame 120 includes a window frame adapter 125 having an opening 127 for receiving the air conditioner 10, and a pair of expander panels 130 which fit within the spaces between the sides of the adapter 125 and the window frame 210. FIG. 36 illustrates a rear view of the installation frame 120 and shows ribbing formed in the adapter 125 which improves the structural integrity of the design while minimizing weight and amount of material used.

The installation frame 120 can be secured to the window structure with a variety of fasteners, such as screws, bolts, clasps, latches, and the like. Furthermore, the size frame may be adjusted to fit different openings through movement of the panels 130. The panels 130 are configured with a generally flat central portion and edges that alternate between male and female configurations that function as stop positions when the panels are moved. It is generally preferred that the female portion have a slotted configuration that is open enough to slide along the flat surface of an adjoining panel but closed enough to be stopped by the male portion. The housing of the air conditioner 10 may include a retainer ridge or collar in the circumference of the housing.

During installation, the frame 120 is attached to the structural opening and the air conditioner 10 is inserted into the frame receiving aperture 127 until the retainer strap 28 engages with a corresponding retaining element in the window installation frame 125, such as a groove that corresponds to the retainer strap 28. This lets the user know that the air conditioner 10 is now in the proper position, and further helps to keep the air conditioner 10 in position while the user uses additional fasteners or fixation mechanisms to further secure the air conditioner 10 to the structure. The size of the present air conditioner 10 also contributes to the ease of installation and uninstallation, as the air conditioner 10 can be easily slid into and out of the window installation frame 120 by pushing or pulling on the handle 36. Furthermore, the significantly reduced height of the present air conditioner 10 means that less of the user's view out of the window is obstructed by the unit, thus improving the user experience overall.

Figure 37:
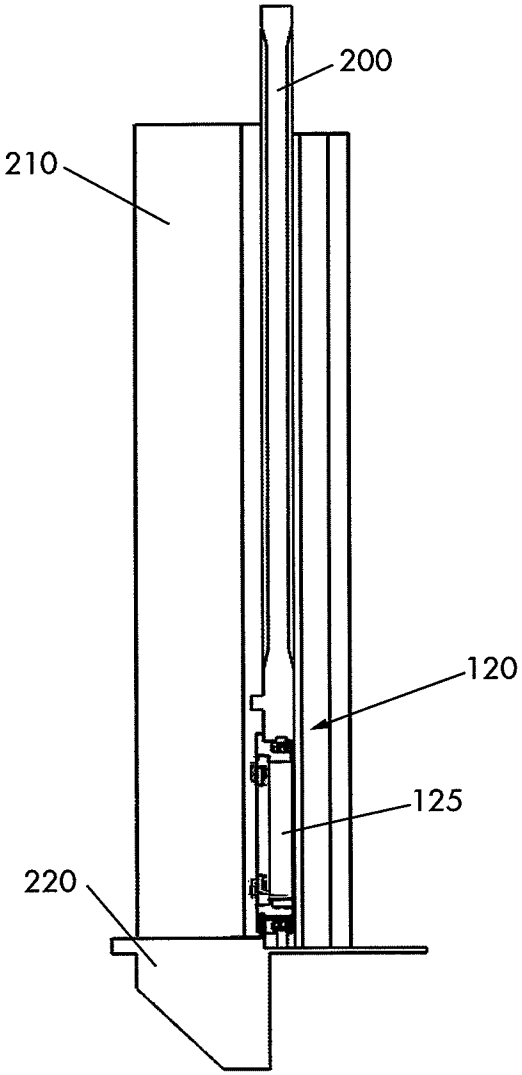
Figure 38:
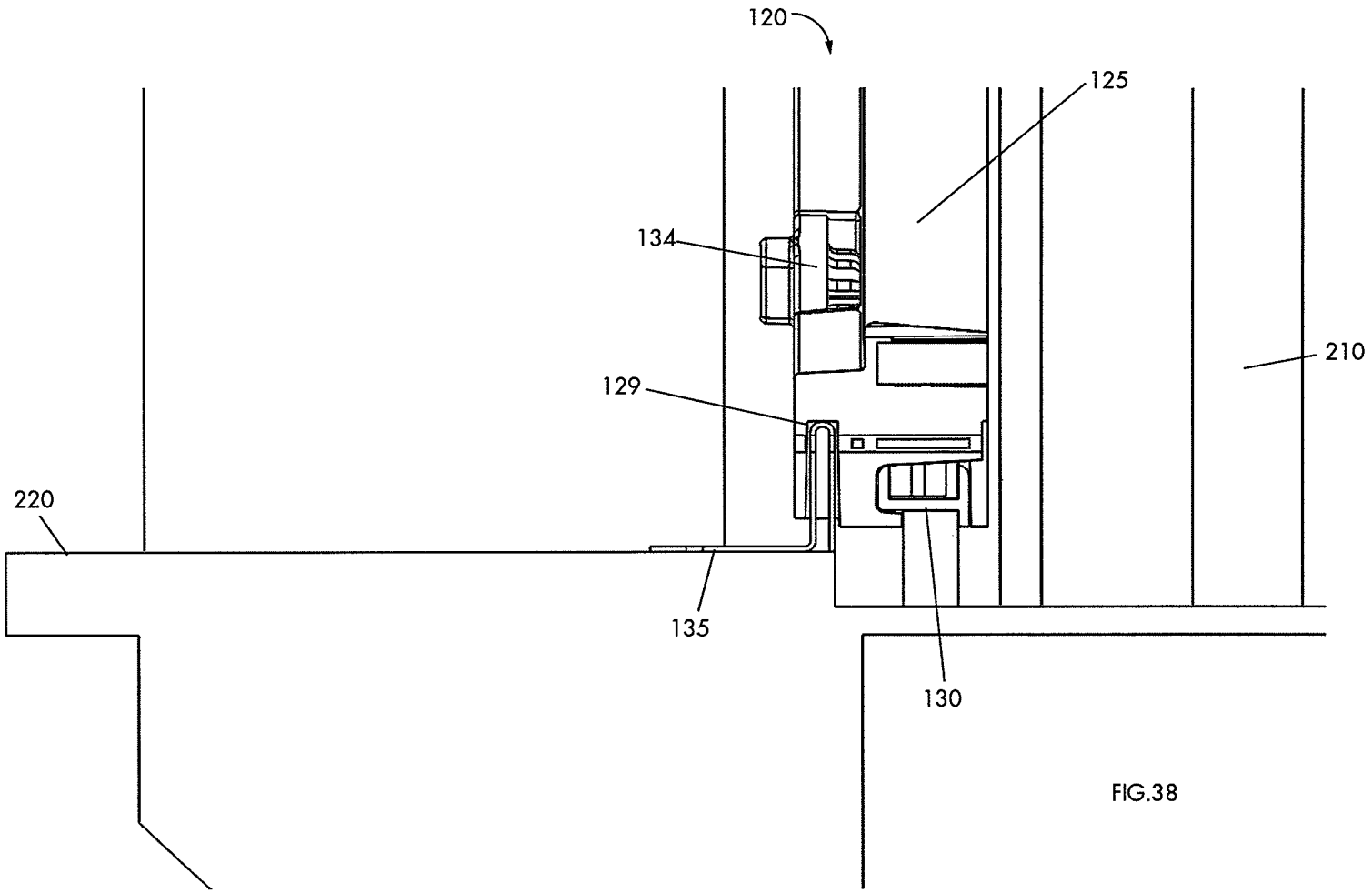

FIGS. 37 and 38 further illustrate the installation frame 120 attached to the window frame 210 including a window sill 220. FIG. 37 is a cross-sectional view taken along line 37-37 in FIG. 34. FIG. 38 is a close-up view of point of connection between the frame adapter 125 and the window sill 220. The window adapter 125 includes an attachment slot 129. The attachment slot 129 allows the installation frame 120 to be used with many different types of windows, such as vinyl windows and older wooden windows. Vinyl windows have a lip that the attachment slot 129 would rest on, so that the adapter 125 is secured in place. Older wooden windows do not have a lip and instead usually include a flat surface in this area. A separate attachment bracket 132 may be secured to the window sill 220 and the adapter 125 placed over the bracket 132 so that it is received in the attachment slot 129.

FIG. 38 also illustrates a portion of the expander panel 130 which extends into the body of the adapter body 125. In addition, FIG. 38 includes a side view of a locking mechanism 134 which engages with corresponding locking elements on the air conditioner 10 to keep the air conditioner 10 in place once installed, as will be described in more detail below.

Figure 39:
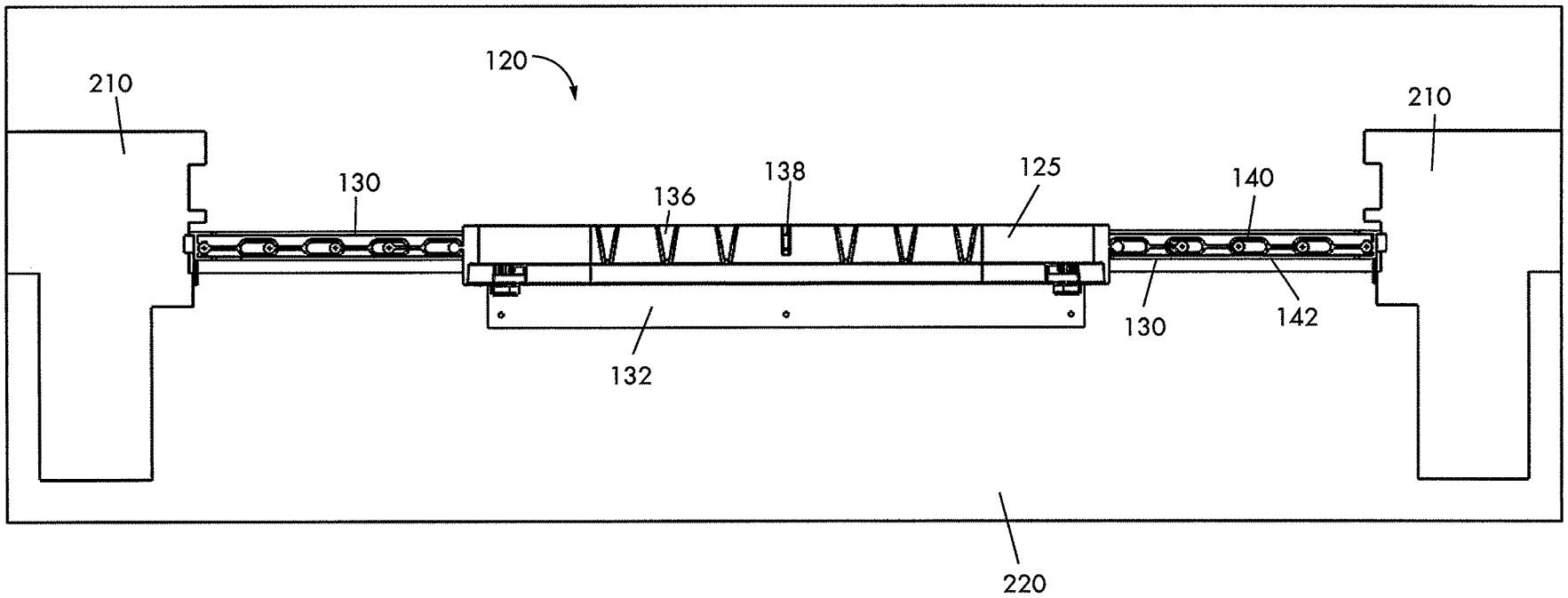
FIGS. 39-40 illustrate the preferred interconnections for the expandable portions of the preferred air conditioner mounting frame.

FIG. 39 is a cross-sectional view taken along line 39-39 of FIG. 34. The adapter 125 includes ribs 136 as previously described for improving the structural integrity. The adapter 125 may also include a level 138 (e.g., a standard bubble level) which is positioned in the bottom of the opening 127 so that the user can ensure that the adapter is level before fastening. The attachment bracket 130 is secured by screws to the window sill 220 by a fastening plate.

Figure 40:
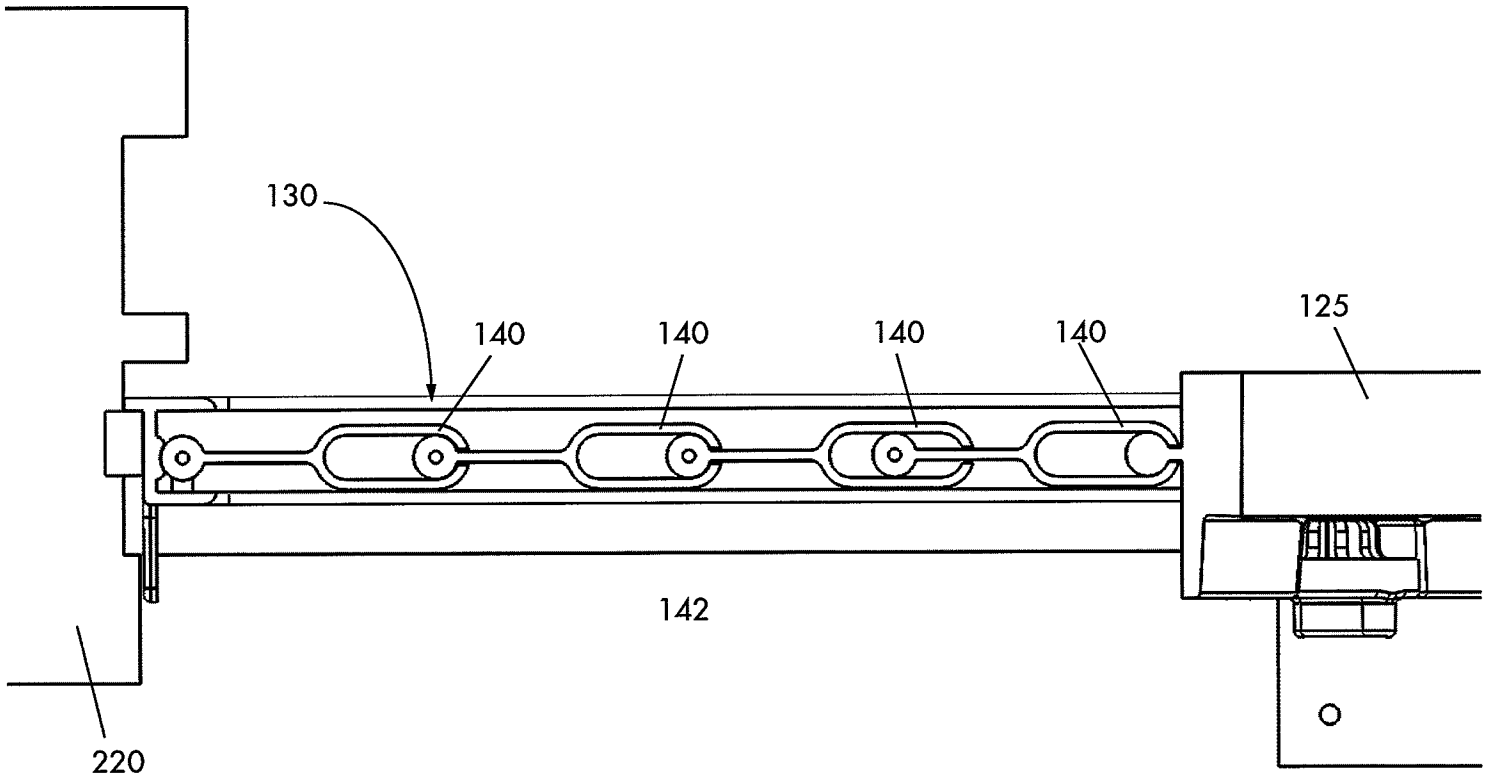

FIG. 39 also illustrates a cross-section of the expander panels 130, including expansion elements 140. FIG. 40 is a close-up view of the expansion elements 140. The expansion elements 140 include male and female parts which connect to each other and allow relative sliding. Additional elements 140 can be added to accommodate a number of window frame widths. The expander panels 130 further include expander arms 142 which removably cover the individual expansion elements 140.

Figure 41:
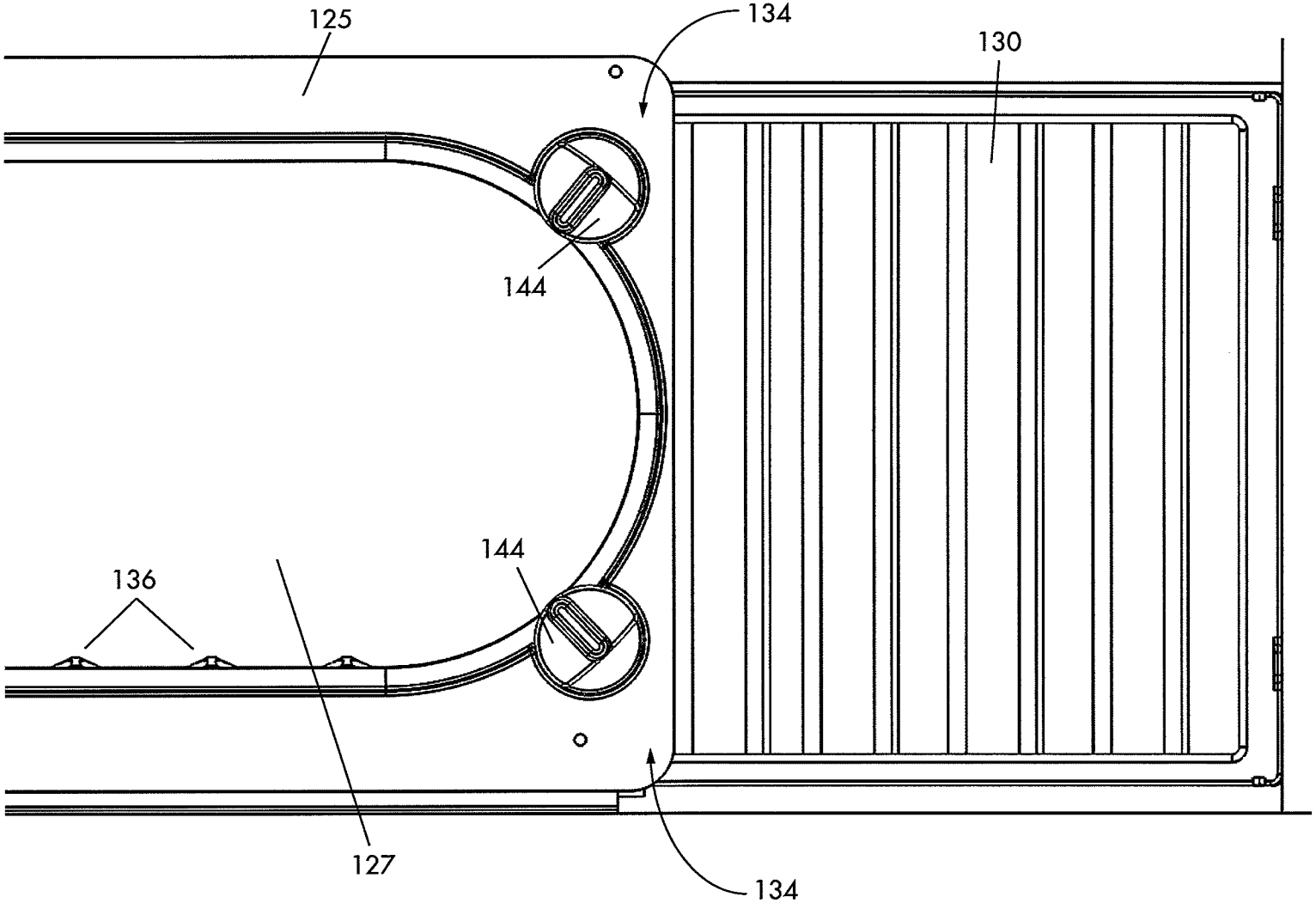
FIGS. 41-45 illustrate the features of the preferred air conditioner mounting frame for securing the frame and the air conditioner.
Figure 42:
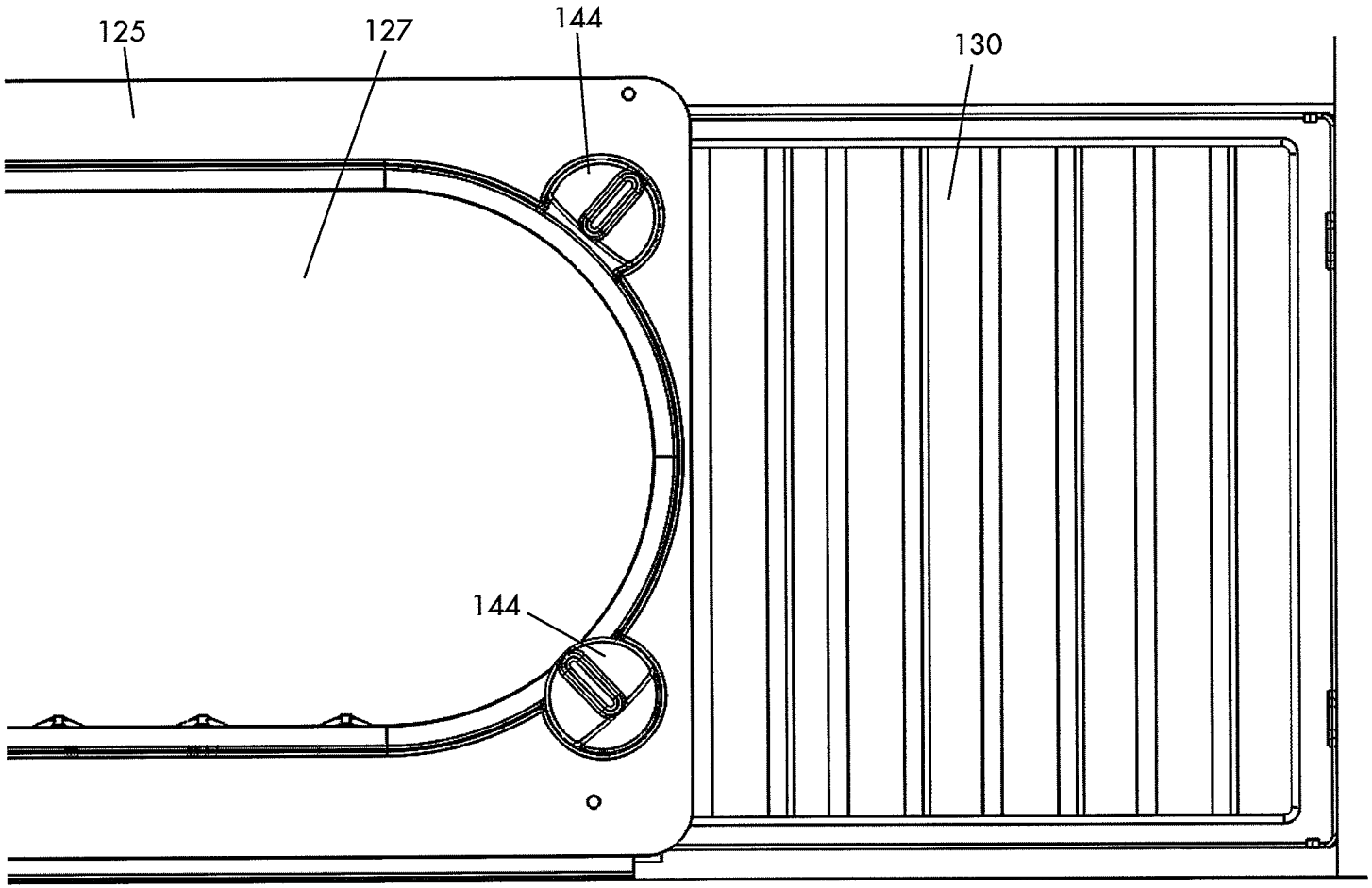

FIGS. 41-42 illustrate the locking mechanism 134 which includes locking knobs 144 positioned at the corners. The locking knobs 144 are rotatable between a locked (FIG. 41) and unlocked (FIG. 42—top right locking knob) positioned. The locking knobs 144 thereby selectively engage the retaining strap 128 to lock the air conditioner 10 in place.

Figure 43:
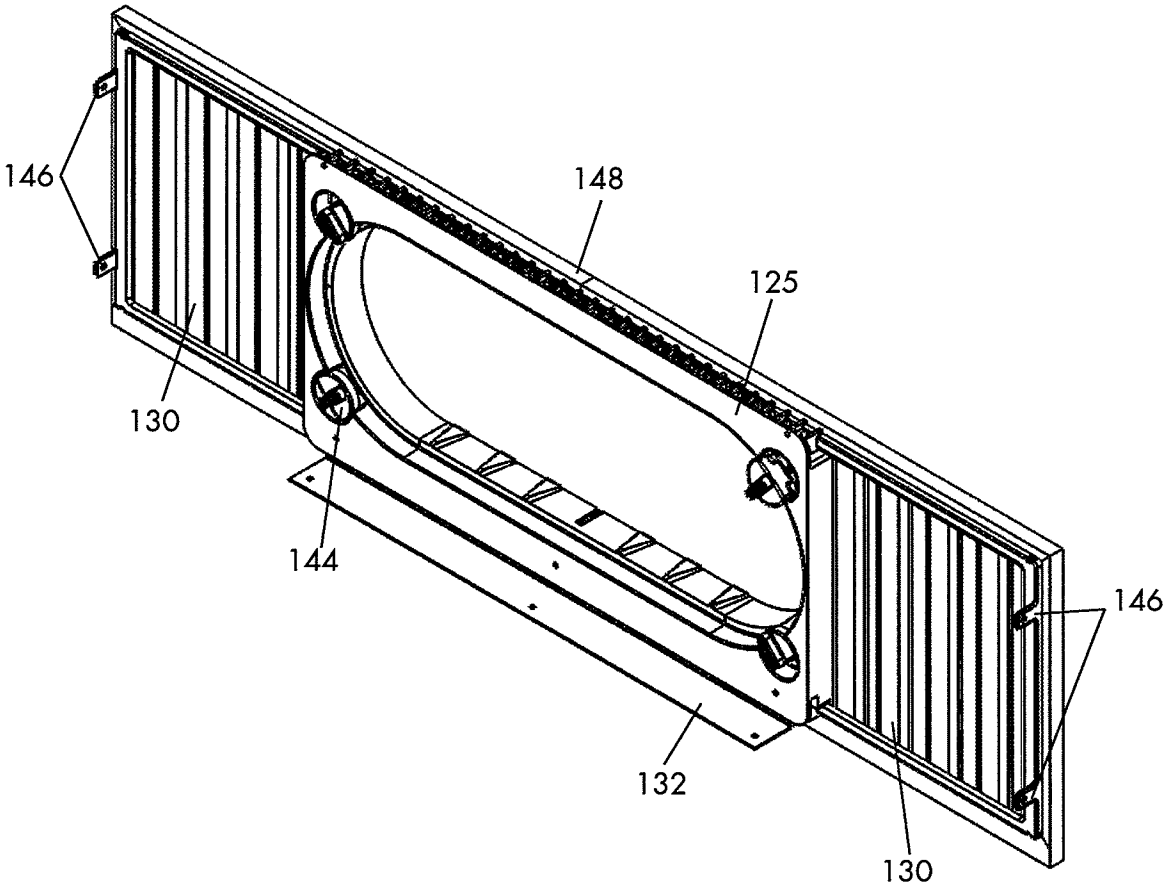
Figure 44:
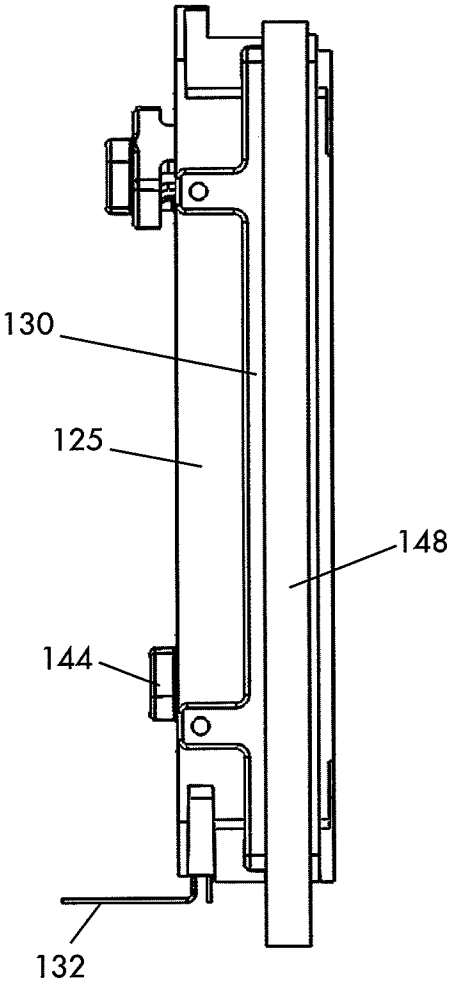

FIGS. 43-44 illustrate perspective and side views of the completed installation frame 120 not positioned in a window. The left and right expander panels have side fasteners 146 that are secured to the sides of the window frame 210 for sufficient stability of the installed assembly. In addition a strip of foam 148 extends around an outer perimeter of the overall installation frame 120. The foam 148 may be cut to size to match the width of the window when installed. Alternatively, there may be a gap in a middle section. The foam 148 helps to create a seal at the juncture between the installation frame 120 and the window.

Figure 45:
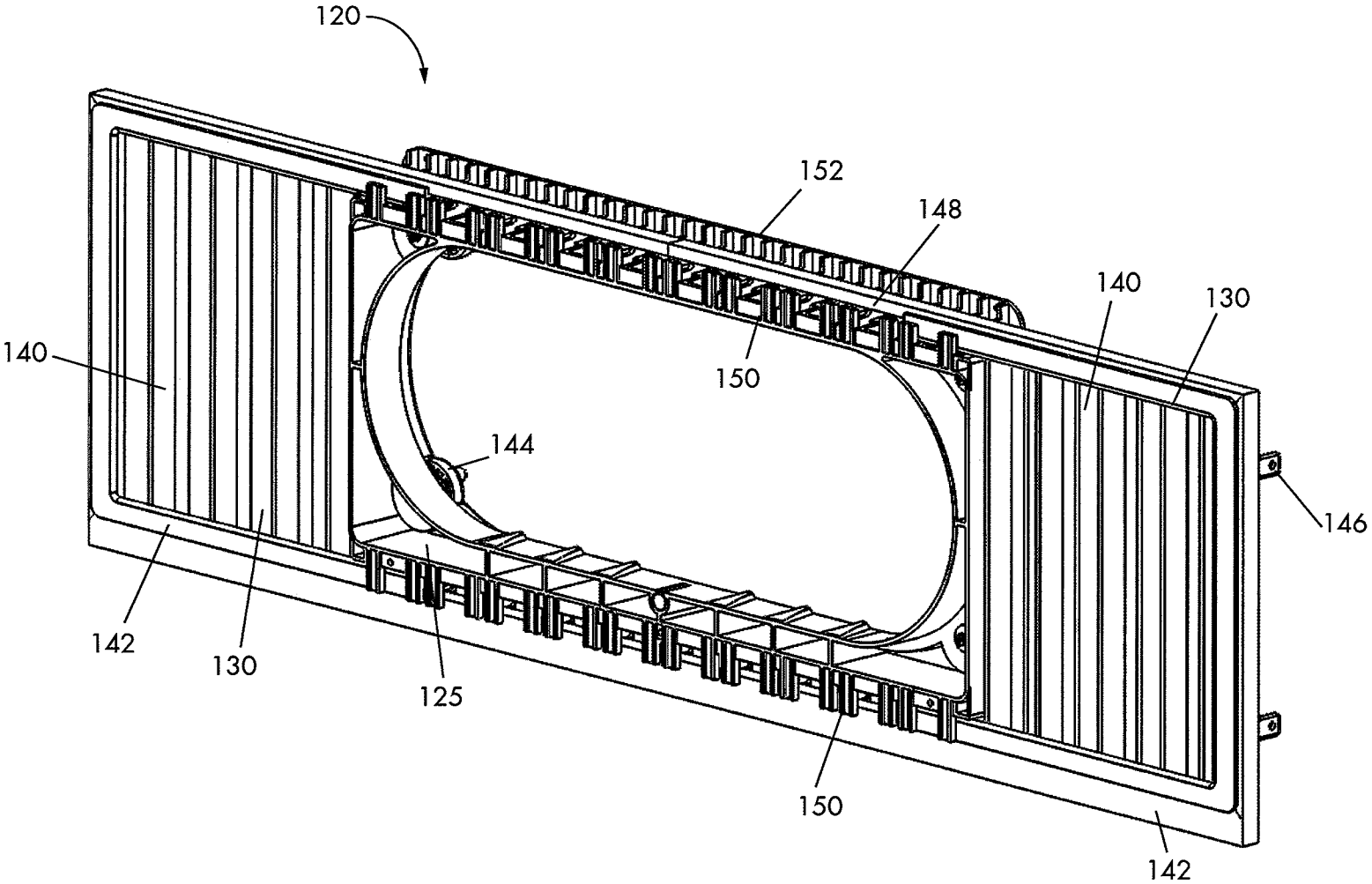
Figure 46:
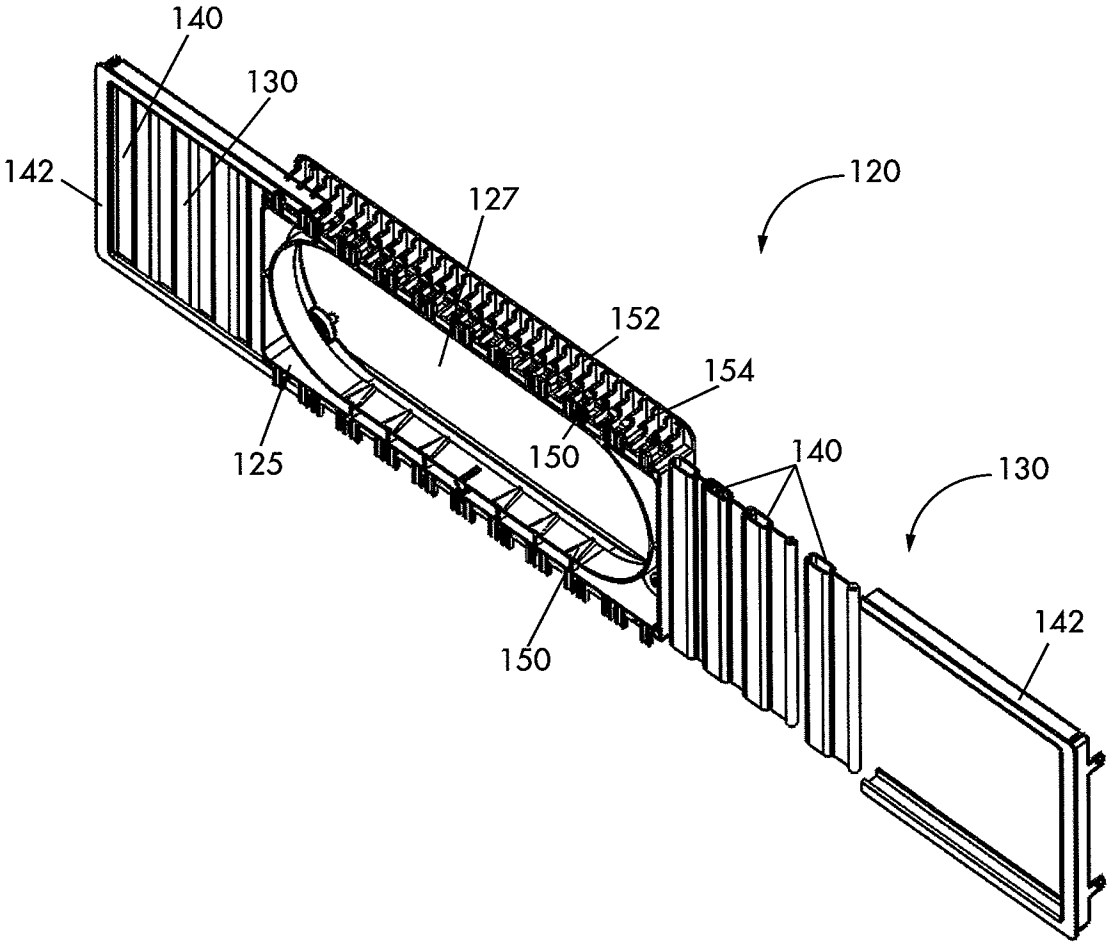
FIGS. 46-48 illustrate addition details of the preferred air conditioner mounting frame.
Figure 47:
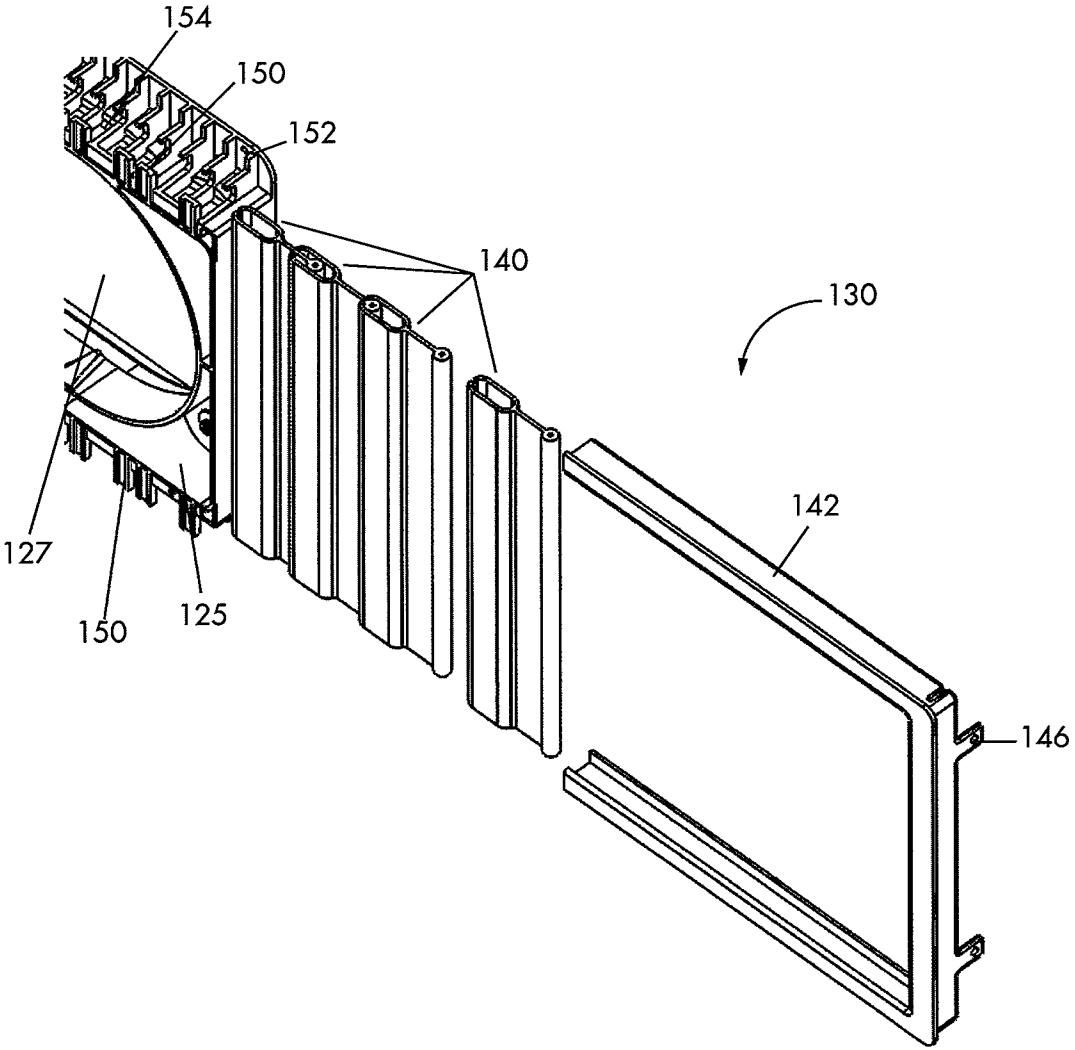
Figure 48:
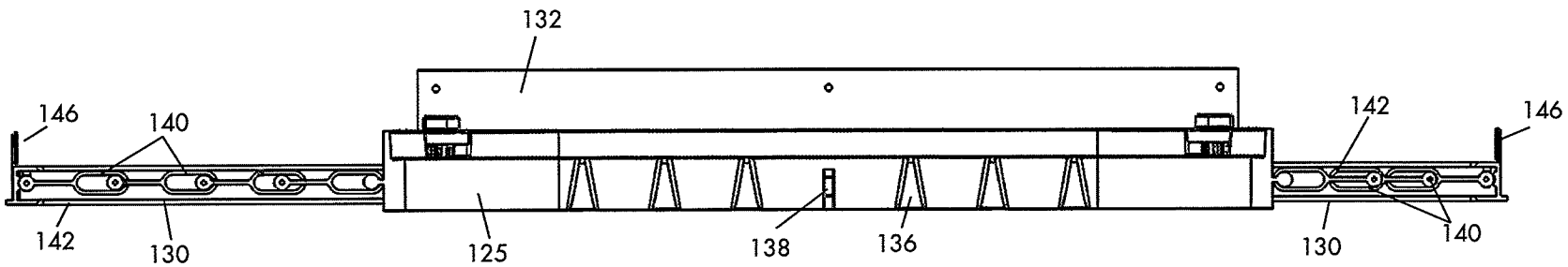
Figure 49:
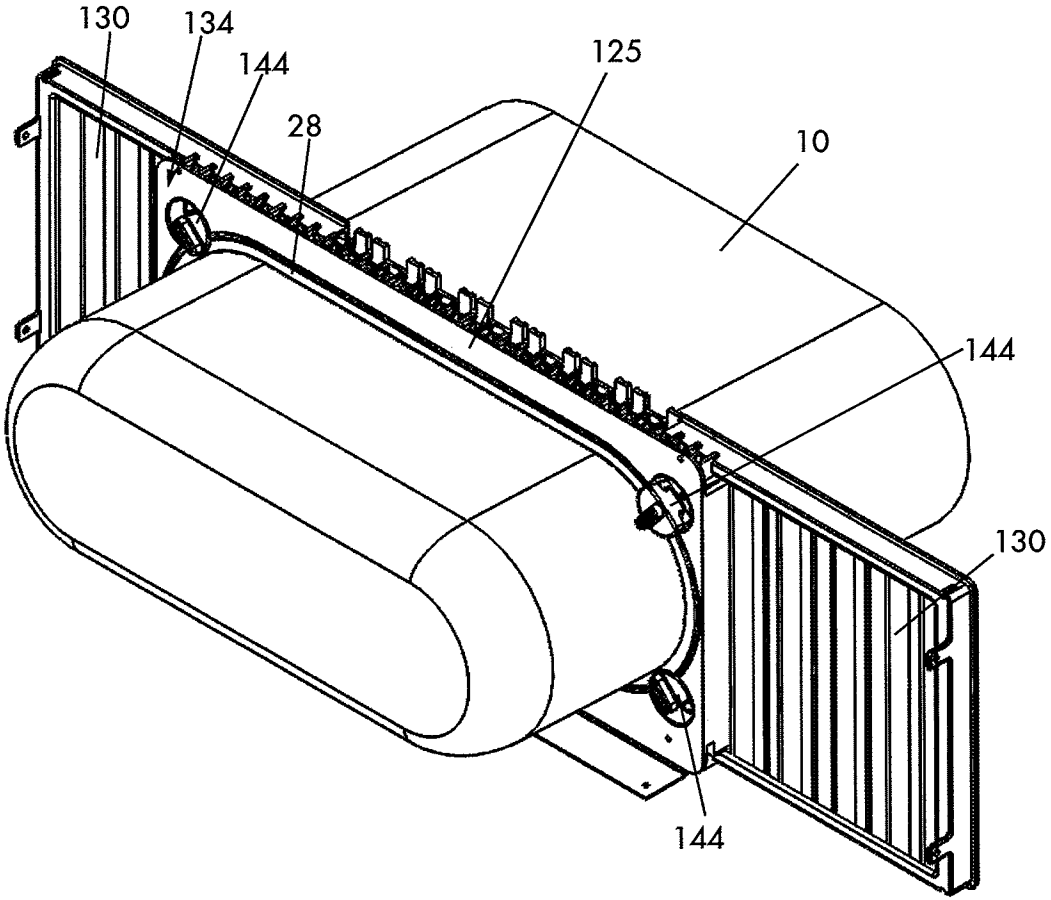
FIGS. 49-56 illustrate the assembly between the air conditioner housing and the preferred air conditioner mounting frame.

FIGS. 45-47 further illustrate the attachment of the expander panels 130 to the body of the installation adapter 125. The expander arms 142 are formed as U-shaped elements which slidably engage the adapter body 125. The adapter body 125 include opposing sets of tabs 150, 152 which create tracks for the expander arms to slide. The tabs 150, 152 also prevent the adapter foam 148 from falling out of the window during a stability test. FIGS. 46 and 47 are an exploded view and show the channel 154 which is created by the tabs 150, 152. The expander arms 142 slide longitudinally in the channel 154 to adjust the size of the expander panels 130 to fit in a window. FIG. 48 is another top cross-sectional view showing on expander panel 130 in a fully expanded position and another expander panel 130 in a fully collapsed positioned with an expansion element 140 removed.

Figure 50:
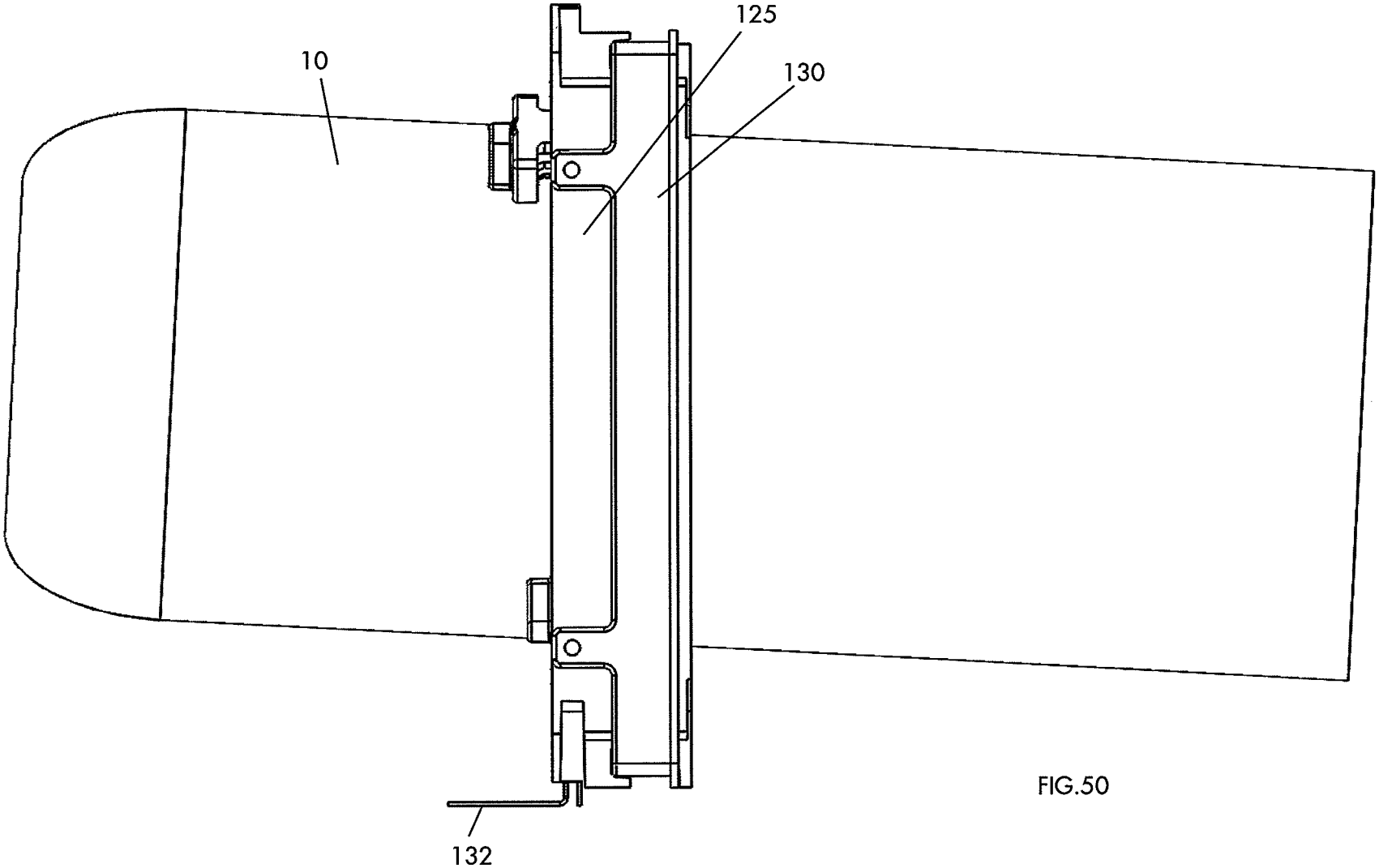
Figure 51:
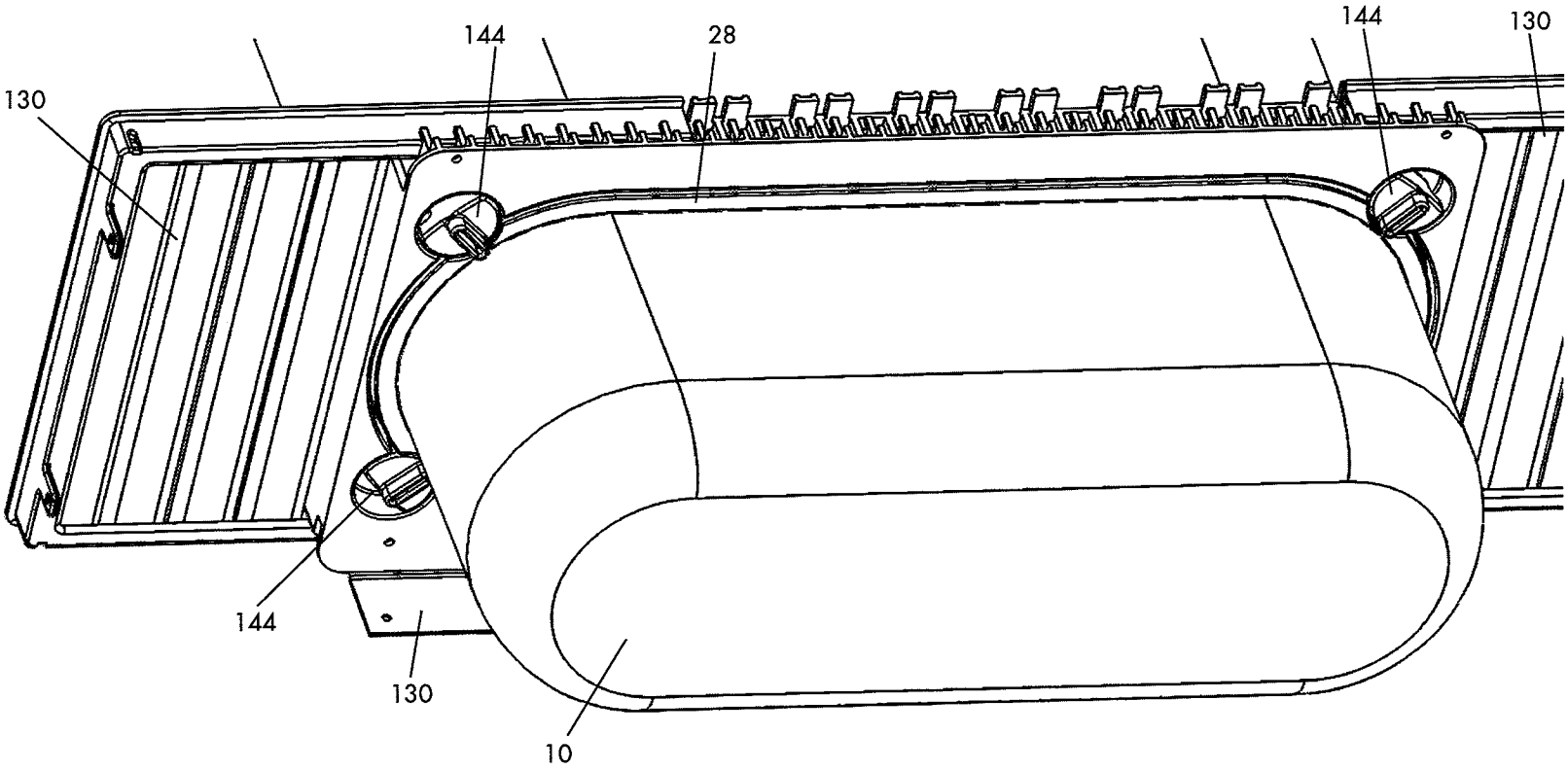
Figure 52:
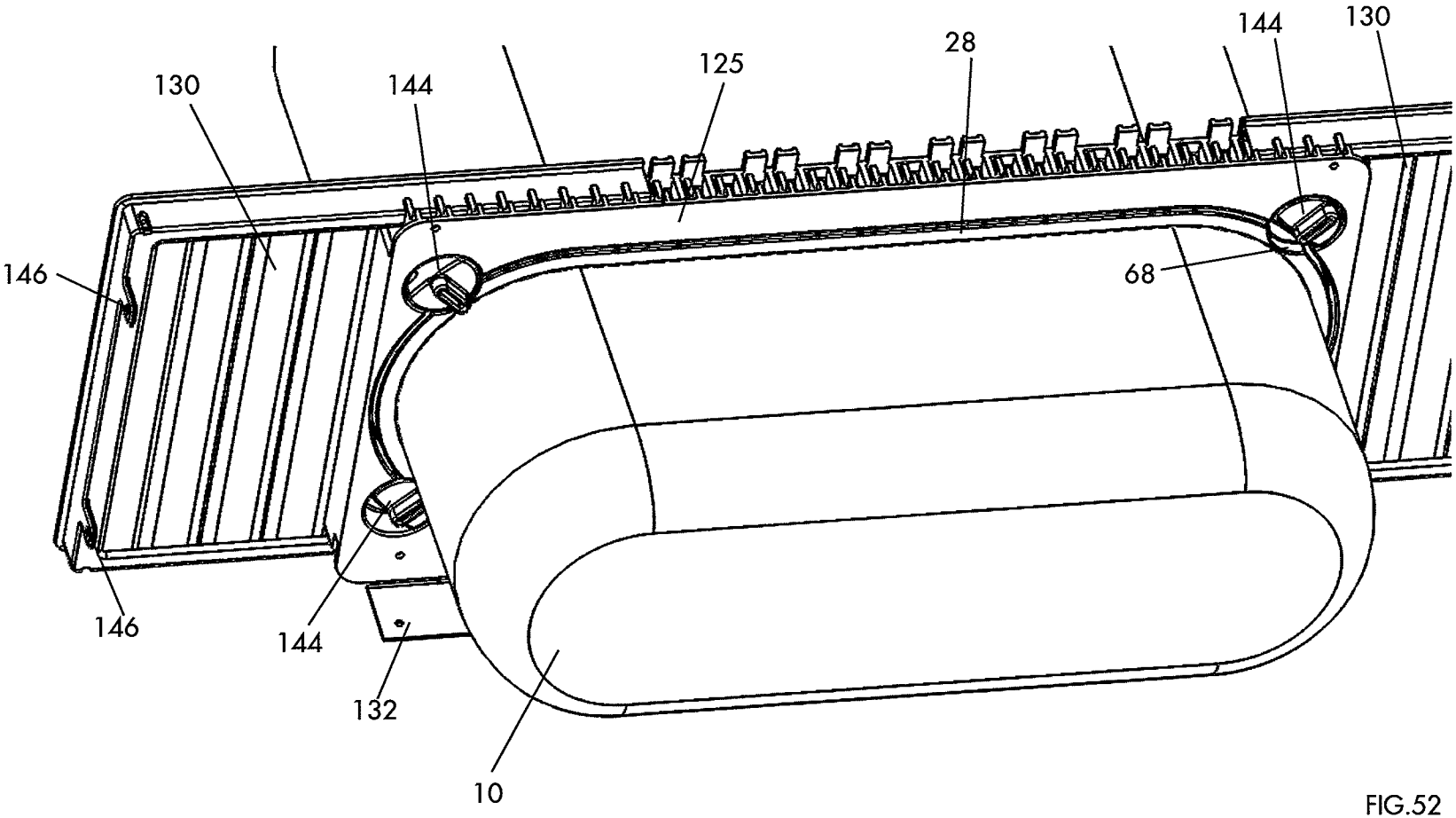
Figure 53:
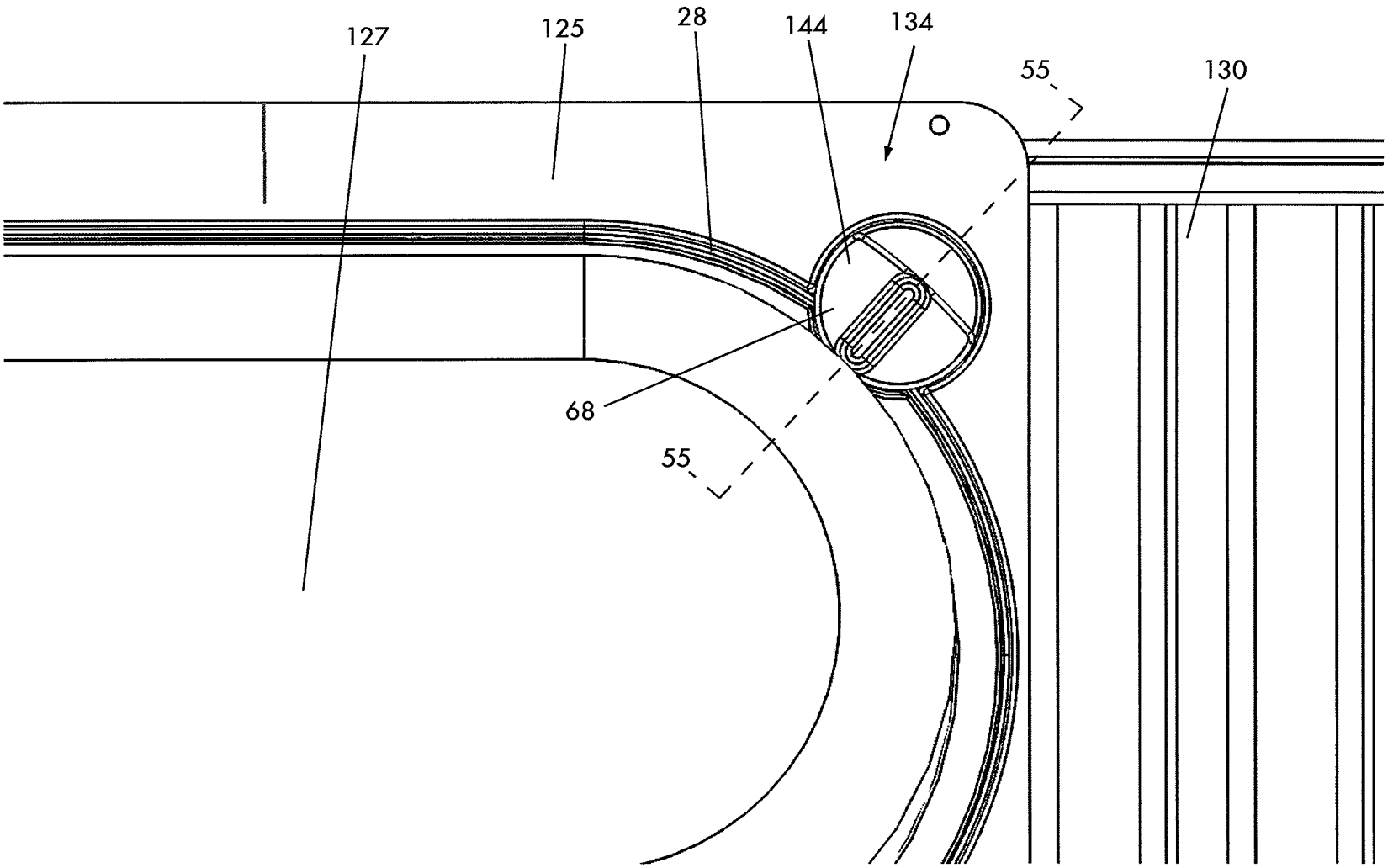
Figure 54:
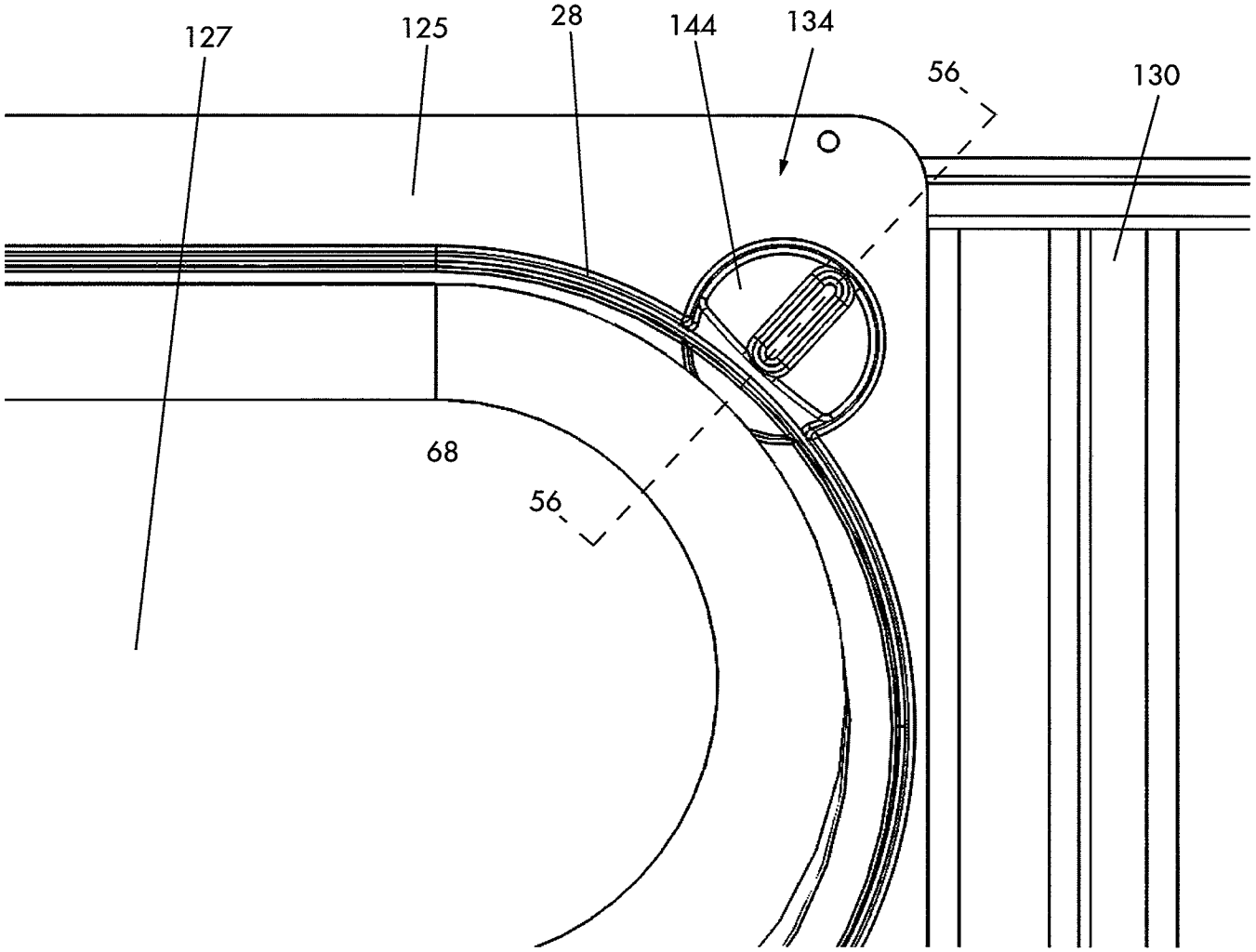

FIGS. 49-56 illustrate the air conditioner 10 installed in the installation frame 120. FIG. 50 shows how the angled retaining strap 28 causes the air conditioner to sit on an angle within the installation frame 120 so that condensation can drain outside of the window.

Figure 55:
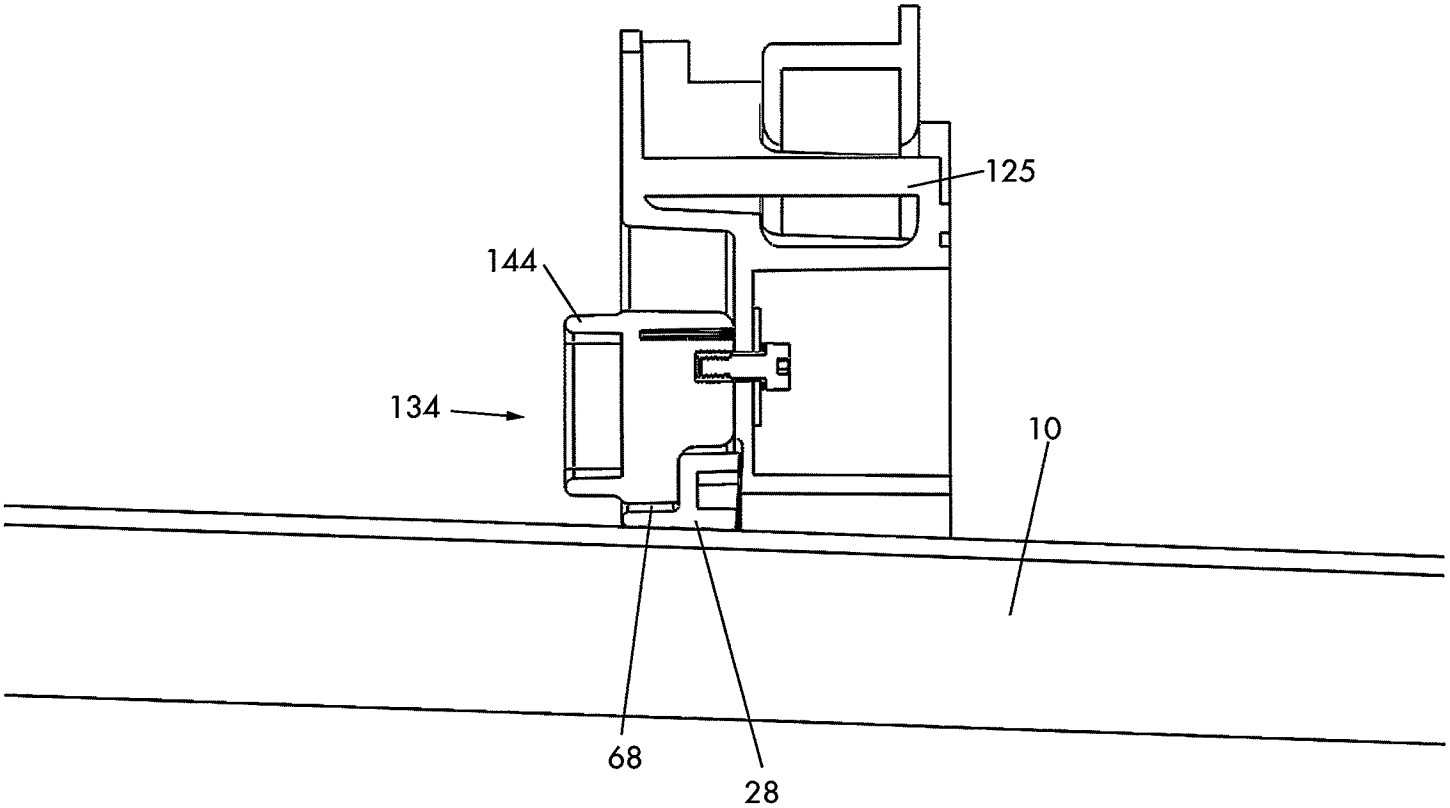
Figure 56:
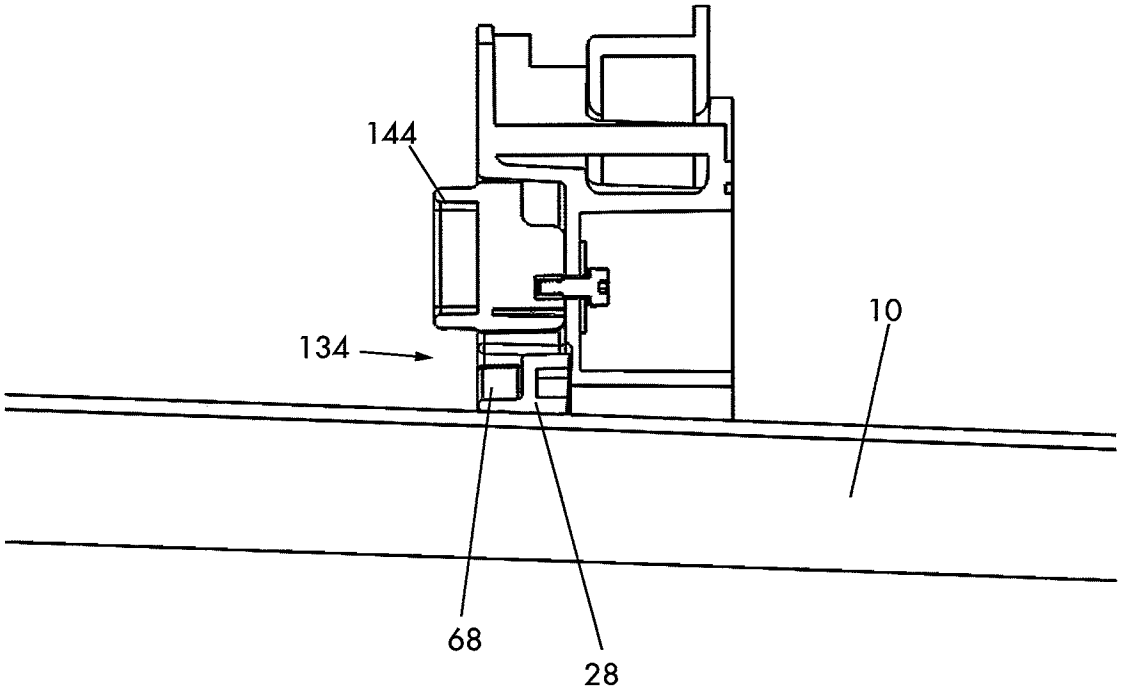

As shown, the locking knobs 144 engage in the retaining strap 28 in order to lock the air conditioner 10 to the installation frame 120. The knobs 144 rotate to selectively enter the fastening receptacles 68 formed in the retaining strap 28. FIGS. 51, 53 and 52, 54 show the locked and unlocked positions, respectively, of the upper right locking knob 144. The locking mechanism 134 inhibits the air conditioner 10 from falling out of the window, and also from being pushed into the room. FIGS. 55 and 56 include cross-sectional views of the locking knobs 144 in the locked and unlocked positions, respectively.

When the user is ready to uninstall the air conditioner, the user may simply unfasten the fasteners 134 or other fixation mechanisms securing the unit to the window installation frame, then use the handle to pull the air conditioner 10 out of the window installation frame 120 such that the retainer strap 28 is disengaged. The air conditioner 10 may then be easily transported and stored, and the window installation frame 120 is removed separately until the next installation. If the user lives in a climate that does not get extremely cold so that the loss of heat through windows is not a major concern, the user may opt to leave the air conditioner 10 installed during the colder months. Alternatively, the window installation frame 120 may include a shielding component configured to close the opening that the air conditioner usually sits in, such as an accordion mechanism, a sliding plate, or a snap on plate, which acts to close off the opening in the window installation frame. The shielding component may take different forms, and may include multiple shielding components each suited to different climates and weathers. For example and without limitation, the shielding component may include a screen for the warmer months when no air conditioner is required, but the outside ambient air is still a comfortable temperature, so that fresh air can enter the interior through the screen. Alternatively, the shielding component may be made out of a material having thermal insulation properties, such that during the colder months heat inside of the room is not lost significantly through the window installation frame to the outside. This would eliminate the need for a user to install and uninstall the window installation frame 120 every year when air conditioner 10 is required, but instead a single installation that remains in place during the year. With current known window air conditioners, many users elect to keep the unit installed year-round due to the complexity and difficulty of the installation and uninstallation process, which results in the view from the window being obstructed year-round and significant heat loss during the colder months through the air conditioner unit and the gaps between the unit and the window frame. The present air conditioner and window installation frame addresses this problem by ensuring that installation and uninstallation is a painless and uncomplicated process, and by providing the user with a way to keep the window installation frame in place without resulting in significant heat loss.

The electrical control system and user control interface were generally described above. By way of example and without any limitation, the user control interface may include a display component, such as the display screens built into the knobs of the control interface to display relevant information to the user regarding operation of the air conditioner and the available settings. Using the control interface, a user may make selections regarding powering the air conditioner speed settings, set the desired temperature to be maintained by the air conditioner, set a timer for the air conditioner, along with other applicable settings. The electrical control system or control interface may also have wireless connectivity so that it can be associated with the user's local wireless network, and may be configured to communicate with computing or mobile devices, such as smartphones. For example and without limitation, the present air conditioner may be controlled by a user using an application on the user's mobile phone, such as a smart phone, so the user can adjust the settings of the air conditioner remotely from a different room or even when away from the home. If the user leaves the home and forgets to turn off the AC or adjust it to maintain a higher temperature, the user can do so using the mobile device that communicates with the air conditioner. Similarly, if the user is returning home and wants to turn the air conditioner to begin cooling the house before the user arrives, the user can do so by adjusting the temperature through the user's mobile device. The electrical control system or user interface of the present air conditioner may further be configured to communicate with the user's power company or another third party, provided that the user has given the requisite consent, to share information regarding the user's use and interaction with the air conditioner, such as energy use, preferred temperature, normal operation hours and settings, etc. This can help power companies or other third-party companies analyze various users' AC usage, track usage trends, monitor power availability, and provide the user with feedback regarding their AC usage. In addition, power companies may obtain the user's consent to automatically reduce the user's power usage during high demand periods such as on very hot summer days, such as by giving the power company control to adjust the temperature of the air conditioner within a given range. In exchange, the power company may reward the user with credits towards the user's energy bill, or in the form of rebate checks or payments in a cryptocurrency such as Bitcoin. The electrical control system or user control interface may further be in communication with other electronic systems in the user's home, such as a home control system or a wireless compatible thermostat, so that the air conditioner can be controlled by the user through those systems as well as the control interface on the unit itself.

The air conditioner may include one or more sensors in communication with the electrical control system to measure various parameters and performance, including without limitation temperature, humidity, occupancy, pressure, and gases such as carbon dioxide or monoxide. For example, a temperature sensor may be located towards the front portion of the housing to measure the temperature within the interior of the room, so that the air conditioner can automatically shut off or adjust fan speed once it approaches or reaches a desired temperature. Although known air conditioners often have temperature sensors, those sensors generally measure the air temperature directly on the air conditioner itself or right in front of the air conditioner, where the temperature is the coldest because of the proximity to the exiting cold air, resulting in the air conditioner stopping cooling before the rest of the room reaches the user's desired temperature. To address this problem, the present air conditioner may include an infrared sensor that measures the air temperature at a location that is some distance away from the air conditioner, such as the temperature of an opposite wall in the room. This tends to ensure that the air conditioner does not decrease cooling or turn off before the room reaches the desired temperature. Furthermore, the present air conditioner may include an exterior temperature sensor, located on the back portion of the housing, to measure the temperature of the external air. The exterior temperature sensor is preferably configured to also measure the temperature at some distance away from the air conditioner, as the hot air exiting vent may skew the readings. By using both interior and exterior temperature sensors, the electrical control system may record and analyze these temperatures to identify trends and predict periods during which cooling is most desired and the amount of time needed to reach the preferred temperature. This information could be provided to a via the user control interface or through an online dashboard or smartphone application. With this information, a user can be educated about optimal settings for the air conditioner, energy consumption, and may further be guided to allow the electrical control system to operate based on interior and exterior temperature readings and temperature trends. For example, if the past temperature readings enable the electrical control system to know the predicted temperature profile during a hot summer day, the electrical control system can begin cooling before the outside temperature rapidly raises during the day so that less time and energy is required. Likewise, the electrical control system can automatically sense that the outside temperature is dropping and automatically adjust the fan speed and cooling settings to conserve energy.

In addition to the advantages discussed above, the space efficiency of the present air conditioner housing allows the overall weight of the system to be distributed more evenly, which is desirable when the air conditioner is shipped, stocked, or moved, as well as when it is handled by an installer. In addition, known air conditioners, particularly window air conditioner, are often very unbalanced because the compressor is usually the heaviest component (approximately 60% of the unit's weight). Because the present compressor is located more centrally than know air conditioner, the weight is more evenly distributed, which is a particular advantage with window air conditioners. The space efficient housing of the present invention also locates the components to direct air movement along specific paths and minimize unused space with in the housing.

With respect to window air conditioners, the mounting frame and housing also provide locates for the placement of securing members, such as straps or plastic ties, to secure the housing to the frame which, in turn, secured to the structure in which the air conditioner is mounted. Additionally, the handle, FIG. 15, in the front of the housing, substantially at the center of the gravity, allows an installer to easily carry, lift, and locate the air conditioner.

One of ordinary skill in the art would appreciate that various aesthetic changes may be made to the present air conditioner without departing from the inventive features and components discussed herein.

Although the preferred configuration of the window air conditioner in the present application has been described with the compressor being arranged along a direction that is perpendicular to the direction along which the bodies of the evaporator and condenser extend, FIGS. 58-62 illustrate the same efficiencies and advantages described above by reconfiguring the components such that the compressor is rotated 90 degrees to extend along the same direction that the bodies of the evaporator and condensers extend. Furthermore, while the evaporator and condenser fan assemblies have been described with each set of evaporator and condenser fans being driven by a single motor, so that only two motors are utilized in the window air conditioner, different combinations of numbers of fans and motors may be utilized to achieve the same function. For example and without limitation, each fan may be driven by an individual motor, so that four separate motors are utilized. While this would increase the number of components and overall cost and weight of the window air conditioner, it presents advantages in that each fan can be individually optimized to operate at different speeds, in order to maximize the airflow through each heat exchanger. As a further example, the two centrifugal evaporator fans may be driven by a single motor, while the two axial condenser fans may each be driven by an individual motor, so that three total motors are used to drive a total of four fans. In addition, the direction along which the centrifugal fans and axial fans rotate may be reconfigured without departing from the spirit of the present application. In the embodiment described above, each set of centrifugal and axial fans are driven by a single motor along a rotational axis that is substantially parallel to the direction that the compressor is arranged. Given this arrangement, the centrifugal and axial fan of each set rotates in the same direction about the same rotational axis. However, in alternate embodiments where the centrifugal fans are each driven by its own motor, or are driven by the same motor separate from the axial fans, the centrifugal fans may be arranged so that they rotate around a different axis, that is substantial perpendicular to the axis of rotation of the axial fans.

Figure 58:
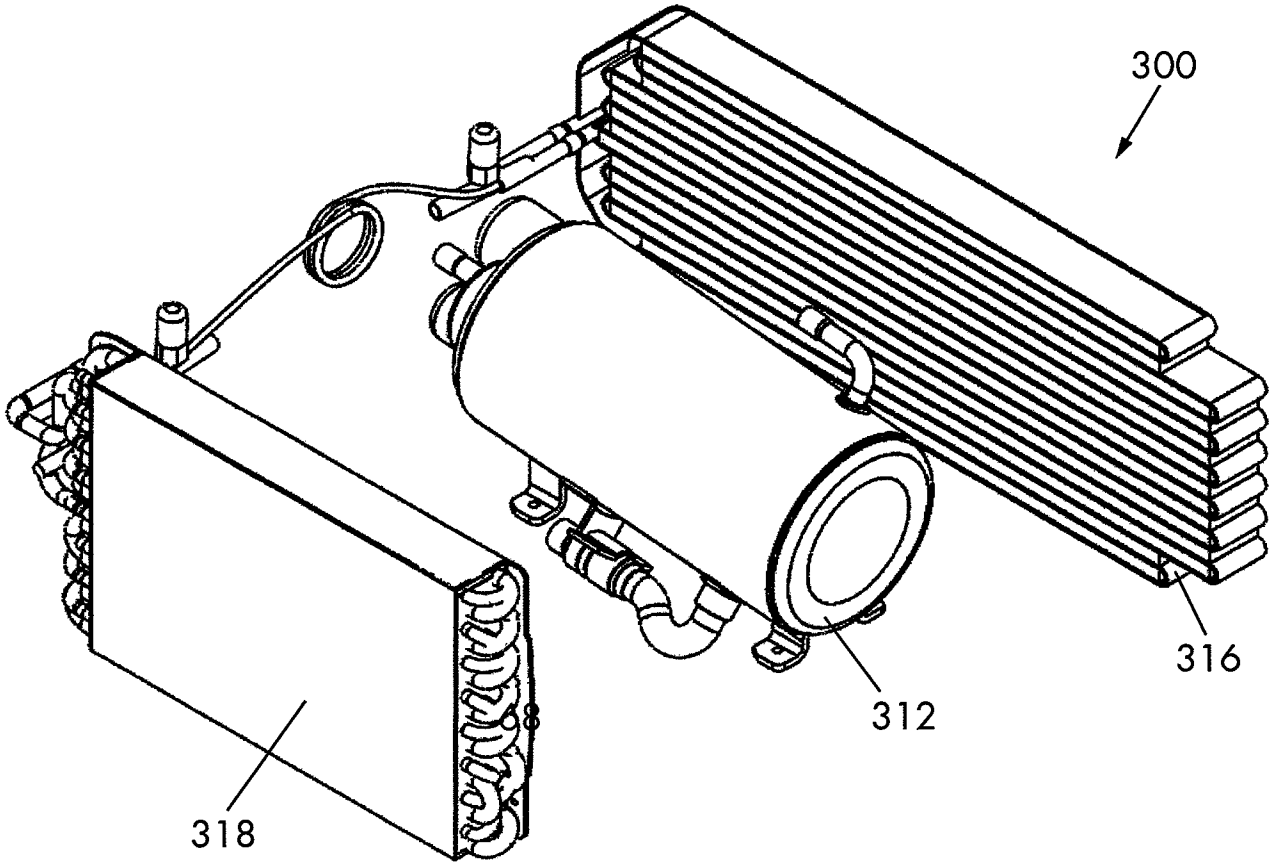
Figure 59:
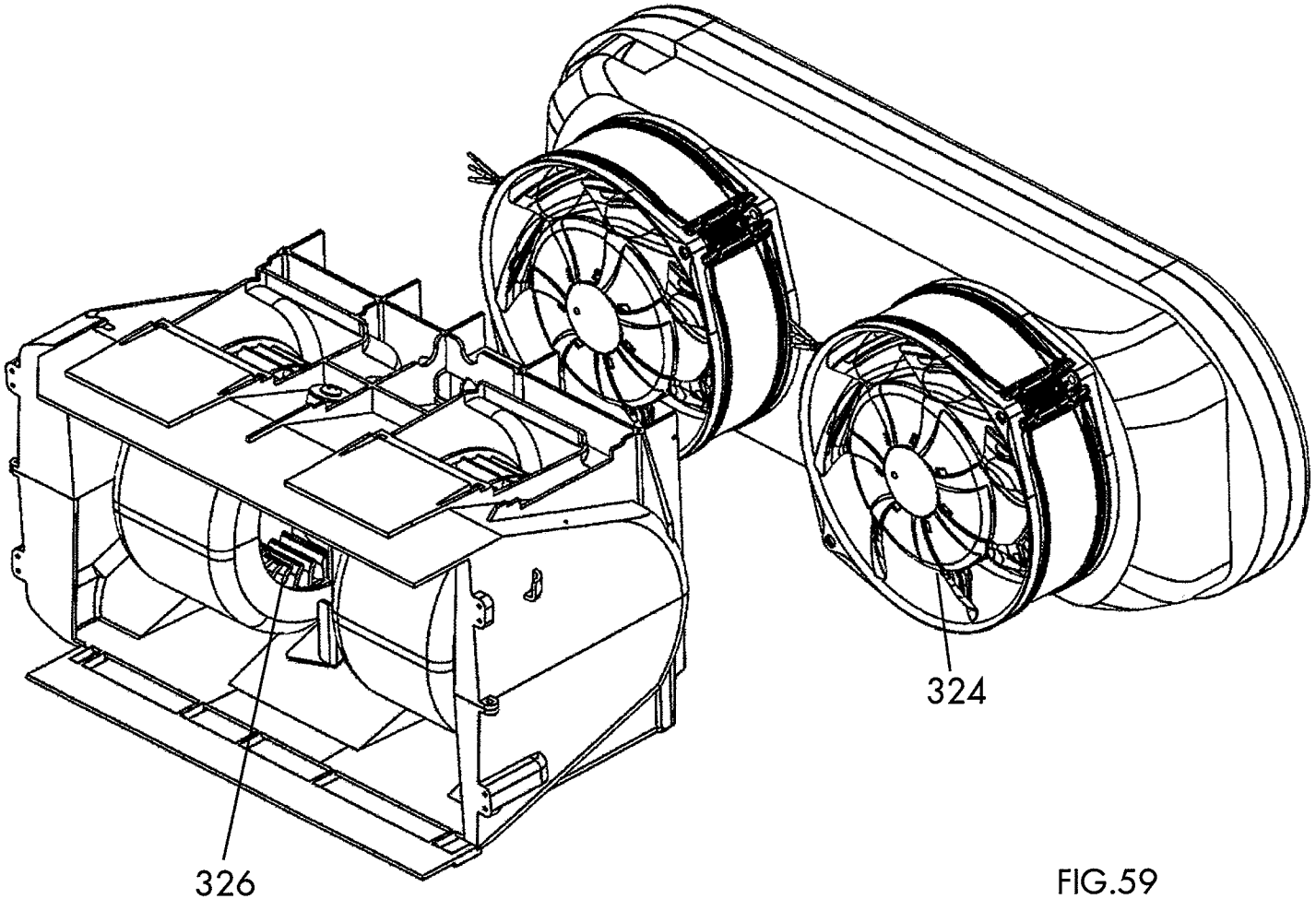
Figure 60:
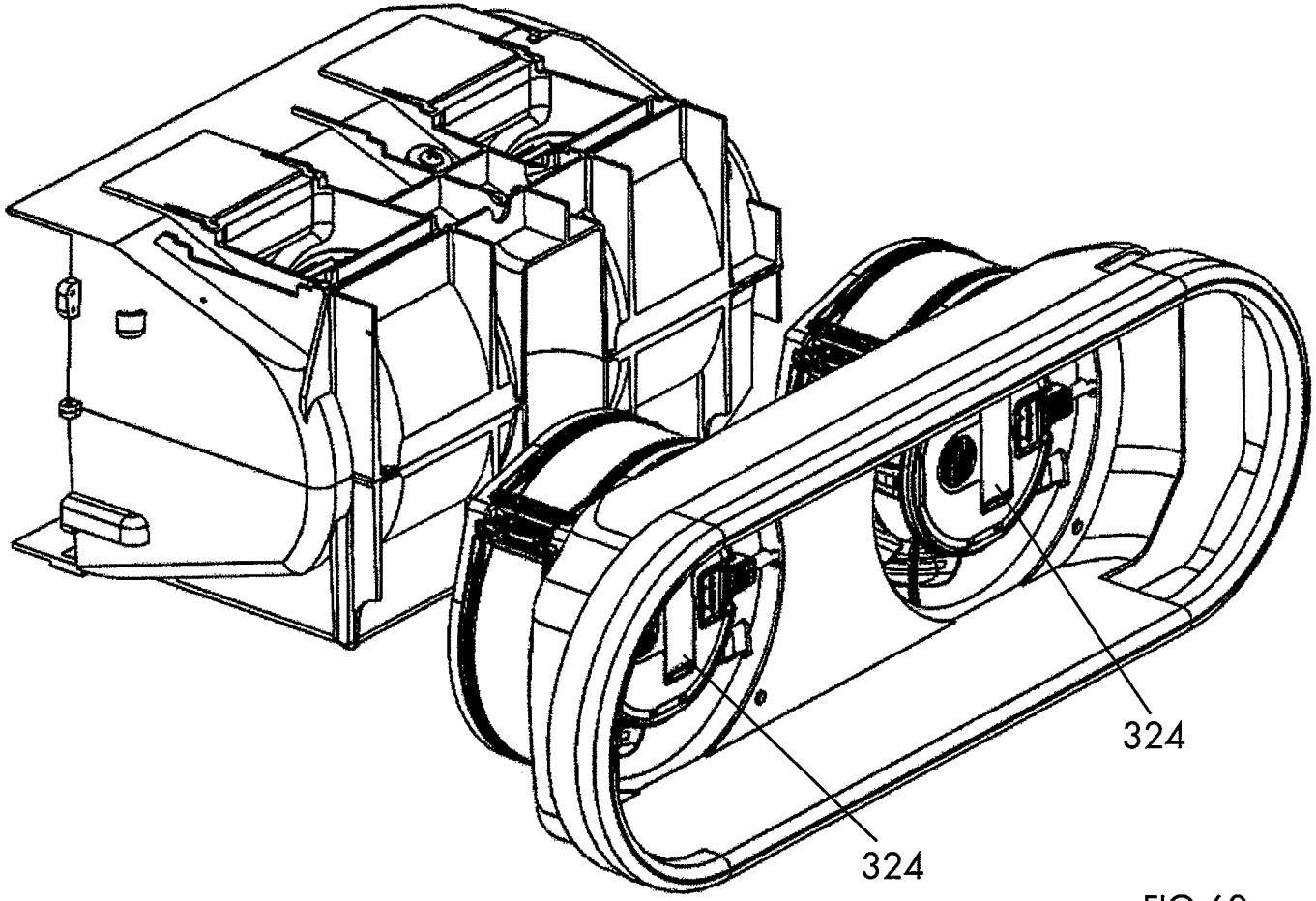
Figure 61:
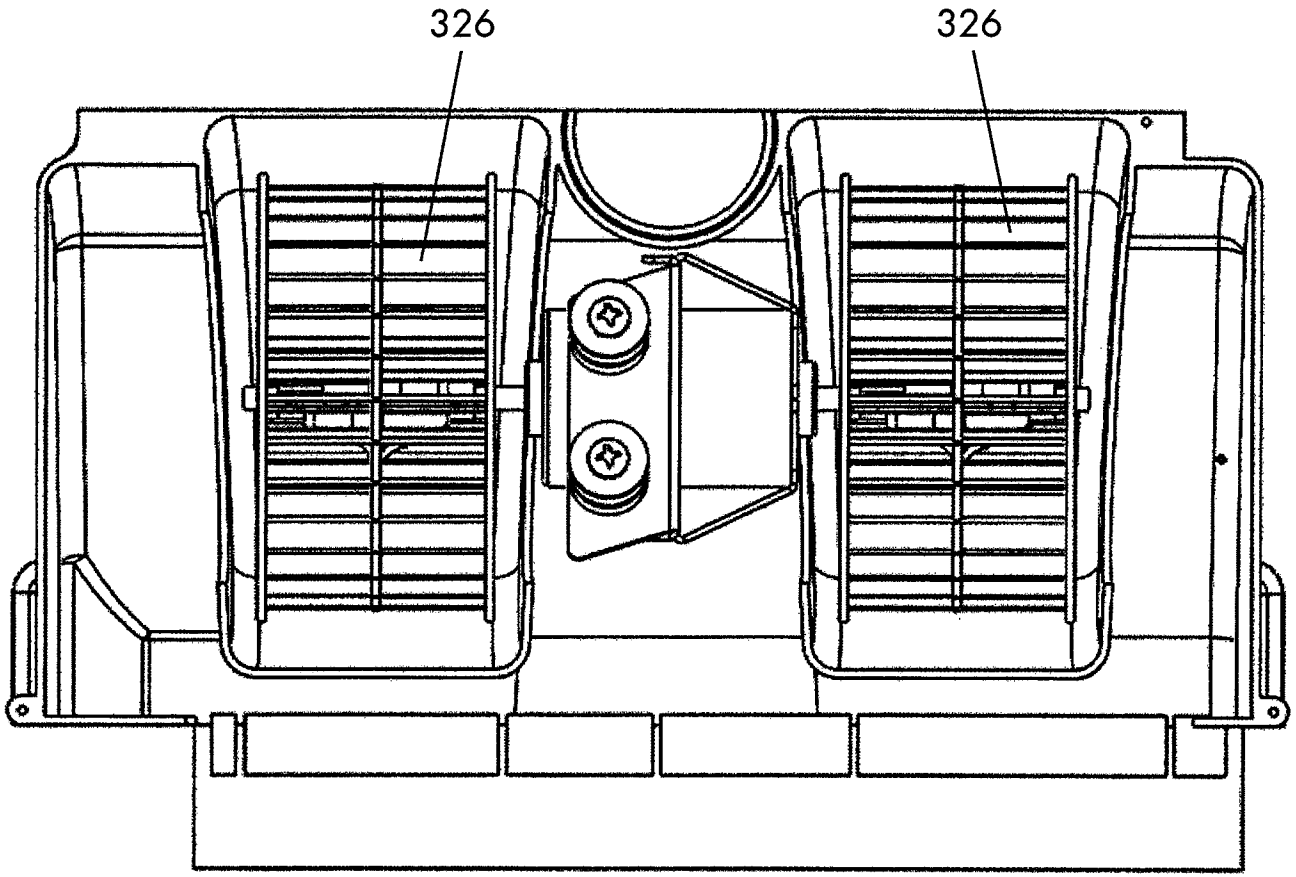
Figure 62:
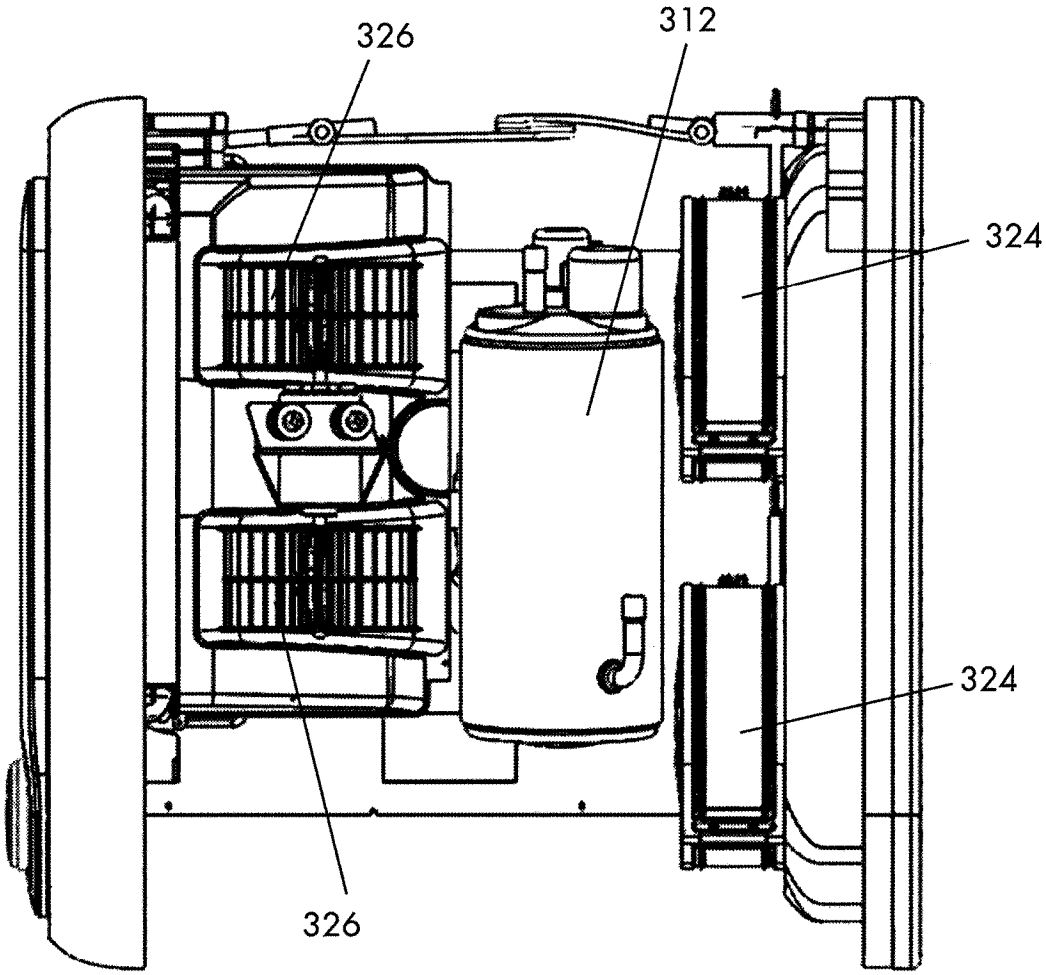

FIGS. 58-62 illustrate one such alternate embodiment 300 that utilizes a different compressor configuration, a different number of motors, and different axes of rotation for the centrifugal evaporator fans and axial condenser fans, while still achieving the advantages described above with respect to the present window air conditioner. As shown in FIG. 58, the compressor 312 is still arranged between the evaporator 318 and condenser 316, but along a direction that is parallel to those heat exchangers. The centrifugal evaporator fans 326 are still arranged in front of the compressor 312, while the axial condenser fans 324 are arranged behind the compressor 312, in order to suck room temperature air in through the evaporator 318 to be cooled and expelled through the evaporator fans 326, while outside air is drawn in by the axial fans 324 and blown through the condenser 316 to cool down the refrigerant. This alternate arrangement of the internal components still maintains the low profile of the window air conditioner, where the total height of the unit is determined by the maximum diameter of the compressor, evaporator fans, and condenser fans, all of which are substantially the same as each other. The two centrifugal evaporator fans 326 are driven by a central motor along the same rotational axis, which is substantially parallel to the direction along which the compressor 312 and heat exchanger (e.g., evaporator 318 and condenser 316) bodies extend.

Alternatively, each centrifugal evaporator fan 326 can be driven by its own motor, which would allow each evaporator fan 326 to operate separately at its own fan speed, and along its own rotational axis which may be offset from the rotational axis of the other evaporator fan. Having the two evaporator fans 326 arranged along slightly offset rotational axes may be desirable in order to meet space constraints within the window air conditioner housing, so that other components may be arranged near the fans, or can be done to optimize the desired airflow and pressure created by the evaporator fans. In this alternate embodiment, each axial condenser fan 324 is driven by its own motor, which can be incorporated into the fan itself and integrated within the fan hub. The axial condenser fans 324 each rotate around an axis that is substantially perpendicular to the rotational axis of the centrifugal evaporator fans 326. As discussed above, the separately operated axial fans can each rotate at a different fan speed, and may be arranged with respect to the condenser and the rest of the assemblies to maximize airflow and pressure to achieve desirable efficiencies and flow rates.

Accordingly, even though the figures in the present application show embodiments utilizing a certain combination of motors and fans, and specific arrangement of the horizontally mounted compressor with respect to the fans, such configurations should not be interpreted as being a limitation on the present invention.

What is claimed is:

1. A mounting frame for locating an air conditioner in an opening, the mounting frame comprising:

a first portion having a height in a longitudinal direction and a width in a lateral direction dimensioned to enclose an area that includes an air conditioner receiving aperture; and, an adjustable closure including a plurality of panels, each panel of the plurality of panels (i) being separable from each other, (ii) including male and female portions formed on lateral edges of the plurality of panels such that the plurality of panels are attachable to each other to adjust a size of the adjustable closure in the lateral direction and (iii) configured to close any remaining portion of the opening by adding or removing at least one panel among the plurality of panels depending on a size of the opening.

2. The mounting frame of claim 1, wherein the plurality of panels and the first portion are positioned within the adjustable closure.

3. The mounting frame of claim 1, wherein a distance that a first panel and a second panel of the plurality of panels can slide relative to each other is restricted by abutment between respective female and male portions.

4. The mounting frame of claim 1, wherein the edges that define the female and male portions extend in the same direction as the height of the first portion.

5. The mounting frame of claim 1, wherein the adjustable closure has a height that is at least equal to the height of the first portion, and the plurality of panels are mounted within an expander channel that moves toward and away from the first portion.

6. A mounting frame for locating an air conditioner in an opening, the mounting frame comprising:

a first portion having a height and a width sufficient to enclose an area that includes an air conditioner receiving aperture; and, at least one adjustable closure having a height in the direction of the height of the first portion and at least two panels adjustable in a direction that is along the width of the first portion so that the at least one adjustable closure adjusts in a direction that is along the width of the first portion and closes any remaining portion of an air conditioner opening, wherein the at least one adjustable closure has at least three interconnected panels;

a first one of the at least three interconnected panels has an edge that defines a female portion of a first interconnection, a second one of the at least three interconnected panels has a first edge that defines a male portion of the first interconnection and a second edge that defines a female portion of a second interconnection, and a third one of the at least three interconnected panels has an edge that defines a male portion of the second interconnection, whereby the female portions and the male portions alternate and adjustment of the panels relative to each other is restricted by contact between the female portions and the male portions of the first and second interconnections.

7. A mounting frame for locating an air conditioner in an opening, the mounting frame comprising:

a first portion having a height in a longitudinal direction and a width in a lateral direction dimensioned to enclose an area that includes an air conditioner receiving aperture; and an adjustable closure including a plurality of separate panels, each panel of the plurality of separate panels including a male lateral end portion and a female lateral end portion that each extend along the longitudinal direction, such that when the male and female portions of two adjoining panels are connected with each other, relative sliding in the lateral direction between the two adjoining panels is permitted and a size of the adjustment closure in the lateral direction is adjusted based on the relative sliding between the two adjoining panels.

8. The mounting frame of claim 7, wherein the plurality of separate panels are attachable and detachable to each other via longitudinal displacement of a first panel relative to a second panel such that the male lateral end portion engages and disengages with the female lateral end portion.

* * * * *